US010272317B2

(12) United States Patent
Watterson

(10) Patent No.: US 10,272,317 B2
(45) Date of Patent: Apr. 30, 2019

(54) LIGHTED PACE FEATURE IN A TREADMILL

(71) Applicant: ICON Health & Fitness, Inc., Logan, UT (US)

(72) Inventor: Scott R. Watterson, Providence, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 32 days.

(21) Appl. No.: 15/460,074

(22) Filed: Mar. 15, 2017

(65) Prior Publication Data

US 2017/0266534 A1 Sep. 21, 2017

Related U.S. Application Data

(60) Provisional application No. 62/310,300, filed on Mar. 18, 2016.

(51) Int. Cl.

| | |
|---|---|
| ***A63B 22/02*** | (2006.01) |
| ***A63B 24/00*** | (2006.01) |
| ***A63B 71/06*** | (2006.01) |

(52) U.S. Cl.

CPC ..... *A63B 71/0686* (2013.01); *A63B 22/0235* (2013.01); *A63B 24/0075* (2013.01); *A63B 71/0622* (2013.01)

(58) Field of Classification Search

None

See application file for complete search history.

(56) References Cited

U.S. PATENT DOCUMENTS

| | | | |
|---|---|---|---|
| 232,022 | A | 9/1880 | Gifford |
| 284,294 | A | 9/1883 | Graves |
| 321,388 | A | 6/1885 | Ruebsam |
| 339,638 | A | 4/1886 | Goldie |
| 348,493 | A | 8/1886 | Greene |
| 421,779 | A | 2/1890 | Steven |
| 447,780 | A | 3/1891 | Luge |
| 450,792 | A | 4/1891 | Dodd |
| 470,837 | A | 3/1892 | Hart |
| 549,084 | A | 10/1895 | Whitaker |
| 601,307 | A | 3/1898 | Salisbury |
| 659,216 | A | 10/1900 | Dowling |
| 663,486 | A | 12/1900 | Boren |
| 674,391 | A | 5/1901 | Baker |
| 683,284 | A | 9/1901 | Honey |
| 766,930 | A | 8/1904 | Clemons |
| 881,521 | A | 3/1908 | Wilson |
| 897,722 | A | 9/1908 | Day |
| 931,394 | A | 8/1909 | Day |
| 937,795 | A | 10/1909 | Hackney |
| 1,016,729 | A | 2/1912 | Barrett |
| 1,020,777 | A | 3/1912 | Peterson |
| 1,064,968 | A | 6/1913 | Hagen |
| 1,082,940 | A | 12/1913 | Flora |
| 1,211,765 | A | 1/1917 | Schmidt |

(Continued)

*Primary Examiner* — Stephen R Crow

(74) *Attorney, Agent, or Firm* — Ray Quinney & Nebeker

(57) ABSTRACT

A treadmill includes an exercise deck. The exercise deck includes a platform, a first pulley attached to the platform in a front portion, a second pulley attached to the platform in a second portion, a tread belt surrounding the first pulley and the second pulley, and a pacing mechanism incorporated into the platform.

20 Claims, 6 Drawing Sheets

(56) References Cited

U.S. PATENT DOCUMENTS 1,570,482 A 1/1926 Hale
1,580,530 A 4/1926 Rambo
1,585,748 A 5/1926 Wendelken
1,715,870 A 6/1929 Augustine
1,766,089 A 6/1930 Wood
1,778,635 A 10/1930 Heisler
1,824,406 A 9/1931 Petersime
1,850,530 A 3/1932 Brown
1,893,728 A 1/1933 Bullis
1,902,694 A 3/1933 Edwards
1,919,627 A 7/1933 Fitz Gerald
1,928,089 A 9/1933 Blickman
1,930,416 A 10/1933 Alfred
1,973,945 A 9/1934 Chavin
1,978,579 A 10/1934 Hooks
1,982,843 A 12/1934 Traver
2,067,136 A 1/1937 Brindenbaugh
2,117,957 A 5/1938 Ritter
2,165,700 A 7/1939 Henry
2,177,957 A 10/1939 Stewart
2,219,219 A 10/1940 Boger
2,247,946 A 7/1941 Hein et al.
2,255,864 A 9/1941 Stephens
2,315,485 A 4/1943 Le Roy
2,399,915 A 5/1946 Drake
2,413,841 A 1/1947 Minuto
2,440,644 A 4/1948 Powell
2,569,007 A 9/1951 Klyce
2,607,816 A 8/1952 Ryder
2,632,645 A 3/1953 Barkschat
2,645,539 A 7/1953 Thompson
2,646,282 A 7/1953 Ringman
2,648,540 A 8/1953 Hunter
2,674,453 A 4/1954 Hummert
2,743,623 A 5/1956 Wells
2,746,822 A 5/1956 Copenhaver
2,779,139 A 1/1957 Boettcher
2,842,365 A 7/1958 Kelley
2,855,200 A 10/1958 Blickman
2,874,971 A 2/1959 Devery
2,906,532 A 9/1959 Echols
2,969,060 A 1/1961 Swanda
2,984,594 A 5/1961 Runton
3,035,671 A 5/1962 Sicherman
3,059,312 A 10/1962 Sicherman
3,068,950 A 12/1962 Davidson
3,072,426 A 1/1963 Gilbert
3,112,108 A 11/1963 Hanke
3,127,171 A 3/1964 Noland et al.
3,179,071 A 4/1965 Johnston
3,193,287 A 7/1965 Robinson
3,205,888 A 9/1965 Stroop
3,316,898 A 5/1967 Brown
3,319,273 A 5/1967 Solin
3,342,485 A 9/1967 Gaul
3,345,067 A 10/1967 Smith
3,358,813 A 12/1967 Kohlhagen
3,378,259 A 4/1968 Kupchinski
3,394,934 A 7/1968 Elia
3,408,067 A 10/1968 Armstrong
3,408,069 A 10/1968 Lewis
3,411,497 A 11/1968 Rickey et al.
3,416,174 A 12/1968 Novitske
3,424,005 A 1/1969 Brown
3,430,084 A 2/1969 Hall
3,430,507 A 3/1969 Hurst et al.
3,432,164 A 3/1969 Deeks
3,438,627 A 4/1969 La Lanne
3,444,830 A 5/1969 Doetsch
3,446,503 A 5/1969 Lawton
3,501,140 A 3/1970 Eichorn
3,511,500 A 5/1970 Dunn
3,514,110 A 5/1970 Thomander
3,518,985 A 7/1970 Quinton
3,547,435 A 12/1970 Scott
3,554,541 A 1/1971 Faye
3,563,541 A 2/1971 Sanquist
3,566,861 A 3/1971 Weiss
3,567,219 A 3/1971 Foster
3,568,669 A 3/1971 Stites
3,572,700 A 3/1971 Mastropaolo
3,583,465 A 6/1971 Youngs et al.
3,586,322 A 6/1971 Kverneland
3,589,715 A 6/1971 Mark
3,592,466 A 7/1971 Parsons
3,598,404 A 8/1971 Bowman
3,602,502 A 8/1971 Jaegar
3,606,320 A 9/1971 Erwin, Jr.
3,608,898 A 9/1971 Berlin
3,614,097 A 10/1971 Blickman
3,628,654 A 12/1971 Haracz
3,628,791 A 12/1971 Garcia
3,634,895 A 1/1972 Childers
3,636,577 A 1/1972 Nissen
3,638,941 A 2/1972 Kulkens
3,640,528 A 2/1972 Proctor
3,641,601 A 2/1972 Sieg
3,642,279 A 2/1972 Cutter
3,643,943 A 2/1972 Erwin, Jr. et al.
3,650,529 A 3/1972 Salm
3,658,327 A 4/1972 Thiede
3,659,845 A 5/1972 Quinton
3,664,666 A 5/1972 Lloyd
3,686,776 A 8/1972 Dahl
3,689,066 A 9/1972 Hagen
3,703,284 A 11/1972 Hesen
3,708,166 A 1/1973 Annas
3,709,197 A 1/1973 Moseley
3,728,940 A 4/1973 Peterson
3,731,917 A 5/1973 Townsend
3,738,649 A 6/1973 Miller
3,741,538 A 6/1973 Useldinger
3,744,480 A 7/1973 Gause et al.
3,744,712 A 7/1973 Papadopoulos
3,744,794 A 7/1973 Gause et al.
3,751,033 A 8/1973 Rosenthal
3,756,595 A 9/1973 Hague
3,767,195 A 10/1973 Dimick
3,782,718 A 1/1974 Saylor
3,788,412 A 1/1974 Vincent
3,792,860 A 2/1974 Selnes
3,802,698 A 4/1974 Burian et al.
3,809,393 A 5/1974 Jones
3,814,420 A 6/1974 Encke
3,818,194 A 6/1974 Biro
3,822,488 A 7/1974 Johnson
3,822,599 A 7/1974 Brentham
3,826,491 A 7/1974 Elder
3,834,696 A 9/1974 Spector
3,845,756 A 11/1974 Olsson
3,848,467 A 11/1974 Flavell
3,851,874 A 12/1974 Wilkin
3,858,938 A 1/1975 Kristensson et al.
3,859,840 A 1/1975 Gause
3,861,215 A 1/1975 Bradley
3,869,121 A 3/1975 Flavell
3,870,297 A 3/1975 Elder
3,874,657 A 4/1975 Niebojewski
3,880,274 A 4/1975 Bechtloff
3,883,922 A 5/1975 Fleischhauer
3,892,404 A 7/1975 Martucci
3,901,379 A 8/1975 Blackwell
3,902,480 A 9/1975 Wilson
3,903,613 A 9/1975 Bisberg
3,904,196 A 9/1975 Berlin
3,909,857 A 10/1975 Herrera
3,912,263 A 10/1975 Yatso
3,918,710 A 11/1975 Niebojewski
3,926,430 A 12/1975 Good
3,929,026 A 12/1975 Hofmann
3,938,400 A 2/1976 Konyha
3,941,377 A 3/1976 Lie
3,948,513 A 4/1976 Pfotenhauer
3,963,101 A 6/1976 Stadelmann et al.

(56) References Cited

U.S. PATENT DOCUMENTS 3,974,491 A 8/1976 Sipe
3,977,451 A 8/1976 Duba
3,981,500 A 9/1976 Ryan
4,012,015 A 3/1977 Nelson et al.
4,020,795 A 5/1977 Marks
4,024,949 A 5/1977 Kleysteuber et al.
4,026,545 A 5/1977 Schonenberger
4,027,531 A 6/1977 Dawson
4,033,567 A 7/1977 Lipfert
4,056,265 A 11/1977 Ide
4,063,726 A 12/1977 Wilson
4,063,727 A 12/1977 Hall
4,066,257 A 1/1978 Moller
4,066,259 A 1/1978 Brentham
4,067,372 A 1/1978 Masson
4,071,235 A 1/1978 Zent
4,072,309 A 2/1978 Wilson
4,077,626 A 3/1978 Newman
4,082,267 A 4/1978 Flavell
4,093,196 A 6/1978 Bauer
4,094,330 A 6/1978 Jong
4,111,417 A 9/1978 Gardner
4,112,928 A 9/1978 Putsch
4,113,071 A 9/1978 Muller et al.
4,120,294 A 10/1978 Wolfe
4,120,924 A 10/1978 Rainville
4,141,158 A 2/1979 Benseler et al.
4,146,222 A 3/1979 Hribar
4,149,714 A 4/1979 Lambert, Jr.
4,151,988 A 5/1979 Nabinger
4,151,994 A 5/1979 Stalberger, Jr.
4,161,998 A 7/1979 Trimble
4,167,938 A 9/1979 Remih
4,168,061 A 9/1979 Gordon
4,171,805 A 10/1979 Abbott
4,179,134 A 12/1979 Atkinson
4,183,156 A 1/1980 Rudy
4,183,494 A 1/1980 Cleveland
4,188,030 A 2/1980 Hooper
4,199,139 A 4/1980 Mahnke
4,204,673 A 5/1980 Speer, Sr.
4,208,049 A 6/1980 Wilson
4,215,516 A 8/1980 Huschle et al.
4,216,856 A 8/1980 Moring et al.
4,220,996 A 9/1980 Searcy
4,227,689 A 10/1980 Keiser
4,235,437 A 11/1980 Ruis et al.
4,236,239 A 11/1980 Imgruth et al.
4,239,092 A 12/1980 Janson
4,240,627 A 12/1980 Brentham
4,248,476 A 2/1981 Phelps
4,249,725 A 2/1981 Mattox
4,251,932 A 2/1981 Love
4,253,661 A 3/1981 Russell
4,258,821 A 3/1981 Wendt
4,258,913 A 3/1981 Brentham
4,274,625 A 6/1981 Gaetano
4,278,095 A 7/1981 Lapeyre
4,278,249 A 7/1981 Forrest
4,286,782 A 9/1981 Fuhrhop
4,290,601 A 9/1981 Mittelstadt
4,298,893 A 11/1981 Holmes
4,300,761 A 11/1981 Howard
4,301,808 A 11/1981 Taus
4,313,602 A 2/1982 Sullivan
4,313,603 A 2/1982 Simjian
4,322,609 A 3/1982 Kato
4,323,237 A 4/1982 Jungerwirth
4,324,501 A 4/1982 Herbenar
4,333,978 A 6/1982 Kocher
4,334,676 A 6/1982 Schonenberger
4,334,695 A 6/1982 Ashby
4,337,283 A 6/1982 Haas, Jr.
4,337,529 A 6/1982 Morokawa
4,342,452 A 8/1982 Summa
4,344,616 A 8/1982 Ogden
4,349,597 A 9/1982 Fine et al.
4,350,336 A 9/1982 Hanford
4,354,676 A 10/1982 Ariel
4,355,645 A 10/1982 Mitani et al.
4,358,105 A 11/1982 Sweeney, Jr.
4,363,480 A 12/1982 Fisher et al.
4,363,486 A 12/1982 Chaudhry
4,367,895 A 1/1983 Pacitti et al.
4,369,081 A 1/1983 Curry et al.
4,370,766 A 2/1983 Teague, Jr.
4,374,587 A 2/1983 Ogden
4,377,045 A 3/1983 Moulinex
4,378,111 A 3/1983 Tsuchida et al.
4,383,684 A 5/1983 Schliep
4,383,714 A 5/1983 Ishida
4,389,047 A 6/1983 Hall
4,397,462 A 8/1983 Wilmarth
4,406,451 A 9/1983 Gaetano
4,408,613 A 10/1983 Relyea
4,422,635 A 12/1983 Herod
4,422,636 A 12/1983 de Angeli
4,423,630 A 1/1984 Morrison
4,423,864 A 1/1984 Wiik
4,426,077 A 1/1984 Becker
4,431,181 A 2/1984 Baswell
4,434,981 A 3/1984 Norton
4,441,708 A 4/1984 Brentham
4,445,684 A 5/1984 Ruff
4,452,448 A 6/1984 Ausherman
4,453,766 A 6/1984 DiVito
4,461,472 A 7/1984 Martinez
4,465,277 A 8/1984 Dittrich
4,476,582 A 10/1984 Strauss et al.
4,477,071 A 10/1984 Brown et al.
4,480,831 A 11/1984 Muller-Deinhardt
4,489,933 A 12/1984 Fisher
4,491,318 A 1/1985 Francke
4,493,561 A 1/1985 Bouchet-Lassale
4,494,662 A 1/1985 Clymer
4,495,560 A 1/1985 Sugimoto et al.
4,496,147 A 1/1985 DeCloux et al.
4,499,784 A 2/1985 Shum
4,502,679 A 3/1985 De Lorenzo
4,504,055 A 3/1985 Wells
4,504,968 A 3/1985 Kaneko et al.
4,505,474 A 3/1985 Mattox
4,505,475 A 3/1985 Olschansky et al.
4,509,510 A 4/1985 Hook
4,512,566 A 4/1985 Bicocchi
4,512,567 A 4/1985 Phillips
4,512,571 A 4/1985 Hermelin
4,515,988 A 5/1985 Bayer et al.
4,519,603 A 5/1985 Decloux
4,522,394 A 6/1985 Broussard
4,529,194 A 7/1985 Haaheim
4,529,196 A 7/1985 Logan
4,533,136 A 8/1985 Smith et al.
4,536,244 A 8/1985 Greci et al.
4,537,396 A 8/1985 Hooper
4,538,805 A 9/1985 Parviainen
4,542,897 A 9/1985 Melton
4,542,899 A 9/1985 Hendricks
4,544,152 A 10/1985 Taitel
4,544,153 A 10/1985 Babcock
4,546,971 A 10/1985 Raasoch
4,548,405 A 10/1985 Lee
4,549,044 A 10/1985 Durham
4,549,733 A 10/1985 Salyer
4,555,108 A 11/1985 Monteiro
4,556,216 A 12/1985 Pitkanen
4,563,001 A 1/1986 Terauds
4,563,003 A 1/1986 Bugallo et al.
4,564,193 A 1/1986 Stewart
4,566,461 A 1/1986 Lubell et al.
4,566,689 A 1/1986 Ogden
4,566,732 A 1/1986 Ostergaard, Sr.
4,569,518 A 2/1986 Fulks
4,571,682 A 2/1986 Silverman et al.

(56) References Cited

U.S. PATENT DOCUMENTS 4,572,500 A 2/1986 Weiss
4,572,504 A 2/1986 DiBartolo
4,573,449 A 3/1986 Warnke
4,576,352 A 3/1986 Ogden
4,576,376 A 3/1986 Miller
4,577,860 A 3/1986 Matias et al.
4,577,865 A 3/1986 Shishido
4,580,983 A 4/1986 Cassini et al.
4,581,269 A 4/1986 Tilman
4,582,320 A 4/1986 Shaw
4,586,495 A 5/1986 Petrofsky
4,589,656 A 5/1986 Baldwin
4,591,147 A 5/1986 Smith et al.
4,592,544 A 6/1986 Smith et al.
4,600,196 A 7/1986 Jones
4,601,142 A 7/1986 Frommelt
4,602,779 A 7/1986 Ogden
4,610,449 A 9/1986 Diercks, Jr.
4,614,337 A 9/1986 Schonenberger
4,616,822 A 10/1986 Trulaske
4,618,139 A 10/1986 Haaheim
4,618,140 A 10/1986 Brown
4,619,454 A 10/1986 Walton
4,621,623 A 11/1986 Wang
4,624,457 A 11/1986 Silberman et al.
4,625,962 A 12/1986 Street
4,627,614 A 12/1986 De Angeli
4,627,615 A 12/1986 Nurkowski
4,627,616 A 12/1986 Kauffman
4,630,817 A 12/1986 Buckley
4,632,385 A 12/1986 Geraci
4,632,386 A 12/1986 Beech
4,632,390 A 12/1986 Richey
4,634,127 A 1/1987 Rockwell
4,635,927 A 1/1987 Shu
4,635,928 A 1/1987 Ogden et al.
4,637,605 A 1/1987 Ritchie
4,638,523 A 1/1987 Todd
4,638,969 A 1/1987 Brown
4,641,833 A 2/1987 Trethewey
4,642,080 A 2/1987 Takano et al.
4,642,769 A 2/1987 Petrofsky
4,643,418 A 2/1987 Bart
4,645,197 A 2/1987 Mcfee
4,645,200 A 2/1987 Hix
4,645,201 A 2/1987 Evans
4,645,917 A 2/1987 Penney et al.
4,647,037 A 3/1987 Donohue
4,647,041 A 3/1987 Whiteley
4,650,067 A 3/1987 Brule
4,650,184 A 3/1987 Brebner
4,650,185 A 3/1987 Cartwright
4,651,446 A 3/1987 Yukawa et al.
4,651,581 A 3/1987 Svensson
4,659,074 A 4/1987 Taitel et al.
4,659,077 A 4/1987 Stropkay
4,659,078 A 4/1987 Blome
4,662,630 A 5/1987 Dignard et al.
4,664,371 A 5/1987 Viander
4,664,373 A 5/1987 Hait
4,664,646 A 5/1987 Rorabaugh
4,665,388 A 5/1987 Ivie et al.
4,671,257 A 6/1987 Kaiser et al.
4,673,177 A 6/1987 Szymski
4,674,740 A 6/1987 Iams et al.
4,674,743 A 6/1987 Hirano
4,678,182 A 7/1987 Nakao et al.
4,678,185 A 7/1987 Mahnke
4,679,786 A 7/1987 Rodgers
4,679,787 A 7/1987 Guilbault
4,684,121 A 8/1987 Nestegard
4,685,670 A 8/1987 Zinkin
4,687,195 A 8/1987 Potts
4,697,809 A 10/1987 Rockwell
4,700,946 A 10/1987 Breunig
4,702,475 A 10/1987 Elstein et al.
4,705,267 A 11/1987 Jackson
4,708,337 A 11/1987 Shyu
4,708,338 A 11/1987 Potts
4,708,837 A 11/1987 Baxter et al.
4,709,917 A 12/1987 Yang
4,709,918 A 12/1987 Grinblat
4,709,920 A 12/1987 Schnell
4,711,447 A 12/1987 Mansfield
4,714,244 A 12/1987 Kolomayets et al.
4,714,248 A 12/1987 Koss
4,718,207 A 1/1988 Frommelt
4,720,093 A 1/1988 Del Mar
4,720,099 A 1/1988 Carlson
4,720,789 A 1/1988 Hector et al.
4,721,303 A 1/1988 Fitzpatrick
4,725,057 A 2/1988 Shifferaw
4,726,581 A 2/1988 Chang
4,726,582 A 2/1988 Fulks
4,728,099 A 3/1988 Pitre
4,729,558 A 3/1988 Kuo
4,729,562 A 3/1988 Pipasik
4,730,828 A 3/1988 Lane
4,730,829 A 3/1988 Carlson
4,733,858 A 3/1988 Lan
4,743,009 A 5/1988 Beale
4,743,015 A 5/1988 Marshall
4,744,559 A 5/1988 Mahnke et al.
4,746,115 A 5/1988 Lahman
4,749,184 A 6/1988 Tobin
4,750,736 A 6/1988 Watterson
4,750,738 A 6/1988 Dang
4,751,755 A 6/1988 Carey, Jr. et al.
4,756,098 A 7/1988 Boggia
4,757,495 A 7/1988 Decker et al.
4,757,987 A 7/1988 Allemand
4,759,540 A 7/1988 Yu et al.
4,763,284 A 8/1988 Carlin
4,765,613 A 8/1988 Voris
4,770,411 A 9/1988 Armstrong et al.
4,771,148 A 9/1988 Bersonnet
4,771,577 A 9/1988 Abe
4,772,015 A 9/1988 Carlson et al.
4,773,170 A 9/1988 Moore et al.
4,774,679 A 9/1988 Carlin
4,776,582 A 10/1988 Ramhorst
4,779,884 A 10/1988 Minati
4,786,049 A 11/1988 Lautenschlager
4,786,050 A 11/1988 Geschwender
4,789,153 A 12/1988 Brown
4,790,522 A 12/1988 Drutchas
4,790,528 A 12/1988 Nakao et al.
4,792,134 A 12/1988 Chen
4,797,968 A 1/1989 Wenzlick
4,798,377 A 1/1989 White
4,798,760 A 1/1989 Diaz-Kotti
4,799,475 A 1/1989 Iams et al.
4,799,671 A 1/1989 Hoggan
4,801,079 A 1/1989 Gonella
4,804,178 A 2/1989 Friedebach
4,805,901 A 2/1989 Kulick
4,807,874 A 2/1989 Little
4,809,804 A 3/1989 Houston et al.
4,809,972 A 3/1989 Rasmussen et al.
4,813,665 A 3/1989 Carr
4,813,667 A 3/1989 Watterson
4,813,668 A 3/1989 Solloway
4,813,743 A 3/1989 Mizelle
4,814,661 A 3/1989 Ratzlaff et al.
4,817,938 A 4/1989 Nakao et al.
4,817,939 A 4/1989 Augspurger et al.
4,817,940 A 4/1989 Shaw et al.
4,818,175 A 4/1989 Kaisha
4,818,234 A 4/1989 Redington
4,819,583 A 4/1989 Guerra
4,819,818 A 4/1989 Simkus
4,822,029 A 4/1989 Sarno
4,822,034 A 4/1989 Shields
4,824,104 A 4/1989 Bloch

(56) References Cited

U.S. PATENT DOCUMENTS

| | | | |
|---|---|---|---|
| 4,826,153 | A | 5/1989 | Schalip |
| 4,826,157 | A | 5/1989 | Fitzpatrick |
| 4,826,158 | A | 5/1989 | Fields, Jr. |
| 4,826,159 | A | 5/1989 | Hersey |
| 4,828,255 | A | 5/1989 | Lahman |
| 4,828,257 | A | 5/1989 | Dyer et al. |
| 4,828,522 | A | 5/1989 | Santos |
| 4,828,713 | A | 5/1989 | McDonald et al. |
| 4,830,362 | A | 5/1989 | Bull |
| 4,830,363 | A | 5/1989 | Kennedy |
| 4,832,332 | A | 5/1989 | Dumbser |
| 4,836,530 | A | 6/1989 | Stanley, Jr. |
| 4,837,157 | A | 6/1989 | Turnell et al. |
| 4,838,543 | A | 6/1989 | Armstrong et al. |
| 4,838,544 | A | 6/1989 | Sasakawa et al. |
| 4,840,372 | A | 6/1989 | Oglesby et al. |
| 4,842,274 | A | 6/1989 | Oosthuizen |
| 4,844,449 | A | 7/1989 | Truslaske |
| 4,844,450 | A | 7/1989 | Rodgers, Jr. |
| 4,846,693 | A | 7/1989 | Baer |
| 4,848,737 | A | 7/1989 | Ehrenfield |
| 4,850,585 | A | 7/1989 | Dalebout |
| 4,855,942 | A | 8/1989 | Bianco |
| 4,860,763 | A | 8/1989 | Schminke |
| 4,861,023 | A | 8/1989 | Wedman |
| 4,861,025 | A | 8/1989 | Rockwell |
| 4,863,157 | A | 9/1989 | Mendel et al. |
| 4,863,161 | A | 9/1989 | Telle |
| 4,865,344 | A | 9/1989 | Romero, Sr. et al. |
| 4,866,704 | A | 9/1989 | Bergman |
| 4,867,442 | A | 9/1989 | Matthews |
| 4,867,443 | A | 9/1989 | Jensen |
| 4,869,493 | A | 9/1989 | Johnston |
| 4,869,494 | A | 9/1989 | Lambert, Sr. |
| 4,869,497 | A | 9/1989 | Stewart et al. |
| 4,875,676 | A | 10/1989 | Zimmer |
| 4,877,239 | A | 10/1989 | Dela Rosa |
| 4,878,662 | A | 11/1989 | Chern |
| 4,878,663 | A | 11/1989 | Luquette |
| 4,880,227 | A | 11/1989 | Sowell |
| 4,883,272 | A | 11/1989 | Lay |
| 4,886,266 | A | 12/1989 | Trulaske |
| 4,889,108 | A | 12/1989 | Bond et al. |
| 4,889,131 | A | 12/1989 | Salem et al. |
| 4,891,764 | A | 1/1990 | McIntosh |
| 4,891,785 | A | 1/1990 | Donohoo |
| 4,894,933 | A | 1/1990 | Tonkel et al. |
| 4,898,379 | A | 2/1990 | Shiba |
| 4,898,381 | A | 2/1990 | Gordon |
| 4,900,012 | A | 2/1990 | Fu |
| 4,900,013 | A | 2/1990 | Rodgers, Jr. |
| 4,900,017 | A | 2/1990 | Bold, Jr. |
| 4,900,018 | A | 2/1990 | Ish |
| 4,902,006 | A | 2/1990 | Stallings, Jr. |
| 4,904,829 | A | 2/1990 | Berthaud et al. |
| 4,905,330 | A | 3/1990 | Jacobs |
| 4,907,795 | A | 3/1990 | Shaw et al. |
| 4,907,797 | A | 3/1990 | Gezari et al. |
| 4,907,798 | A | 3/1990 | Burchatz |
| 4,907,973 | A | 3/1990 | Hon |
| 4,909,504 | A | 3/1990 | Yang |
| 4,911,427 | A | 3/1990 | Kabushiki |
| 4,911,438 | A | 3/1990 | Van Straaten |
| 4,912,638 | A | 3/1990 | Pratt, Jr. |
| 4,913,396 | A | 4/1990 | Dalebout et al. |
| 4,913,423 | A | 4/1990 | Farran |
| 4,915,377 | A | 4/1990 | Malnke et al. |
| 4,915,379 | A | 4/1990 | Sapp |
| 4,917,376 | A | 4/1990 | Lo |
| 4,919,418 | A | 4/1990 | Miller |
| 4,919,419 | A | 4/1990 | Houston |
| 4,921,242 | A | 5/1990 | Watterson |
| 4,921,247 | A | 5/1990 | Sterling |
| 4,923,193 | A | 5/1990 | Pitzen et al. |
| 4,925,183 | A | 5/1990 | Kim |
| 4,925,189 | A | 5/1990 | Braeunig |
| 4,925,724 | A | 5/1990 | Ogden |
| 4,927,136 | A | 5/1990 | Leask |
| 4,928,546 | A | 5/1990 | Walters |
| 4,928,957 | A | 5/1990 | Lanier et al. |
| 4,930,768 | A | 6/1990 | Lapcevic |
| 4,930,769 | A | 6/1990 | Nenoff |
| 4,930,770 | A | 6/1990 | Baker |
| 4,934,690 | A | 6/1990 | Bull |
| 4,934,692 | A | 6/1990 | Owens |
| 4,934,694 | A | 6/1990 | Mcintosh |
| 4,938,469 | A | 7/1990 | Crandell |
| 4,938,473 | A | 7/1990 | Lee |
| 4,938,474 | A | 7/1990 | Sweeney et al. |
| 4,940,233 | A | 7/1990 | Bull |
| 4,941,652 | A | 7/1990 | Nagano et al. |
| 4,941,673 | A | 7/1990 | Bennett |
| 4,948,121 | A | 8/1990 | Haaheim et al. |
| 4,949,954 | A | 8/1990 | Hix |
| 4,949,958 | A | 8/1990 | Richey |
| 4,949,959 | A | 8/1990 | Stevens |
| 4,949,993 | A | 8/1990 | Stark et al. |
| 4,952,265 | A | 8/1990 | Yamanaka et al. |
| 4,953,415 | A | 9/1990 | Lehtonen |
| 4,953,858 | A | 9/1990 | Zelli |
| 4,955,466 | A | 9/1990 | Almes et al. |
| 4,958,832 | A | 9/1990 | Kim |
| 4,959,713 | A | 9/1990 | Morotomi et al. |
| 4,960,276 | A | 10/1990 | Feuer et al. |
| 4,964,632 | A | 10/1990 | Rockwell |
| 4,968,028 | A | 11/1990 | Wehrell |
| 4,971,316 | A | 11/1990 | Dalebout et al. |
| 4,974,831 | A | 12/1990 | Dunham |
| 4,974,832 | A | 12/1990 | Dalebout |
| 4,976,424 | A | 12/1990 | Sargeant et al. |
| 4,976,428 | A | 12/1990 | Ghazi |
| 4,976,435 | A | 12/1990 | Shatford |
| 4,983,847 | A | 1/1991 | Bryan |
| 4,984,810 | A | 1/1991 | Stearns et al. |
| 4,986,261 | A | 1/1991 | Iams et al. |
| 4,986,534 | A | 1/1991 | Meier et al. |
| 4,986,689 | A | 1/1991 | Drutchas |
| 4,989,860 | A | 2/1991 | Iams et al. |
| 4,992,190 | A | 2/1991 | Shtarkman |
| 4,998,725 | A | 3/1991 | Watterson et al. |
| 5,000,440 | A | 3/1991 | Lynch |
| 5,000,442 | A | 3/1991 | Dalebout et al. |
| 5,001,632 | A | 3/1991 | Hal Tipping |
| 5,002,271 | A | 3/1991 | Gonzales |
| 5,004,224 | A | 4/1991 | Wang |
| 5,007,630 | A | 4/1991 | Real et al. |
| 5,007,631 | A | 4/1991 | Wang |
| 5,013,031 | A | 5/1991 | Bull |
| 5,015,926 | A | 5/1991 | Casler |
| 5,016,870 | A | 5/1991 | Bulloch et al. |
| 5,020,793 | A | 6/1991 | Loane |
| 5,020,794 | A | 6/1991 | Englehardt et al. |
| 5,020,795 | A | 6/1991 | Airy et al. |
| 5,024,441 | A | 6/1991 | Rousseau |
| 5,026,049 | A | 6/1991 | Goodman |
| 5,027,303 | A | 6/1991 | Witte |
| 5,029,801 | A | 7/1991 | Dalebout et al. |
| 5,031,455 | A | 7/1991 | Cline |
| 5,031,901 | A | 7/1991 | Saarinen |
| 5,034,576 | A | 7/1991 | Dalebout et al. |
| 5,035,418 | A | 7/1991 | Harabayashi |
| RE33,662 | E | 8/1991 | Blair et al. |
| 5,037,084 | A | 8/1991 | Flor |
| 5,037,089 | A | 8/1991 | Spagnuolo |
| 5,039,088 | A | 8/1991 | Shifferaw |
| 5,039,089 | A | 8/1991 | Lapcevic |
| 5,039,091 | A | 8/1991 | Johnson |
| 5,042,799 | A | 8/1991 | Stanley |
| 5,046,382 | A | 9/1991 | Steinberg |
| 5,046,722 | A | 9/1991 | Antoon |
| 5,048,823 | A | 9/1991 | Bean |
| 5,051,638 | A | 9/1991 | Pyles |
| 5,052,375 | A | 10/1991 | Stark |
| 5,052,684 | A | 10/1991 | Kosuge et al. |

(56) References Cited

U.S. PATENT DOCUMENTS

| | | | |
|---|---|---|---|
| 5,054,770 | A | 10/1991 | Bull |
| 5,054,774 | A | 10/1991 | Belsito |
| 5,058,881 | A | 10/1991 | Measom |
| 5,058,882 | A | 10/1991 | Dalebout et al. |
| 5,058,888 | A | 10/1991 | Walker et al. |
| 5,062,626 | A | 11/1991 | Dalebout et al. |
| 5,062,629 | A | 11/1991 | Vaughan |
| 5,062,632 | A | 11/1991 | Dalebout et al. |
| 5,066,000 | A | 11/1991 | Dolan |
| 5,067,710 | A | 11/1991 | Watterson et al. |
| 5,071,115 | A | 12/1991 | Welch |
| 5,072,928 | A | 12/1991 | Stearns et al. |
| 5,072,929 | A | 12/1991 | Peterson et al. |
| 5,074,550 | A | 12/1991 | Sloan |
| 5,077,916 | A | 1/1992 | Beneteau |
| 5,078,152 | A | 1/1992 | Bond et al. |
| 5,080,353 | A | 1/1992 | Tench |
| 5,081,991 | A | 1/1992 | Tench |
| 5,085,426 | A | 2/1992 | Wanzer et al. |
| 5,085,427 | A | 2/1992 | Finn |
| 5,086,385 | A | 2/1992 | Launey et al. |
| 5,087,047 | A | 2/1992 | McConnell |
| 5,088,729 | A | 2/1992 | Dalebout |
| 5,089,960 | A | 2/1992 | Sweeney, Jr. |
| 5,094,249 | A | 3/1992 | Marras et al. |
| 5,094,447 | A | 3/1992 | Wang |
| 5,096,225 | A | 3/1992 | Osawa |
| 5,102,122 | A | 4/1992 | Piane, Jr. |
| 5,102,380 | A | 4/1992 | Jacobson et al. |
| 5,104,119 | A | 4/1992 | Lynch |
| 5,104,120 | A | 4/1992 | Watterson et al. |
| 5,108,093 | A | 4/1992 | Watterson |
| 5,109,778 | A | 5/1992 | Berkowitz et al. |
| 5,110,117 | A | 5/1992 | Fisher et al. |
| 5,112,045 | A | 5/1992 | Mason et al. |
| 5,113,427 | A | 5/1992 | Ryoichi et al. |
| 5,114,388 | A | 5/1992 | Trulaske |
| 5,114,391 | A | 5/1992 | Pitzen et al. |
| 5,117,674 | A | 6/1992 | Howard |
| 5,118,112 | A | 6/1992 | Bregman et al. |
| 5,123,629 | A | 6/1992 | Takeuchi |
| 5,123,885 | A | 6/1992 | Shields |
| 5,123,886 | A | 6/1992 | Cook |
| 5,129,872 | A | 7/1992 | Dalton et al. |
| 5,131,895 | A | 7/1992 | Rogers, Jr. |
| 5,135,458 | A | 8/1992 | Huang |
| 5,137,501 | A | 8/1992 | Mertesdorf |
| 5,138,730 | A | 8/1992 | Masuda |
| 5,141,480 | A | 8/1992 | Lennox et al. |
| 5,142,358 | A | 8/1992 | Jason |
| 5,145,475 | A | 9/1992 | Cares |
| 5,145,481 | A | 9/1992 | Friedebach |
| 5,147,266 | A | 9/1992 | Ricard |
| 5,149,084 | A | 9/1992 | Dalebout et al. |
| 5,149,312 | A | 9/1992 | Croft et al. |
| 5,152,210 | A | 10/1992 | Chen |
| 5,158,093 | A | 10/1992 | Shvartz |
| 5,158,520 | A | 10/1992 | Lemke et al. |
| 5,162,029 | A | 11/1992 | Schine |
| 5,163,885 | A | 11/1992 | Wanzer et al. |
| 5,167,159 | A | 12/1992 | Lucking |
| 5,167,597 | A | 12/1992 | David |
| 5,167,850 | A | 12/1992 | Shtarkman |
| 5,171,196 | A | 12/1992 | Lynch |
| 5,176,602 | A | 1/1993 | Roberts |
| 5,178,593 | A | 1/1993 | Roberts |
| 5,178,599 | A | 1/1993 | Scott |
| 5,180,347 | A | 1/1993 | Chen |
| 5,180,351 | A | 1/1993 | Ehrenfried |
| 5,180,647 | A | 1/1993 | Rowland et al. |
| 5,181,894 | A | 1/1993 | Shieng |
| 5,184,295 | A | 2/1993 | Mann |
| 5,184,988 | A | 2/1993 | Dunham |
| 5,186,471 | A | 2/1993 | Vancraeynest |
| 5,186,697 | A | 2/1993 | Rennex |
| 5,192,255 | A | 3/1993 | Dalebout et al. |
| 5,192,257 | A | 3/1993 | Panasewicz |
| 5,192,258 | A | 3/1993 | Keller |
| 5,195,781 | A | 3/1993 | Osawa |
| 5,195,935 | A | 3/1993 | Fencel |
| 5,195,937 | A | 3/1993 | Engel et al. |
| 5,199,931 | A | 4/1993 | Easley et al. |
| 5,201,694 | A | 4/1993 | Zappel |
| 5,201,772 | A | 4/1993 | Maxwell |
| 5,202,424 | A | 4/1993 | Fencel |
| 5,203,229 | A | 4/1993 | Chen |
| 5,203,800 | A | 4/1993 | Meredith |
| 5,203,826 | A | 4/1993 | Dalebout |
| 5,204,670 | A | 4/1993 | Stinton |
| 5,205,798 | A | 4/1993 | Lekhtman |
| 5,205,800 | A | 4/1993 | Grant |
| 5,206,671 | A | 4/1993 | Eydelman et al. |
| 5,207,489 | A | 5/1993 | Miller |
| 5,207,622 | A | 5/1993 | Wilkinson et al. |
| 5,207,625 | A | 5/1993 | White |
| 5,207,628 | A | 5/1993 | Graham |
| 5,211,617 | A | 5/1993 | Millen |
| 5,213,555 | A | 5/1993 | Hood |
| 5,215,510 | A | 6/1993 | Baran |
| 5,217,422 | A | 6/1993 | Domzalski |
| 5,226,866 | A | 7/1993 | Engel et al. |
| 5,230,672 | A | 7/1993 | Brown et al. |
| 5,230,673 | A | 7/1993 | Maeyama et al. |
| 5,232,422 | A | 8/1993 | Bishop, Jr. |
| 5,233,520 | A | 8/1993 | Kretsch et al. |
| 5,234,392 | A | 8/1993 | Clark |
| 5,234,395 | A | 8/1993 | Miller et al. |
| 5,240,417 | A | 8/1993 | Smithson et al. |
| 5,242,339 | A | 9/1993 | Thornton |
| 5,242,340 | A | 9/1993 | Jerome |
| 5,242,343 | A | 9/1993 | Miller |
| 5,242,347 | A | 9/1993 | Keeton |
| 5,243,998 | A | 9/1993 | Silverman et al. |
| 5,246,411 | A | 9/1993 | Rackman |
| 5,247,853 | A | 9/1993 | Dalebout |
| 5,250,012 | A | 10/1993 | Whitcomb, Jr. |
| 5,250,013 | A | 10/1993 | Brangi |
| 5,254,066 | A | 10/1993 | Brown et al. |
| 5,254,067 | A | 10/1993 | Habing et al. |
| 5,256,115 | A | 10/1993 | Scholder |
| 5,256,117 | A | 10/1993 | Potts et al. |
| 5,256,118 | A | 10/1993 | Chen |
| 5,256,126 | A | 10/1993 | Grotstein |
| 5,257,084 | A | 10/1993 | Marsh |
| 5,257,701 | A | 11/1993 | Edelson |
| 5,257,964 | A | 11/1993 | Petters |
| 5,260,870 | A | 11/1993 | Tsuchiya et al. |
| 5,261,864 | A | 11/1993 | Fitzpatrick |
| 5,267,925 | A | 12/1993 | Boyd |
| 5,269,081 | A | 12/1993 | Gray |
| 5,269,519 | A | 12/1993 | Malone |
| 5,269,736 | A | 12/1993 | Roberts |
| 5,271,416 | A | 12/1993 | Lepley |
| 5,273,285 | A | 12/1993 | Long |
| 5,277,678 | A | 1/1994 | Friedebach et al. |
| 5,279,528 | A | 1/1994 | Dalebout et al. |
| 5,279,529 | A | 1/1994 | Eschenbach |
| 5,279,531 | A | 1/1994 | Jen Huey |
| 5,282,776 | A | 2/1994 | Dalebout |
| 5,284,461 | A | 2/1994 | Wilkinson et al. |
| 5,290,205 | A | 3/1994 | Densmore et al. |
| 5,290,211 | A | 3/1994 | Stearns |
| 5,292,293 | A | 3/1994 | Schumacher |
| 5,295,928 | A | 3/1994 | Rennex |
| 5,295,935 | A | 3/1994 | Wang |
| 5,299,810 | A | 4/1994 | Pierce et al. |
| 5,299,992 | A | 4/1994 | Wilkinson |
| 5,299,993 | A | 4/1994 | Habing |
| 5,301,154 | A | 4/1994 | Suga |
| 5,302,162 | A | 4/1994 | Pasero |
| 5,306,220 | A | 4/1994 | Kearney |
| 5,306,221 | A | 4/1994 | Itaru |
| 5,308,075 | A | 5/1994 | Theriault |
| 5,308,296 | A | 5/1994 | Eckstein |

(56) References Cited

U.S. PATENT DOCUMENTS

| | | | |
|---|---|---|---|
| 5,308,300 | A | 5/1994 | Chino et al. |
| 5,308,304 | A | 5/1994 | Habing |
| 5,309,355 | A | 5/1994 | Lockwood |
| 5,310,392 | A | 5/1994 | Lo |
| 5,313,852 | A | 5/1994 | Arena |
| 5,313,942 | A | 5/1994 | Platzker |
| 5,314,389 | A | 5/1994 | Dotan |
| 5,314,390 | A | 5/1994 | Westing et al. |
| 5,314,391 | A | 5/1994 | Potash et al. |
| 5,314,392 | A | 5/1994 | Hawkins et al. |
| 5,314,394 | A | 5/1994 | Ronan |
| 5,316,534 | A | 5/1994 | Dalebout et al. |
| 5,318,487 | A | 6/1994 | Golen et al. |
| 5,318,491 | A | 6/1994 | Houston |
| 5,320,343 | A | 6/1994 | McKinney |
| 5,320,588 | A | 6/1994 | Wanzer et al. |
| 5,320,591 | A | 6/1994 | Harmon et al. |
| 5,323,650 | A | 6/1994 | Fullen et al. |
| 5,323,784 | A | 6/1994 | Shu |
| 5,324,242 | A | 6/1994 | Lo |
| 5,328,420 | A | 7/1994 | Allen |
| 5,328,422 | A | 7/1994 | Nichols |
| 5,328,429 | A | 7/1994 | Potash et al. |
| 5,330,401 | A | 7/1994 | Walstead |
| 5,330,402 | A | 7/1994 | Johnson |
| 5,334,120 | A | 8/1994 | Rasmussen |
| 5,335,188 | A | 8/1994 | Brisson |
| 5,336,144 | A | 8/1994 | Rodden |
| 5,336,145 | A | 8/1994 | Keiser |
| 5,342,264 | A | 8/1994 | Gordon |
| 5,342,271 | A | 8/1994 | Long |
| RE34,728 | E | 9/1994 | Hall-Tipping |
| 5,344,372 | A | 9/1994 | Hung |
| 5,348,524 | A | 9/1994 | Grant |
| 5,350,344 | A | 9/1994 | Kissel |
| 5,352,166 | A | 10/1994 | Chang |
| 5,352,167 | A | 10/1994 | Ulicny |
| 5,352,169 | A | 10/1994 | Eschenbach |
| 5,353,452 | A | 10/1994 | Rulis |
| 5,354,248 | A | 10/1994 | Rawls et al. |
| 5,354,251 | A | 10/1994 | Sleamaker |
| 5,356,356 | A | 10/1994 | Hildebrandt et al. |
| 5,357,696 | A | 10/1994 | Gray |
| 5,358,461 | A | 10/1994 | Bailey, Jr. |
| 5,359,986 | A | 11/1994 | Magrath, III et al. |
| 5,361,091 | A | 11/1994 | Hoarty et al. |
| 5,361,778 | A | 11/1994 | Seitz |
| 5,362,069 | A | 11/1994 | Hall-Tipping |
| 5,362,295 | A | 11/1994 | Nurge |
| 5,362,298 | A | 11/1994 | Brown et al. |
| 5,364,271 | A | 11/1994 | Aknin et al. |
| 5,364,327 | A | 11/1994 | Graham |
| 5,368,532 | A | 11/1994 | Farnet |
| 5,372,556 | A | 12/1994 | Ropp |
| 5,372,559 | A | 12/1994 | Dalebout et al. |
| 5,372,560 | A | 12/1994 | Chang |
| 5,372,564 | A | 12/1994 | Spirito |
| 5,374,227 | A | 12/1994 | Webb |
| 5,375,068 | A | 12/1994 | Palmer et al. |
| 5,377,171 | A | 12/1994 | Schlup |
| 5,377,258 | A | 12/1994 | Bro |
| 5,378,212 | A | 1/1995 | Pin-Kuo |
| 5,380,258 | A | 1/1995 | Hawley, Jr. |
| 5,382,207 | A | 1/1995 | Skowronski et al. |
| 5,382,208 | A | 1/1995 | Hu |
| 5,382,209 | A | 1/1995 | Pasier |
| 5,383,827 | A | 1/1995 | Stern |
| 5,383,828 | A | 1/1995 | Sands et al. |
| 5,385,346 | A | 1/1995 | Carroll et al. |
| 5,385,519 | A | 1/1995 | Hsu |
| 5,385,520 | A | 1/1995 | Lepine et al. |
| 5,387,164 | A | 2/1995 | Brown, Jr. |
| 5,387,169 | A | 2/1995 | Wang |
| 5,387,170 | A | 2/1995 | Rawls et al. |
| 5,387,171 | A | 2/1995 | Casey et al. |
| 5,391,080 | A | 2/1995 | Bernacki |
| 5,394,922 | A | 3/1995 | Colson et al. |
| 5,396,340 | A | 3/1995 | Ishii et al. |
| 5,396,876 | A | 3/1995 | Liscio et al. |
| 5,398,948 | A | 3/1995 | Mathis |
| 5,401,226 | A | 3/1995 | Stearns |
| 5,403,251 | A | 4/1995 | Belsito et al. |
| 5,403,253 | A | 4/1995 | Gaylord |
| 5,403,254 | A | 4/1995 | Lundin et al. |
| 5,403,255 | A | 4/1995 | Johnston |
| 5,406,661 | A | 4/1995 | Pekar |
| 5,407,402 | A | 4/1995 | Brown et al. |
| 5,407,403 | A | 4/1995 | Coleman |
| 5,407,408 | A | 4/1995 | Wilkinson |
| 5,409,435 | A | 4/1995 | Daniels |
| 5,410,471 | A | 4/1995 | Alyfuku et al. |
| 5,410,472 | A | 4/1995 | Anderson |
| RE34,959 | E | 5/1995 | Potts |
| 5,410,971 | A | 5/1995 | Golden et al. |
| 5,417,222 | A | 5/1995 | Dempsey et al. |
| 5,417,643 | A | 5/1995 | Taylor |
| 5,419,562 | A | 5/1995 | Cromarty |
| 5,419,570 | A | 5/1995 | Bollotte |
| 5,419,571 | A | 5/1995 | Vaughan |
| 5,419,751 | A | 5/1995 | Byrd et al. |
| 5,421,801 | A | 6/1995 | Davies, III et al. |
| 5,423,729 | A | 6/1995 | Eschenbach |
| 5,423,730 | A | 6/1995 | Hirsch |
| 5,429,563 | A | 7/1995 | Engel et al. |
| 5,429,569 | A | 7/1995 | Gunnari |
| 5,431,612 | A | 7/1995 | Holden |
| 5,433,679 | A | 7/1995 | Szymczak et al. |
| 5,435,315 | A | 7/1995 | McPhee et al. |
| 5,435,798 | A | 7/1995 | Habing et al. |
| 5,435,799 | A | 7/1995 | Lundin |
| 5,437,289 | A | 8/1995 | Liverance |
| 5,441,467 | A | 8/1995 | Stevens |
| 5,441,468 | A | 8/1995 | Deckers et al. |
| 5,445,583 | A | 8/1995 | Habing |
| 5,449,334 | A | 9/1995 | Kingsbury |
| 5,451,922 | A | 9/1995 | Hamilton |
| 5,452,269 | A | 9/1995 | Cherdak |
| 5,454,772 | A | 10/1995 | Rodden |
| 5,454,773 | A | 10/1995 | Blanchard et al. |
| 5,456,262 | A | 10/1995 | Birnbaum |
| 5,456,648 | A | 10/1995 | Edinburg |
| 5,460,586 | A | 10/1995 | Wilkinson |
| 5,462,051 | A | 10/1995 | Oka et al. |
| 5,462,503 | A | 10/1995 | Benjamin et al. |
| 5,462,504 | A | 10/1995 | Trulaske et al. |
| 5,466,203 | A | 11/1995 | Chen |
| 5,469,740 | A | 11/1995 | French et al. |
| 5,470,298 | A | 11/1995 | Curtis |
| 5,471,405 | A | 11/1995 | Marsh |
| 5,472,205 | A | 12/1995 | Bouton |
| 5,474,077 | A | 12/1995 | Suga |
| 5,474,087 | A | 12/1995 | Nashner |
| 5,474,090 | A | 12/1995 | Begun et al. |
| 5,474,510 | A | 12/1995 | Chen |
| 5,476,428 | A | 12/1995 | Potash et al. |
| 5,476,430 | A | 12/1995 | Lee et al. |
| 5,478,295 | A | 12/1995 | Fracchia |
| 5,482,472 | A | 1/1996 | Garoni et al. |
| 5,484,358 | A | 1/1996 | Wang et al. |
| 5,484,362 | A | 1/1996 | Skowronski et al. |
| 5,484,389 | A | 1/1996 | Stark |
| 5,486,001 | A | 1/1996 | Baker |
| 5,487,707 | A | 1/1996 | Sharf et al. |
| 5,489,249 | A | 2/1996 | Brewer et al. |
| 5,489,250 | A | 2/1996 | Densmore et al. |
| 5,490,818 | A | 2/1996 | Haber et al. |
| 5,492,514 | A | 2/1996 | Daum |
| 5,492,520 | A | 2/1996 | Brown |
| 5,493,127 | A | 2/1996 | Lloyd et al. |
| 5,496,235 | A | 3/1996 | Stevens |
| 5,496,236 | A | 3/1996 | Buonauito |
| 5,496,238 | A | 3/1996 | Taylor |
| 5,496,239 | A | 3/1996 | Kallman |
| 5,499,956 | A | 3/1996 | Habing et al. |

(56) References Cited

U.S. PATENT DOCUMENTS 5,505,011 A 4/1996 Bleimhofer
5,507,271 A 4/1996 Actor
5,509,870 A 4/1996 Lloyd
5,510,828 A 4/1996 Lutterbach
5,512,025 A 4/1996 Dalebout et al.
5,512,029 A 4/1996 Barnard
5,514,053 A 5/1996 Hawkins et al.
5,516,334 A 5/1996 Easton
5,518,471 A 5/1996 Hettinger et al.
5,518,473 A 5/1996 Miller
5,519,189 A 5/1996 Gibisch
5,520,599 A 5/1996 Chen
5,522,783 A 6/1996 Gordon
5,524,110 A 6/1996 Danneels et al.
5,524,637 A 6/1996 Erickson
5,527,239 A 6/1996 Abbondanza
5,527,245 A 6/1996 Dalebout et al.
5,529,554 A 6/1996 Eschenbach
5,531,658 A 7/1996 L. S. C.
5,533,899 A 7/1996 Young
5,533,948 A 7/1996 Wilkinson
5,533,951 A 7/1996 Chang
5,535,664 A 7/1996 Rokowski
5,538,486 A 7/1996 France et al.
5,538,489 A 7/1996 Magid
5,542,420 A 8/1996 Goldman
5,542,672 A 8/1996 Meredith
5,542,892 A 8/1996 Buhler
5,545,112 A 8/1996 Densmore et al.
5,547,439 A 8/1996 Rawls et al.
5,549,052 A 8/1996 Hoffman
5,549,536 A 8/1996 Clark
5,551,934 A 9/1996 Binette
5,551,937 A 9/1996 Kwo
5,554,033 A 9/1996 Bizzi et al.
5,554,083 A 9/1996 Chen
5,556,362 A 9/1996 Whipps
5,562,572 A 10/1996 Carmein
5,562,574 A 10/1996 Miller
5,563,487 A 10/1996 Davis
5,568,993 A 10/1996 Potzick
5,569,120 A 10/1996 Anjanappa et al.
5,569,128 A 10/1996 Dalebout
5,569,138 A 10/1996 Wang et al.
5,572,643 A 11/1996 Judson
5,573,485 A 11/1996 Geschwender
5,575,740 A 11/1996 Piaget
5,576,951 A 11/1996 Lockwood
5,577,186 A 11/1996 Mann, II et al.
5,577,981 A 11/1996 Jarvik
5,577,985 A 11/1996 Miller
5,577,987 A 11/1996 Brown
5,580,249 A 12/1996 Jacobsen et al.
5,582,563 A 12/1996 Fan
5,584,700 A 12/1996 Feldman et al.
5,584,779 A 12/1996 Knecht
5,584,784 A 12/1996 Wu
5,585,561 A 12/1996 Bahl et al.
5,585,583 A 12/1996 Owen
5,586,736 A 12/1996 Mollet
5,586,962 A 12/1996 Hallmark
5,588,938 A 12/1996 Schneider et al.
5,590,128 A 12/1996 Maloney et al.
5,590,181 A 12/1996 Hogan et al.
5,590,893 A 1/1997 Robinson et al.
5,591,104 A 1/1997 Andrus et al.
5,591,106 A 1/1997 Dalebout et al.
5,591,107 A 1/1997 Rodgers, Jr.
5,591,908 A 1/1997 Reid
5,593,372 A 1/1997 Rodgers, Jr.
5,593,380 A 1/1997 Bittikofer
5,595,556 A 1/1997 Dalebout et al.
5,598,849 A 2/1997 Browne
5,599,261 A 2/1997 Easley et al.
5,600,310 A 2/1997 Whipple, III et al.
5,603,675 A 2/1997 Wu
5,603,678 A 2/1997 Wilson
5,605,336 A 2/1997 Gaoiran
5,607,375 A 3/1997 Dalebout
5,613,216 A 3/1997 Galler
5,613,856 A 3/1997 Hoover
5,616,103 A 4/1997 Lee
5,618,245 A 4/1997 Trulaske et al.
5,618,250 A 4/1997 Butz
5,619,412 A 4/1997 Hapka
5,619,991 A 4/1997 Sloane
5,622,527 A 4/1997 Watterson et al.
5,625,577 A 4/1997 Kunii et al.
5,626,539 A 5/1997 Piaget
5,630,566 A 5/1997 Case
5,632,209 A 5/1997 Sakakibara
5,634,870 A 6/1997 Wilkinson
5,638,343 A 6/1997 Ticknor
5,643,142 A 7/1997 Salerno et al.
5,643,144 A 7/1997 Trulaske
5,643,146 A 7/1997 Stark et al.
5,643,147 A 7/1997 Huang
5,643,152 A 7/1997 Simonson
5,643,153 A 7/1997 Nylen et al.
5,643,157 A 7/1997 Seliber
5,645,509 A 7/1997 Brewer et al.
5,645,513 A 7/1997 Haydocy et al.
5,645,914 A 7/1997 Horowitz
5,649,882 A 7/1997 Parikh et al.
5,650,709 A 7/1997 Rotunda et al.
5,652,304 A 7/1997 Calderon et al.
5,652,824 A 7/1997 Hirayama et al.
5,653,662 A 8/1997 Rodgers, Jr.
5,655,945 A 8/1997 Jani
5,655,997 A 8/1997 Greenberg et al.
5,656,003 A 8/1997 Robinson et al.
5,658,227 A 8/1997 Stearns
5,659,691 A 8/1997 Durward et al.
5,662,557 A 9/1997 Watterson et al.
5,665,031 A 9/1997 Hsieh
5,665,033 A 9/1997 Palmer
5,667,459 A 9/1997 Su
5,669,833 A 9/1997 Stone
5,669,857 A 9/1997 Watterson et al.
5,669,865 A 9/1997 Gordon
5,672,140 A 9/1997 Watterson et al.
5,674,156 A 10/1997 Watterson et al.
5,674,453 A 10/1997 Watterson et al.
5,676,138 A 10/1997 Zawilinski
5,676,624 A 10/1997 Watterson et al.
5,679,047 A 10/1997 Engel
5,679,101 A 10/1997 Magid
5,683,332 A 11/1997 Watterson et al.
5,688,209 A 11/1997 Trulaske et al.
5,688,216 A 11/1997 Mauriello
5,690,582 A 11/1997 Ulrich et al.
5,690,587 A 11/1997 Gruenangerl
5,690,589 A 11/1997 Rodgers, Jr.
5,690,852 A 11/1997 Saito et al.
5,692,994 A 12/1997 Eschenbach
5,693,004 A 12/1997 Carlson et al.
5,695,400 A 12/1997 Fennell, Jr. et al.
5,695,436 A 12/1997 Huang
5,697,834 A 12/1997 Heumann et al.
5,702,323 A 12/1997 Poulton
5,702,325 A 12/1997 Watterson et al.
5,704,875 A 1/1998 Tanabe
5,704,879 A 1/1998 Watterson et al.
5,707,319 A 1/1998 Riley
5,708,355 A 1/1998 Schrey
5,709,632 A 1/1998 Socwell
5,709,633 A 1/1998 Sokol
5,710,884 A 1/1998 Dedrick
5,711,745 A 1/1998 Yang
5,711,746 A 1/1998 Carlson
5,711,749 A 1/1998 Miller
5,713,549 A 2/1998 Shieh
5,713,794 A 2/1998 Shimojima et al.
5,713,821 A 2/1998 Nissen

(56) References Cited

U.S. PATENT DOCUMENTS

| | | | |
|---|---|---|---|
| 5,716,308 | A | 2/1998 | Lee |
| 5,718,657 | A | 2/1998 | Dalebout et al. |
| 5,718,660 | A | 2/1998 | Chen |
| 5,719,825 | A | 2/1998 | Dotter |
| 5,720,200 | A | 2/1998 | Anderson et al. |
| 5,720,474 | A | 2/1998 | Sugiyama |
| 5,720,771 | A | 2/1998 | Snell |
| 5,721,539 | A | 2/1998 | Goetzl |
| 5,722,418 | A | 3/1998 | Bro |
| 5,722,420 | A | 3/1998 | Lee |
| 5,722,917 | A | 3/1998 | Olschansky et al. |
| 5,722,920 | A | 3/1998 | Bauer |
| 5,722,922 | A | 3/1998 | Watterson et al. |
| 5,724,025 | A | 3/1998 | Tavori |
| 5,725,459 | A | 3/1998 | Rexach |
| 5,730,236 | A | 3/1998 | Miller et al. |
| 5,733,228 | A | 3/1998 | Stevens |
| 5,733,229 | A | 3/1998 | Dalebout et al. |
| 5,734,625 | A | 3/1998 | Kondo |
| 5,735,586 | A | 4/1998 | Cheng |
| 5,735,773 | A | 4/1998 | Vittone |
| 5,735,776 | A | 4/1998 | Swezey |
| 5,738,612 | A | 4/1998 | Tsuda |
| 5,739,457 | A | 4/1998 | Devecka |
| 5,741,205 | A | 4/1998 | Doll et al. |
| 5,743,193 | A | 4/1998 | Kakuta et al. |
| 5,743,832 | A | 4/1998 | Sands et al. |
| 5,743,833 | A | 4/1998 | Watterson et al. |
| 5,743,835 | A | 4/1998 | Trotter |
| 5,746,682 | A | 5/1998 | Hung |
| 5,749,372 | A | 5/1998 | Allen |
| 5,749,787 | A | 5/1998 | Jank |
| 5,749,807 | A | 5/1998 | Webb |
| 5,749,809 | A | 5/1998 | Lin |
| 5,749,813 | A | 5/1998 | Domzalski |
| 5,752,879 | A | 5/1998 | Berdut |
| 5,752,883 | A | 5/1998 | Butcher et al. |
| 5,752,897 | A | 5/1998 | Skowronski et al. |
| 5,754,765 | A | 5/1998 | Danneels et al. |
| 5,755,642 | A | 5/1998 | Miller |
| 5,755,645 | A | 5/1998 | Miller et al. |
| 5,755,651 | A | 5/1998 | Homyonfer |
| 5,759,136 | A | 6/1998 | Chen |
| 5,759,199 | A | 6/1998 | Snell et al. |
| 5,760,353 | A | 6/1998 | Rapp |
| 5,761,831 | A | 6/1998 | Cho |
| 5,762,503 | A | 6/1998 | Hoo et al. |
| 5,762,587 | A | 6/1998 | Dalebout et al. |
| 5,762,588 | A | 6/1998 | Chen |
| 5,769,755 | A | 6/1998 | Henry et al. |
| 5,771,152 | A | 6/1998 | Crompton et al. |
| 5,771,354 | A | 6/1998 | Crawford |
| 5,772,508 | A | 6/1998 | Sugita et al. |
| 5,772,522 | A | 6/1998 | Nesbit |
| 5,772,558 | A | 6/1998 | Rodgers, Jr. |
| 5,772,560 | A | 6/1998 | Watterson et al. |
| 5,776,582 | A | 7/1998 | Needham |
| 5,777,678 | A | 7/1998 | Ogata et al. |
| 5,779,596 | A | 7/1998 | Weber |
| 5,779,599 | A | 7/1998 | Chen |
| 5,779,607 | A | 7/1998 | Harris |
| 5,782,639 | A | 7/1998 | Beal |
| 5,782,723 | A | 7/1998 | Kuo |
| 5,785,630 | A | 7/1998 | Bobick et al. |
| 5,785,631 | A | 7/1998 | Heidecke |
| 5,785,632 | A | 7/1998 | Greenberg et al. |
| 5,788,609 | A | 8/1998 | Miller |
| 5,788,610 | A | 8/1998 | Eschenbach |
| 5,788,611 | A | 8/1998 | Kuo |
| 5,790,785 | A | 8/1998 | Klug et al. |
| 5,792,027 | A | 8/1998 | Gvoich |
| 5,792,031 | A | 8/1998 | Alton |
| 5,794,210 | A | 8/1998 | Goldhaber et al. |
| 5,795,270 | A | 8/1998 | Woods et al. |
| 5,797,578 | A | 8/1998 | Graffeo |
| 5,797,805 | A | 8/1998 | Lubell et al. |
| 5,799,281 | A | 8/1998 | Login et al. |
| 5,803,870 | A | 9/1998 | Buhler |
| 5,803,874 | A | 9/1998 | Wilkinson |
| 5,803,877 | A | 9/1998 | Franey |
| 5,803,882 | A | 9/1998 | Habing et al. |
| 5,807,210 | A | 9/1998 | Devlin |
| 5,810,696 | A | 9/1998 | Webb |
| 5,810,697 | A | 9/1998 | Joiner |
| 5,810,698 | A | 9/1998 | Hullett et al. |
| 5,810,747 | A | 9/1998 | Brudny et al. |
| 5,813,142 | A | 9/1998 | Demon |
| 5,813,864 | A | 9/1998 | Ikuta |
| 5,813,945 | A | 9/1998 | Bernacki |
| 5,813,947 | A | 9/1998 | Densmore |
| 5,813,953 | A | 9/1998 | Whipple |
| 5,816,372 | A | 10/1998 | Carlson et al. |
| 5,816,443 | A | 10/1998 | Bustos |
| 5,816,981 | A | 10/1998 | Hung |
| 5,820,478 | A | 10/1998 | Wood et al. |
| 5,820,525 | A | 10/1998 | Riley |
| 5,823,618 | A | 10/1998 | Fox et al. |
| 5,823,913 | A | 10/1998 | Aruin |
| 5,825,983 | A | 10/1998 | Park et al. |
| 5,827,154 | A | 10/1998 | Gill |
| 5,827,155 | A | 10/1998 | Jensen et al. |
| 5,827,158 | A | 10/1998 | Drecksel |
| 5,830,107 | A | 11/1998 | Brigliadoro |
| 5,830,113 | A | 11/1998 | Coody et al. |
| 5,830,114 | A | 11/1998 | Halfen et al. |
| 5,833,577 | A | 11/1998 | Hurt |
| 5,833,583 | A | 11/1998 | Chuang |
| 5,833,584 | A | 11/1998 | Piaget et al. |
| 5,833,587 | A | 11/1998 | Strong et al. |
| 5,836,770 | A | 11/1998 | Powers |
| 5,838,906 | A | 11/1998 | Doyle et al. |
| 5,839,990 | A | 11/1998 | Virkkala |
| 5,839,993 | A | 11/1998 | Fox |
| 5,842,961 | A | 12/1998 | Davis |
| 5,845,230 | A | 12/1998 | Lamberson |
| 5,846,166 | A | 12/1998 | Kuo |
| 5,848,396 | A | 12/1998 | Gerace |
| 5,848,954 | A | 12/1998 | Stearns et al. |
| 5,852,264 | A | 12/1998 | Muller |
| 5,854,833 | A | 12/1998 | Hogan et al. |
| 5,855,537 | A | 1/1999 | Coody et al. |
| 5,855,538 | A | 1/1999 | Argabright |
| 5,857,939 | A | 1/1999 | Kaufman |
| 5,857,940 | A | 1/1999 | Husted |
| 5,857,941 | A | 1/1999 | Maresh |
| 5,857,943 | A | 1/1999 | Murray |
| 5,860,893 | A | 1/1999 | Watterson et al. |
| 5,860,894 | A | 1/1999 | Dalebout et al. |
| 5,860,899 | A | 1/1999 | Rassman |
| 5,864,018 | A | 1/1999 | Morser et al. |
| 5,865,710 | A | 2/1999 | Wilson-Hyde |
| 5,865,733 | A | 2/1999 | Malinouskas et al. |
| 5,868,108 | A | 2/1999 | Schmitz et al. |
| 5,868,648 | A | 2/1999 | Coody et al. |
| 5,871,421 | A | 2/1999 | Trulaske et al. |
| 5,873,369 | A | 2/1999 | Laniado et al. |
| 5,876,095 | A | 3/1999 | Johnston |
| 5,879,270 | A | 3/1999 | Huish et al. |
| 5,879,271 | A | 3/1999 | Stearns et al. |
| 5,879,273 | A | 3/1999 | Wei |
| 5,879,276 | A | 3/1999 | Miller |
| 5,880,677 | A | 3/1999 | Lestician |
| 5,882,281 | A | 3/1999 | Stearns et al. |
| 5,885,197 | A | 3/1999 | Barton |
| 5,888,172 | A | 3/1999 | Andrus et al. |
| 5,890,149 | A | 3/1999 | Schmonsees |
| 5,890,562 | A | 4/1999 | Bartels et al. |
| 5,890,906 | A | 4/1999 | Macri |
| 5,890,995 | A | 4/1999 | Bobick et al. |
| 5,890,996 | A | 4/1999 | Frame et al. |
| 5,890,997 | A | 4/1999 | Roth |
| 5,891,001 | A | 4/1999 | Carnes et al. |
| 5,891,003 | A | 4/1999 | Deac et al. |
| 5,891,042 | A | 4/1999 | Sham et al. |

(56) References Cited

U.S. PATENT DOCUMENTS

| | | | |
|---|---|---|---|
| 5,895,339 | A | 4/1999 | Maresh |
| 5,895,340 | A | 4/1999 | Keller |
| 5,897,457 | A | 4/1999 | Mackovjak |
| 5,897,459 | A | 4/1999 | Habing et al. |
| 5,897,460 | A | 4/1999 | McBride et al. |
| 5,897,461 | A | 4/1999 | Socwell |
| 5,897,463 | A | 4/1999 | Maresh |
| 5,899,833 | A | 5/1999 | Ryan et al. |
| 5,899,834 | A | 5/1999 | Dalebout et al. |
| 5,899,963 | A | 5/1999 | Hutchings |
| 5,904,398 | A | 5/1999 | Farricielli |
| 5,904,636 | A | 5/1999 | Chen |
| 5,905,442 | A | 5/1999 | Mosebrook et al. |
| 5,906,269 | A | 5/1999 | Zabron et al. |
| 5,906,494 | A | 5/1999 | Ogawa et al. |
| 5,906,564 | A | 5/1999 | Jacobsen |
| 5,906,581 | A | 5/1999 | Tsuda |
| 5,909,544 | A | 6/1999 | Anderson, II et al. |
| 5,910,070 | A | 6/1999 | Henry et al. |
| 5,910,072 | A | 6/1999 | Rawls et al. |
| 5,911,044 | A | 6/1999 | Lo et al. |
| 5,911,132 | A | 6/1999 | Sloane |
| 5,911,687 | A | 6/1999 | Sato et al. |
| 5,913,310 | A | 6/1999 | Brown |
| 5,913,751 | A | 6/1999 | Eschenbach |
| 5,913,830 | A | 6/1999 | Miles |
| 5,916,063 | A | 6/1999 | Alessandri |
| 5,916,064 | A | 6/1999 | Eschenbach |
| 5,916,065 | A | 6/1999 | McBride et al. |
| 5,916,069 | A | 6/1999 | Wang |
| 5,917,405 | A | 6/1999 | Joao |
| 5,917,692 | A | 6/1999 | Schmitz et al. |
| 5,919,117 | A | 7/1999 | Thompson et al. |
| 5,919,118 | A | 7/1999 | Stearns |
| 5,921,891 | A | 7/1999 | Browne |
| 5,921,892 | A | 7/1999 | Easton |
| 5,921,896 | A | 7/1999 | Boland |
| 5,925,001 | A | 7/1999 | Hoyt et al. |
| 5,929,748 | A | 7/1999 | Odinak |
| 5,929,782 | A | 7/1999 | Stark |
| 5,929,848 | A | 7/1999 | Albukerk et al. |
| 5,931,763 | A | 8/1999 | Alessandri |
| 5,937,387 | A | 8/1999 | Summerell et al. |
| 5,938,551 | A | 8/1999 | Warner |
| 5,938,565 | A | 8/1999 | Bernacki |
| 5,938,570 | A | 8/1999 | Maresh |
| 5,938,571 | A | 8/1999 | Stevens |
| 5,938,575 | A | 8/1999 | Stearns |
| 5,940,502 | A | 8/1999 | Hirai et al. |
| 5,940,911 | A | 8/1999 | Wang |
| 5,941,797 | A | 8/1999 | Kashiwaguchi |
| 5,941,807 | A | 8/1999 | Cassidy |
| 5,943,794 | A | 8/1999 | Gelsomini |
| 5,944,638 | A | 8/1999 | Maresh |
| 5,944,641 | A | 8/1999 | Habing |
| 5,947,868 | A | 9/1999 | Dugan |
| 5,947,869 | A | 9/1999 | Shea |
| 5,947,872 | A | 9/1999 | Ryan et al. |
| 5,951,444 | A | 9/1999 | Webber |
| 5,951,447 | A | 9/1999 | Butler |
| 5,951,449 | A | 9/1999 | Oppriecht |
| 5,956,509 | A | 9/1999 | Kevner |
| 5,957,699 | A | 9/1999 | Peterson et al. |
| 5,957,814 | A | 9/1999 | Eschenbach |
| 5,961,423 | A | 10/1999 | Sellers |
| 5,961,430 | A | 10/1999 | Zuckerman et al. |
| 5,961,561 | A | 10/1999 | Wakefield, II |
| 5,961,593 | A | 10/1999 | Gabber et al. |
| 5,964,701 | A | 10/1999 | Asada et al. |
| 5,967,944 | A | 10/1999 | Vittone et al. |
| 5,967,954 | A | 10/1999 | Habing |
| 5,967,955 | A | 10/1999 | Westfall et al. |
| 5,967,975 | A | 10/1999 | Ridgeway |
| 5,970,340 | A | 10/1999 | Edgar |
| 5,971,902 | A | 10/1999 | Robertson et al. |
| 5,973,696 | A | 10/1999 | Agranat et al. |
| 5,976,039 | A | 11/1999 | Epel et al. |
| 5,976,061 | A | 11/1999 | Moon et al. |
| 5,976,083 | A | 11/1999 | Richardson et al. |
| 5,980,429 | A | 11/1999 | Nashner |
| 5,980,430 | A | 11/1999 | Wang |
| 5,980,432 | A | 11/1999 | Ahman |
| 5,981,168 | A | 11/1999 | Reiner et al. |
| 5,984,798 | A | 11/1999 | Gilmour |
| 5,984,839 | A | 11/1999 | Corkum |
| 5,989,161 | A | 11/1999 | Wang et al. |
| 5,989,163 | A | 11/1999 | Rodgers, Jr. |
| 5,989,168 | A | 11/1999 | See |
| 5,990,405 | A | 11/1999 | Auten et al. |
| 5,991,143 | A | 11/1999 | Wright et al. |
| 5,993,356 | A | 11/1999 | Houston et al. |
| 5,993,358 | A | 11/1999 | Gureghian et al. |
| 5,993,359 | A | 11/1999 | Eschenbach |
| 5,993,362 | A | 11/1999 | Ghobadi |
| 5,995,868 | A | 11/1999 | Dorfmeister et al. |
| 5,997,447 | A | 12/1999 | Giannelli et al. |
| 5,997,450 | A | 12/1999 | Wilkinson |
| 5,997,476 | A | 12/1999 | Brown |
| 6,002,982 | A | 12/1999 | Fry |
| 6,003,481 | A | 12/1999 | Pischinger et al. |
| 6,004,243 | A | 12/1999 | Ewert |
| 6,004,244 | A | 12/1999 | Simonson |
| 6,006,379 | A | 12/1999 | Hensley |
| 6,010,432 | A | 1/2000 | Vawter |
| 6,010,451 | A | 1/2000 | Clawson |
| 6,012,591 | A | 1/2000 | Brandenberg |
| 6,012,772 | A | 1/2000 | Conde et al. |
| 6,013,007 | A | 1/2000 | Root et al. |
| 6,013,009 | A | 1/2000 | Karkanen |
| 6,013,011 | A | 1/2000 | Moore et al. |
| 6,014,432 | A | 1/2000 | Modney |
| 6,014,634 | A | 1/2000 | Scroggie et al. |
| 6,015,367 | A | 1/2000 | Scaramucci |
| 6,015,368 | A | 1/2000 | Clem |
| 6,018,705 | A | 1/2000 | Gaudet et al. |
| 6,027,428 | A | 2/2000 | Thomas et al. |
| 6,027,429 | A | 2/2000 | Daniels |
| 6,027,430 | A | 2/2000 | Stearns et al. |
| 6,027,432 | A | 2/2000 | Cheng |
| 6,029,858 | A | 2/2000 | Srokose |
| 6,030,320 | A | 2/2000 | Stearns |
| 6,030,321 | A | 2/2000 | Fuentes |
| 6,030,323 | A | 2/2000 | Fontenot |
| 6,033,227 | A | 3/2000 | Ishige |
| 6,033,344 | A | 3/2000 | Trulaske et al. |
| 6,033,347 | A | 3/2000 | Dalebout et al. |
| 6,033,350 | A | 3/2000 | Krull |
| 6,036,622 | A | 3/2000 | Gordon |
| 6,039,677 | A | 3/2000 | Spletzer |
| 6,042,512 | A | 3/2000 | Eschenbach |
| 6,042,514 | A | 3/2000 | Abelbeck |
| 6,042,515 | A | 3/2000 | Wang |
| 6,042,516 | A | 3/2000 | Norton |
| 6,042,518 | A | 3/2000 | Hildebrandt et al. |
| 6,042,519 | A | 3/2000 | Shea |
| 6,042,523 | A | 3/2000 | Graham |
| 6,045,487 | A | 4/2000 | Miller |
| 6,045,488 | A | 4/2000 | Eschenbach |
| 6,045,490 | A | 4/2000 | Shafer |
| 6,045,491 | A | 4/2000 | McNergney |
| 6,050,822 | A | 4/2000 | Faughn |
| 6,050,920 | A | 4/2000 | Ehrenfried |
| 6,050,921 | A | 4/2000 | Wang |
| 6,050,922 | A | 4/2000 | Wang |
| 6,050,923 | A | 4/2000 | Yu |
| 6,050,924 | A | 4/2000 | Shea |
| 6,050,942 | A | 4/2000 | Rust et al. |
| 6,053,737 | A | 4/2000 | Babbitt et al. |
| 6,053,844 | A | 4/2000 | Clem |
| 6,053,847 | A | 4/2000 | Stearns et al. |
| 6,053,848 | A | 4/2000 | Eschenbach |
| 6,055,513 | A | 4/2000 | Katz et al. |
| 6,055,573 | A | 4/2000 | Gardenswartz et al. |
| 6,055,747 | A | 5/2000 | Lombardino |

(56) References Cited

U.S. PATENT DOCUMENTS

| | | | |
|---|---|---|---|
| 6,056,670 | A | 5/2000 | Shu et al. |
| 6,056,678 | A | 5/2000 | Giannelli et al. |
| 6,059,576 | A | 5/2000 | Brann |
| 6,059,692 | A | 5/2000 | Hickman |
| 6,059,695 | A | 5/2000 | Hung |
| 6,063,009 | A | 5/2000 | Stearns |
| 6,065,572 | A | 5/2000 | Schober et al. |
| 6,066,075 | A | 5/2000 | Poulton |
| 6,066,077 | A | 5/2000 | Horst |
| 6,066,705 | A | 5/2000 | Calderon et al. |
| 6,068,578 | A | 5/2000 | Wang |
| 6,068,579 | A | 5/2000 | Killian et al. |
| 6,071,031 | A | 6/2000 | Bailey |
| 6,071,216 | A | 6/2000 | Giannelli et al. |
| 6,075,525 | A | 6/2000 | Hsieh |
| 6,077,196 | A | 6/2000 | Eschenbach |
| 6,077,198 | A | 6/2000 | Eschenbach |
| 6,077,199 | A | 6/2000 | Hsu |
| 6,077,200 | A | 6/2000 | Lin |
| 6,080,091 | A | 6/2000 | Habing et al. |
| 6,086,379 | A | 7/2000 | Pendergast et al. |
| 6,086,520 | A | 7/2000 | Rodriquez |
| 6,090,014 | A | 7/2000 | Eschenbach |
| 6,090,016 | A | 7/2000 | Kuo |
| 6,090,017 | A | 7/2000 | Wang |
| 6,095,951 | A | 8/2000 | Skowronski et al. |
| 6,099,439 | A | 8/2000 | Ryan et al. |
| 6,102,412 | A | 8/2000 | Staffaroni |
| 6,102,832 | A | 8/2000 | Tani |
| 6,102,846 | A | 8/2000 | Patton et al. |
| 6,103,203 | A | 8/2000 | Fischer |
| 6,106,297 | A | 8/2000 | Pollak et al. |
| 6,110,076 | A | 8/2000 | Hurt |
| 6,110,077 | A | 8/2000 | Yu |
| 6,113,188 | A | 9/2000 | Stewart et al. |
| 6,113,522 | A | 9/2000 | Montgomery |
| 6,113,537 | A | 9/2000 | Castano |
| 6,117,049 | A | 9/2000 | Lowe |
| 6,120,421 | A | 9/2000 | Kuo |
| 6,122,340 | A | 9/2000 | Darley et al. |
| 6,123,646 | A | 9/2000 | Colassi |
| 6,123,647 | A | 9/2000 | Mitchell |
| 6,123,648 | A | 9/2000 | Stevens |
| 6,123,649 | A | 9/2000 | Lee |
| 6,123,650 | A | 9/2000 | Birrell |
| 6,125,851 | A | 10/2000 | Walker et al. |
| 6,126,574 | A | 10/2000 | Stearns et al. |
| 6,126,575 | A | 10/2000 | Wang |
| 6,126,576 | A | 10/2000 | Wang |
| 6,126,577 | A | 10/2000 | Chang |
| 6,128,663 | A | 10/2000 | Thomas |
| 6,129,962 | A | 10/2000 | Quigley et al. |
| 6,132,337 | A | 10/2000 | Krupka et al. |
| 6,132,340 | A | 10/2000 | Wang |
| 6,133,610 | A | 10/2000 | Bolam et al. |
| 6,135,924 | A | 10/2000 | Gibbs et al. |
| 6,135,925 | A | 10/2000 | Liu |
| 6,142,870 | A | 11/2000 | Wada et al. |
| 6,142,912 | A | 11/2000 | Profaci |
| 6,142,913 | A | 11/2000 | Ewert |
| 6,142,914 | A | 11/2000 | Crawford et al. |
| 6,142,915 | A | 11/2000 | Eschenbach |
| 6,146,313 | A | 11/2000 | Whan-Tong et al. |
| 6,146,315 | A | 11/2000 | Schonenberger |
| 6,148,262 | A | 11/2000 | Fry |
| 6,149,551 | A | 11/2000 | Pyles et al. |
| 6,149,552 | A | 11/2000 | Chen |
| 6,151,586 | A | 11/2000 | Brown |
| 6,152,854 | A | 11/2000 | Carmein |
| 6,152,856 | A | 11/2000 | Studor et al. |
| 6,152,859 | A | 11/2000 | Stearns |
| 6,159,131 | A | 12/2000 | Pfeffer |
| 6,162,151 | A | 12/2000 | Tani et al. |
| 6,162,183 | A | 12/2000 | Hoover |
| 6,162,189 | A | 12/2000 | Girone et al. |
| 6,163,451 | A | 12/2000 | Chiu |
| 6,165,107 | A | 12/2000 | Birrell |
| 6,168,551 | B1 | 1/2001 | McGuinness |
| 6,171,186 | B1 | 1/2001 | Kurosawa et al. |
| 6,171,216 | B1 | 1/2001 | Wang |
| 6,171,218 | B1 | 1/2001 | Shea |
| 6,174,267 | B1 | 1/2001 | Dalebout |
| 6,174,268 | B1 | 1/2001 | Novak |
| 6,175,608 | B1 | 1/2001 | Pyles et al. |
| 6,176,241 | B1 | 1/2001 | Blau et al. |
| 6,176,814 | B1 | 1/2001 | Ryan et al. |
| 6,179,746 | B1 | 1/2001 | Delman |
| 6,179,753 | B1 | 1/2001 | Barker et al. |
| 6,181,647 | B1 | 1/2001 | Tipton |
| 6,183,259 | B1 | 2/2001 | Macri et al. |
| 6,183,397 | B1 | 2/2001 | Stearns et al. |
| 6,183,425 | B1 | 2/2001 | Whalen |
| 6,186,145 | B1 | 2/2001 | Brown |
| 6,186,290 | B1 | 2/2001 | Carlson |
| 6,186,460 | B1 | 2/2001 | Lin |
| 6,186,929 | B1 | 2/2001 | Endelman et al. |
| 6,189,846 | B1 | 2/2001 | Wang |
| 6,190,289 | B1 | 2/2001 | Pyles et al. |
| 6,193,631 | B1 | 2/2001 | Hickman |
| 6,193,635 | B1 | 2/2001 | Webber et al. |
| 6,198,394 | B1 | 3/2001 | Jacobsen et al. |
| 6,203,474 | B1 | 3/2001 | Jones |
| 6,206,795 | B1 | 3/2001 | Ou |
| 6,210,305 | B1 | 4/2001 | Eschenbach |
| 6,211,451 | B1 | 4/2001 | Tohgi et al. |
| 6,213,919 | B1 | 4/2001 | Wang |
| 6,215,870 | B1 | 4/2001 | Hirai et al. |
| 6,217,487 | B1 | 4/2001 | Reinert |
| 6,220,865 | B1 | 4/2001 | Macri et al. |
| 6,220,990 | B1 | 4/2001 | Crivello |
| 6,220,995 | B1 | 4/2001 | Chen |
| 6,221,451 | B1 | 4/2001 | Lauer et al. |
| 6,221,667 | B1 | 4/2001 | Reiner et al. |
| 6,224,387 | B1 | 5/2001 | Jones |
| 6,224,516 | B1 | 5/2001 | Disch |
| 6,224,519 | B1 | 5/2001 | Doolittle |
| 6,225,977 | B1 | 5/2001 | Li |
| 6,227,968 | B1 | 5/2001 | Suzuki et al. |
| 6,230,047 | B1 | 5/2001 | McHugh |
| 6,230,460 | B1 | 5/2001 | Huyett |
| 6,230,501 | B1 | 5/2001 | Bailey, Sr. et al. |
| 6,231,481 | B1 | 5/2001 | Brock |
| 6,231,482 | B1 | 5/2001 | Thompson |
| 6,231,946 | B1 | 5/2001 | Brown, Jr. et al. |
| 6,234,935 | B1 | 5/2001 | Chu |
| 6,234,936 | B1 | 5/2001 | Wang |
| 6,237,583 | B1 | 5/2001 | Ripley et al. |
| 6,238,323 | B1 | 5/2001 | Simonson |
| 6,241,524 | B1 | 6/2001 | Aoshima et al. |
| 6,241,638 | B1 | 6/2001 | Hurt |
| 6,244,987 | B1 | 6/2001 | Ohsuga et al. |
| 6,244,988 | B1 | 6/2001 | Delman |
| 6,244,992 | B1 | 6/2001 | James |
| 6,245,001 | B1 | 6/2001 | Siaperas |
| 6,251,047 | B1 | 6/2001 | Stearns et al. |
| 6,251,048 | B1 | 6/2001 | Kaufman |
| 6,252,153 | B1 | 6/2001 | Toyama |
| 6,254,513 | B1 | 7/2001 | Takenaka et al. |
| 6,254,514 | B1 | 7/2001 | Maresh et al. |
| 6,254,515 | B1 | 7/2001 | Carman et al. |
| 6,259,944 | B1 | 7/2001 | Margulis et al. |
| 6,260,970 | B1 | 7/2001 | Horn |
| 6,261,209 | B1 | 7/2001 | Coody |
| 6,264,586 | B1 | 7/2001 | Webber |
| 6,267,710 | B1 | 7/2001 | Liu |
| 6,273,842 | B1 | 8/2001 | Wang |
| 6,273,843 | B1 | 8/2001 | Lo |
| 6,276,749 | B1 | 8/2001 | Okazawa et al. |
| 6,277,054 | B1 | 8/2001 | Kuo |
| 6,277,056 | B1 | 8/2001 | McBride et al. |
| 6,278,378 | B1 | 8/2001 | Feiner et al. |
| 6,280,361 | B1 | 8/2001 | Harvey et al. |
| 6,280,362 | B1 | 8/2001 | Dalebout et al. |
| 6,280,367 | B1 | 8/2001 | Arsenault |

(56) References Cited

U.S. PATENT DOCUMENTS

| | | | |
|---|---|---|---|
| 6,282,816 | B1 | 9/2001 | Rosendahl |
| 6,283,760 | B1 | 9/2001 | Wakamoto |
| 6,283,859 | B1 | 9/2001 | Carlson et al. |
| 6,283,896 | B1 | 9/2001 | Grunfeld |
| 6,287,239 | B1 | 9/2001 | Hernandez |
| 6,287,240 | B1 | 9/2001 | Trabbic |
| 6,292,688 | B1 | 9/2001 | Patton |
| 6,293,375 | B1 | 9/2001 | Chen |
| 6,293,802 | B1 | 9/2001 | Ahlgren |
| 6,299,959 | B1 | 10/2001 | Squires et al. |
| 6,302,815 | B1 | 10/2001 | Shishido et al. |
| 6,302,826 | B1 | 10/2001 | Lee |
| 6,302,828 | B1 | 10/2001 | Martin et al. |
| 6,302,829 | B1 | 10/2001 | Schmidt |
| 6,302,830 | B1 | 10/2001 | Stearns |
| 6,302,833 | B1 | 10/2001 | Ellis et al. |
| 6,306,108 | B1 | 10/2001 | Butler |
| 6,307,167 | B1 | 10/2001 | Kajio et al. |
| 6,308,565 | B1 | 10/2001 | French |
| 6,312,363 | B1 | 11/2001 | Watterson et al. |
| 6,312,366 | B1 | 11/2001 | Prusick |
| 6,313,363 | B1 | 11/2001 | Joly et al. |
| 6,314,058 | B1 | 11/2001 | Lee |
| 6,314,667 | B1 | 11/2001 | Rife et al. |
| 6,315,486 | B1 | 11/2001 | Lunz |
| 6,317,151 | B1 | 11/2001 | Ohsuga et al. |
| 6,322,059 | B1 | 11/2001 | Kelm et al. |
| 6,322,451 | B1 | 11/2001 | Miura |
| 6,322,481 | B1 | 11/2001 | Krull |
| 6,325,745 | B1 | 12/2001 | Yu |
| 6,325,746 | B1 | 12/2001 | Wang |
| 6,328,676 | B1 | 12/2001 | Alessandri |
| 6,328,677 | B1 | 12/2001 | Drapeau |
| 6,334,624 | B1 | 1/2002 | Giglio |
| 6,336,891 | B1 | 1/2002 | Fedrigon et al. |
| 6,342,028 | B1 | 1/2002 | De Sane |
| 6,344,986 | B1 | 2/2002 | Jain et al. |
| 6,345,197 | B1 | 2/2002 | Wheadon, et al. |
| 6,347,603 | B1 | 2/2002 | Felger |
| 6,348,028 | B1 | 2/2002 | Cragg |
| 6,350,218 | B1 | 2/2002 | Dalebout et al. |
| 6,352,494 | B2 | 3/2002 | McAlonan |
| 6,356,856 | B1 | 3/2002 | Damen et al. |
| 6,357,077 | B1 | 3/2002 | Jones, Jr. et al. |
| 6,358,187 | B1 | 3/2002 | Smith |
| 6,361,476 | B1 | 3/2002 | Eschenbach |
| 6,368,251 | B1 | 4/2002 | Casler |
| 6,368,252 | B1 | 4/2002 | Stearns |
| 6,368,254 | B1 | 4/2002 | Wall |
| 6,369,313 | B2 | 4/2002 | Devecka |
| 6,371,123 | B1 | 4/2002 | Watanabe |
| 6,371,738 | B2 | 4/2002 | Jones |
| 6,371,850 | B1 | 4/2002 | Sonoda |
| 6,371,895 | B1 | 4/2002 | Endelman et al. |
| 6,375,580 | B1 | 4/2002 | Schmidt |
| 6,379,289 | B1 | 4/2002 | Gossie |
| 6,382,627 | B1 | 5/2002 | Lundberg |
| 6,383,120 | B1 | 5/2002 | Lo |
| 6,385,651 | B2 | 5/2002 | Dancs et al. |
| 6,387,015 | B1 | 5/2002 | Watson |
| 6,387,016 | B1 | 5/2002 | Lo |
| 6,390,923 | B1 | 5/2002 | Yoshitomi et al. |
| 6,390,953 | B1 | 5/2002 | Maresh |
| 6,390,955 | B1 | 5/2002 | Wang |
| 6,394,239 | B1 | 5/2002 | Carlson |
| 6,397,797 | B1 | 6/2002 | Kolmanovsky et al. |
| 6,398,695 | B2 | 6/2002 | Miller |
| 6,402,520 | B1 | 6/2002 | Freer |
| 6,402,558 | B1 | 6/2002 | Hung-Ju et al. |
| 6,402,666 | B2 | 6/2002 | Krull |
| 6,404,418 | B1 | 6/2002 | Leem |
| 6,405,077 | B1 | 6/2002 | Birnbaum et al. |
| 6,409,513 | B1 | 6/2002 | Kawamura et al. |
| 6,409,632 | B1 | 6/2002 | Eschenbach |
| 6,409,633 | B1 | 6/2002 | Abelbeck |
| 6,413,197 | B2 | 7/2002 | McKechnie et al. |
| 6,416,442 | B1 | 7/2002 | Stearns et al. |
| 6,416,444 | B1 | 7/2002 | Lim |
| 6,418,394 | B1 | 7/2002 | Puolakanaho et al. |
| 6,419,611 | B1 | 7/2002 | Levine et al. |
| 6,421,358 | B1 | 7/2002 | Stimmel et al. |
| 6,422,976 | B1 | 7/2002 | Eschenbach |
| 6,422,977 | B1 | 7/2002 | Eschenbach |
| 6,422,983 | B1 | 7/2002 | Weck |
| 6,428,449 | B1 | 8/2002 | Apseloff |
| 6,430,997 | B1 | 8/2002 | French et al. |
| 6,432,026 | B1 | 8/2002 | Wang |
| 6,435,466 | B1 | 8/2002 | Adams |
| 6,436,007 | B1 | 8/2002 | Eschenbach |
| 6,436,008 | B1 | 8/2002 | Skowronski et al. |
| 6,440,013 | B1 | 8/2002 | Brown |
| 6,440,042 | B2 | 8/2002 | Eschenbach |
| 6,443,875 | B1 | 9/2002 | Golen, Jr. et al. |
| 6,446,745 | B1 | 9/2002 | Lee |
| 6,447,424 | B1 | 9/2002 | Ashby et al. |
| 6,447,430 | B1 | 9/2002 | Webb et al. |
| 6,450,284 | B1 | 9/2002 | Sakyo et al. |
| 6,450,922 | B1 | 9/2002 | Henderson et al. |
| 6,450,923 | B1 | 9/2002 | Vatti |
| 6,450,925 | B1 | 9/2002 | Kuo |
| 6,454,679 | B1 | 9/2002 | Radow |
| 6,454,682 | B1 | 9/2002 | Kuo |
| 6,455,960 | B1 | 9/2002 | Trago et al. |
| 6,458,060 | B1 | 10/2002 | Watterson et al. |
| 6,458,061 | B2 | 10/2002 | Simonson |
| 6,461,275 | B1 | 10/2002 | Wang et al. |
| 6,461,279 | B1 | 10/2002 | Kuo |
| 6,463,385 | B1 | 10/2002 | Fry |
| 6,464,618 | B1 | 10/2002 | Shea |
| 6,466,460 | B1 | 10/2002 | Rein et al. |
| 6,468,189 | B2 | 10/2002 | Alessandri |
| 6,471,622 | B1 | 10/2002 | Hammer et al. |
| 6,473,483 | B2 | 10/2002 | Pyles |
| 6,474,193 | B1 | 11/2002 | Farney |
| 6,475,115 | B1 | 11/2002 | Candito |
| 6,475,121 | B2 | 11/2002 | Wang |
| 6,475,122 | B2 | 11/2002 | Wu |
| 6,478,721 | B1 | 11/2002 | Hunter |
| 6,478,736 | B1 | 11/2002 | Mault |
| 6,482,128 | B1 | 11/2002 | Michalow |
| 6,482,130 | B1 | 11/2002 | Pasero et al. |
| 6,482,132 | B2 | 11/2002 | Eschenbach |
| 6,484,062 | B1 | 11/2002 | Kim |
| 6,485,397 | B1 | 11/2002 | Manderbacka |
| 6,488,020 | B1 | 12/2002 | Rosas-Magallan |
| 6,491,610 | B1 | 12/2002 | Henn |
| 6,493,652 | B1 | 12/2002 | Ohlenbusch et al. |
| 6,494,814 | B1 | 12/2002 | Wang |
| 6,494,817 | B2 | 12/2002 | Lake |
| 6,497,426 | B2 | 12/2002 | Vanpelt |
| 6,500,097 | B1 | 12/2002 | Hall |
| 6,503,173 | B2 | 1/2003 | Clem |
| 6,505,503 | B1 | 1/2003 | Teresi et al. |
| 6,511,402 | B2 | 1/2003 | Shu et al. |
| 6,513,381 | B2 | 2/2003 | Fyfe et al. |
| 6,513,532 | B2 | 2/2003 | Mault et al. |
| 6,513,669 | B2 | 2/2003 | Ozawa et al. |
| 6,514,180 | B1 | 2/2003 | Rawls |
| 6,515,593 | B1 | 2/2003 | Stark et al. |
| 6,520,891 | B1 | 2/2003 | Stephens, Jr. |
| 6,527,674 | B1 | 3/2003 | Clem |
| 6,527,678 | B1 | 3/2003 | Wang |
| 6,527,685 | B2 | 3/2003 | Endelman et al. |
| 6,527,711 | B1 | 3/2003 | Stivoric et al. |
| 6,527,712 | B1 | 3/2003 | Brown et al. |
| 6,527,796 | B1 | 3/2003 | Magovern |
| 6,530,864 | B1 | 3/2003 | Parks |
| 6,533,707 | B2 | 3/2003 | Wang |
| 6,537,184 | B2 | 3/2003 | Kim |
| 6,539,931 | B2 | 4/2003 | Trajkovic et al. |
| 6,543,247 | B2 | 4/2003 | Strauss |
| 6,544,146 | B1 | 4/2003 | Stearns et al. |
| 6,547,701 | B1 | 4/2003 | Eschenbach |
| 6,547,702 | B1 | 4/2003 | Heidecke |

(56) References Cited

U.S. PATENT DOCUMENTS

| | | | |
|---|---|---|---|
| 6,551,218 | B2 | 4/2003 | Goh |
| 6,551,220 | B1 | 4/2003 | Schroeder |
| 6,551,223 | B2 | 4/2003 | Cheng |
| 6,554,749 | B2 | 4/2003 | Iund et al. |
| 6,558,301 | B1 | 5/2003 | Jackson |
| 6,560,903 | B1 | 5/2003 | Darley |
| 6,561,951 | B2 | 5/2003 | Cannon et al. |
| 6,561,955 | B1 | 5/2003 | Dreissigacker et al. |
| 6,561,960 | B2 | 5/2003 | Webber |
| 6,563,489 | B1 | 5/2003 | Latypov et al. |
| 6,569,061 | B2 | 5/2003 | Stearns et al. |
| 6,569,062 | B2 | 5/2003 | Wang |
| 6,572,511 | B1 | 6/2003 | Volpe |
| 6,572,512 | B2 | 6/2003 | Anderson et al. |
| 6,572,513 | B1 | 6/2003 | Whan-Tong et al. |
| 6,575,878 | B1 | 6/2003 | Choy |
| 6,579,210 | B1 | 6/2003 | Stearns et al. |
| 6,579,214 | B2 | 6/2003 | Crump |
| 6,582,342 | B2 | 6/2003 | Kaufman |
| 6,582,344 | B2 | 6/2003 | Tang |
| 6,585,622 | B1 | 7/2003 | Shum et al. |
| 6,585,624 | B1 | 7/2003 | Chen |
| 6,585,626 | B2 | 7/2003 | McBride |
| 6,589,138 | B2 | 7/2003 | Dyer et al. |
| 6,592,502 | B1 | 7/2003 | Phillips |
| 6,599,223 | B2 | 7/2003 | Wang |
| 6,601,016 | B1 | 7/2003 | Brown et al. |
| 6,601,358 | B2 | 8/2003 | Panatta |
| 6,601,825 | B2 | 8/2003 | Bressner et al. |
| 6,602,191 | B2 | 8/2003 | Quy |
| 6,604,008 | B2 | 8/2003 | Chudley et al. |
| 6,604,023 | B1 | 8/2003 | Brown et al. |
| 6,604,419 | B2 | 8/2003 | Guzman |
| 6,605,020 | B1 | 8/2003 | Huang |
| 6,605,038 | B1 | 8/2003 | Teller et al. |
| 6,605,044 | B2 | 8/2003 | Bimbaum |
| 6,606,374 | B1 | 8/2003 | Rokoff et al. |
| 6,609,478 | B2 | 8/2003 | Del Valle |
| 6,610,063 | B2 | 8/2003 | Kumar et al. |
| 6,611,789 | B1 | 8/2003 | Darley |
| 6,612,170 | B2 | 9/2003 | Brown |
| 6,612,492 | B1 | 9/2003 | Yen |
| 6,612,969 | B2 | 9/2003 | Eschenbach |
| 6,612,971 | B1 | 9/2003 | Morris |
| 6,616,578 | B2 | 9/2003 | Alessandri |
| 6,619,681 | B2 | 9/2003 | Gutierrez |
| 6,619,835 | B2 | 9/2003 | Kita |
| 6,620,079 | B2 | 9/2003 | Kuo |
| 6,623,407 | B2 | 9/2003 | Novak |
| 6,623,409 | B1 | 9/2003 | Abelbeck |
| 6,626,799 | B2 | 9/2003 | Watterson et al. |
| 6,626,800 | B1 | 9/2003 | Casler |
| 6,626,802 | B1 | 9/2003 | Rodgers, Jr. |
| 6,626,803 | B1 | 9/2003 | Oglesby et al. |
| 6,629,902 | B2 | 10/2003 | Murphy et al. |
| 6,629,910 | B1 | 10/2003 | Krull |
| 6,632,161 | B1 | 10/2003 | Nir |
| 6,634,992 | B1 | 10/2003 | Ogawa |
| 6,634,996 | B2 | 10/2003 | Jacobsen |
| 6,635,015 | B2 | 10/2003 | Sagel |
| 6,637,811 | B2 | 10/2003 | Zheng |
| 6,637,818 | B2 | 10/2003 | Williams |
| 6,638,160 | B2 | 10/2003 | Yoshitomi |
| 6,645,124 | B1 | 11/2003 | Clem |
| 6,645,125 | B1 | 11/2003 | Stearns et al. |
| 6,645,126 | B1 | 11/2003 | Martin et al. |
| 6,645,130 | B2 | 11/2003 | Webber |
| 6,648,353 | B1 | 11/2003 | Cabal |
| 6,648,798 | B2 | 11/2003 | Yoo |
| 6,648,800 | B2 | 11/2003 | Stearns et al. |
| 6,648,801 | B2 | 11/2003 | Stearns et al. |
| 6,648,802 | B2 | 11/2003 | Ware |
| 6,652,424 | B2 | 11/2003 | Dalebout |
| 6,652,425 | B1 | 11/2003 | Martin et al. |
| 6,652,429 | B2 | 11/2003 | Bushnell |
| 6,656,091 | B1 | 12/2003 | Abelbeck |
| 6,659,916 | B1 | 12/2003 | Shea |
| 6,659,946 | B1 | 12/2003 | Batchelor et al. |
| 6,660,949 | B2 | 12/2003 | Kamino et al. |
| 6,661,136 | B1 | 12/2003 | Lee |
| 6,663,127 | B2 | 12/2003 | Miller |
| 6,663,498 | B2 | 12/2003 | Stipan |
| 6,663,500 | B2 | 12/2003 | Huang |
| 6,666,800 | B2 | 12/2003 | Krull |
| 6,666,801 | B1 | 12/2003 | Michalow |
| 6,668,678 | B1 | 12/2003 | Baba et al. |
| 6,669,600 | B2 | 12/2003 | Warner |
| 6,669,609 | B2 | 12/2003 | Gerschefske et al. |
| 6,671,975 | B2 | 1/2004 | Hennessey |
| 6,672,991 | B2 | 1/2004 | O'Malley |
| 6,672,992 | B1 | 1/2004 | Lo et al. |
| 6,672,994 | B1 | 1/2004 | Stearns et al. |
| 6,676,530 | B2 | 1/2004 | Lochtefeld |
| 6,676,569 | B1 | 1/2004 | Radow |
| 6,676,572 | B2 | 1/2004 | Wang |
| 6,676,579 | B1 | 1/2004 | Lin |
| 6,677,299 | B2 | 1/2004 | Stern et al. |
| 6,679,816 | B1 | 1/2004 | Krull |
| 6,679,820 | B2 | 1/2004 | Barkus et al. |
| 6,681,014 | B1 | 1/2004 | Ghassabian |
| 6,681,704 | B1 | 1/2004 | Brookhiser |
| 6,681,728 | B2 | 1/2004 | Haghgooie |
| 6,682,460 | B2 | 1/2004 | Lo |
| 6,682,461 | B2 | 1/2004 | Wang |
| 6,685,480 | B2 | 2/2004 | Nishimoto et al. |
| 6,685,601 | B1 | 2/2004 | Knapp |
| 6,685,602 | B2 | 2/2004 | Colosky, Jr. et al. |
| 6,685,607 | B1 | 2/2004 | Olson |
| 6,687,535 | B2 | 2/2004 | Hautala et al. |
| 6,689,019 | B2 | 2/2004 | Ohrt et al. |
| 6,689,057 | B1 | 2/2004 | Shinsel et al. |
| 6,691,839 | B1 | 2/2004 | El-Kassouf |
| 6,695,694 | B2 | 2/2004 | Ishikawa et al. |
| 6,695,799 | B2 | 2/2004 | Kitadou et al. |
| 6,698,110 | B1 | 3/2004 | Robbins |
| 6,699,159 | B2 | 3/2004 | Rouse |
| 6,699,162 | B2 | 3/2004 | Chen |
| 6,700,788 | B2 | 3/2004 | Matsushita et al. |
| 6,701,271 | B2 | 3/2004 | Willner et al. |
| 6,702,719 | B1 | 3/2004 | Brown et al. |
| 6,705,977 | B1 | 3/2004 | Ziak |
| 6,708,427 | B2 | 3/2004 | Sussmann et al. |
| 6,712,737 | B1 | 3/2004 | Nusbaum |
| 6,716,139 | B1 | 4/2004 | Hosseinzadeh-Dolkhani |
| 6,716,142 | B2 | 4/2004 | Kuo |
| 6,716,144 | B1 | 4/2004 | Shifferaw |
| 6,719,667 | B2 | 4/2004 | Wong et al. |
| 6,719,669 | B1 | 4/2004 | Wang |
| 6,722,888 | B1 | 4/2004 | Macri et al. |
| 6,723,413 | B2 | 4/2004 | Walters |
| 6,726,113 | B2 | 4/2004 | Guo |
| 6,726,600 | B2 | 4/2004 | Miller |
| 6,726,601 | B1 | 4/2004 | Beutel |
| 6,726,602 | B2 | 4/2004 | Chang |
| 6,730,002 | B2 | 5/2004 | Hald et al. |
| 6,733,423 | B1 | 5/2004 | Chang |
| 6,733,424 | B2 | 5/2004 | Krull |
| 6,736,360 | B1 | 5/2004 | Buczek |
| 6,736,759 | B1 | 5/2004 | Stubbs et al. |
| 6,738,274 | B2 | 5/2004 | Prasad et al. |
| 6,740,007 | B2 | 5/2004 | Gordon et al. |
| 6,740,009 | B1 | 5/2004 | Hall |
| 6,741,052 | B2 | 5/2004 | Fitzgibbon |
| 6,743,153 | B2 | 6/2004 | Watterson et al. |
| 6,746,247 | B2 | 6/2004 | Barton |
| 6,746,371 | B1 | 6/2004 | Brown et al. |
| 6,747,427 | B1 | 6/2004 | Carson |
| 6,749,432 | B2 | 6/2004 | French et al. |
| 6,749,536 | B1 | 6/2004 | Cuskaden et al. |
| 6,749,537 | B1 | 6/2004 | Hickman |
| 6,749,542 | B2 | 6/2004 | Wu |
| 6,749,546 | B2 | 6/2004 | Yang |
| 6,751,439 | B2 | 6/2004 | Tice et al. |
| 6,757,572 | B1 | 6/2004 | Forest |

(56) References Cited

U.S. PATENT DOCUMENTS

| | | | |
|---|---|---|---|
| 6,758,790 | B1 | 7/2004 | Ellis |
| 6,758,791 | B1 | 7/2004 | Kuo |
| 6,758,792 | B1 | 7/2004 | Chang |
| 6,761,387 | B2 | 7/2004 | Sloss |
| 6,761,667 | B1 | 7/2004 | Cutler et al. |
| 6,764,429 | B1 | 7/2004 | Michalow |
| 6,764,430 | B1 | 7/2004 | Fencel |
| 6,764,431 | B2 | 7/2004 | Yoss |
| 6,765,726 | B2 | 7/2004 | French et al. |
| 6,767,314 | B2 | 7/2004 | Thompson |
| 6,769,689 | B1 | 8/2004 | Shimomura et al. |
| 6,770,015 | B2 | 8/2004 | Simonson |
| 6,776,740 | B1 | 8/2004 | Anderson et al. |
| 6,778,938 | B1 | 8/2004 | Ng et al. |
| 6,783,482 | B2 | 8/2004 | Oglesby et al. |
| 6,786,415 | B2 | 9/2004 | Yiu |
| 6,786,821 | B2 | 9/2004 | Nobe et al. |
| 6,786,847 | B1 | 9/2004 | Morgan et al. |
| 6,786,848 | B2 | 9/2004 | Yamashita et al. |
| 6,786,850 | B2 | 9/2004 | Nizamuddin |
| 6,786,852 | B2 | 9/2004 | Watterson et al. |
| 6,790,162 | B1 | 9/2004 | Ellis et al. |
| 6,790,163 | B1 | 9/2004 | Van De Laarschot |
| 6,790,178 | B1 | 9/2004 | Mault et al. |
| 6,793,607 | B2 | 9/2004 | Neil |
| 6,793,609 | B1 | 9/2004 | Fan |
| 6,796,159 | B2 | 9/2004 | Kelm et al. |
| 6,796,927 | B2 | 9/2004 | Toyama |
| 6,798,378 | B1 | 9/2004 | Burk |
| 6,807,869 | B2 | 10/2004 | Farringdon et al. |
| 6,808,458 | B1 | 10/2004 | Jung |
| 6,808,472 | B1 | 10/2004 | Hickman |
| 6,808,473 | B2 | 10/2004 | Hisano et al. |
| 6,808,475 | B2 | 10/2004 | Kehrbaum |
| 6,811,516 | B1 | 11/2004 | Dugan |
| 6,811,519 | B2 | 11/2004 | Kuo |
| 6,811,520 | B2 | 11/2004 | Wu |
| 6,817,117 | B1 | 11/2004 | Campbell |
| 6,817,968 | B2 | 11/2004 | Galbraith et al. |
| 6,817,979 | B2 | 11/2004 | Nihtilä |
| 6,821,230 | B2 | 11/2004 | Dalebout et al. |
| 6,823,036 | B1 | 11/2004 | Chen |
| 6,823,327 | B1 | 11/2004 | Klug |
| 6,824,210 | B2 | 11/2004 | Zheng |
| 6,824,502 | B1 | 11/2004 | Huang |
| 6,825,164 | B1 | 11/2004 | Stern et al. |
| 6,825,876 | B1 | 11/2004 | Easwar et al. |
| 6,827,669 | B2 | 12/2004 | Cohen et al. |
| 6,827,670 | B1 | 12/2004 | Stark et al. |
| 6,827,822 | B2 | 12/2004 | Tao et al. |
| 6,830,540 | B2 | 12/2004 | Watterson |
| 6,830,541 | B2 | 12/2004 | Wu |
| 6,835,166 | B1 | 12/2004 | Stearns et al. |
| 6,837,827 | B1 | 1/2005 | Lee et al. |
| 6,837,829 | B2 | 1/2005 | Eschenbach |
| 6,837,830 | B2 | 1/2005 | Eldridge |
| 6,837,838 | B2 | 1/2005 | List |
| 6,840,892 | B1 | 1/2005 | Wu |
| 6,840,904 | B2 | 1/2005 | Goldberg |
| 6,842,928 | B2 | 1/2005 | Yang et al. |
| 6,843,732 | B1 | 1/2005 | Huang |
| 6,846,270 | B1 | 1/2005 | Etnyre |
| 6,846,272 | B2 | 1/2005 | Rosenow et al. |
| 6,849,032 | B2 | 2/2005 | Chu |
| 6,852,068 | B2 | 2/2005 | Ogawa |
| 6,852,069 | B2 | 2/2005 | Park |
| 6,855,093 | B2 | 2/2005 | Anderson et al. |
| 6,855,097 | B2 | 2/2005 | Krull |
| 6,857,993 | B2 | 2/2005 | Yeh |
| 6,859,215 | B1 | 2/2005 | Brown et al. |
| 6,860,836 | B1 | 3/2005 | Wu |
| 6,860,839 | B1 | 3/2005 | Dice |
| 6,863,641 | B1 | 3/2005 | Brown et al. |
| 6,866,613 | B1 | 3/2005 | Brown et al. |
| 6,872,077 | B2 | 3/2005 | Yeager |
| 6,872,168 | B2 | 3/2005 | Wang et al. |
| 6,872,175 | B2 | 3/2005 | Lin |
| 6,872,187 | B1 | 3/2005 | Stark et al. |
| 6,875,157 | B1 | 4/2005 | Wang |
| 6,875,160 | B2 | 4/2005 | Watterson et al. |
| 6,876,496 | B2 | 4/2005 | French et al. |
| 6,876,947 | B1 | 4/2005 | Darley et al. |
| 6,878,099 | B2 | 4/2005 | Corbalis et al. |
| 6,878,101 | B2 | 4/2005 | Colley |
| 6,880,487 | B2 | 4/2005 | Reinkensmeyer et al. |
| 6,882,955 | B1 | 4/2005 | Ohlenbusch et al. |
| 6,885,971 | B2 | 4/2005 | Vock et al. |
| 6,886,613 | B1 | 5/2005 | Zahdeh |
| 6,887,185 | B1 | 5/2005 | Kuo |
| 6,887,190 | B1 | 5/2005 | Azari |
| 6,893,383 | B1 | 5/2005 | Chang et al. |
| 6,896,645 | B1 | 5/2005 | Krull |
| 6,899,657 | B2 | 5/2005 | Chuang |
| 6,899,659 | B2 | 5/2005 | Anderson et al. |
| 6,902,513 | B1 | 6/2005 | Mcclure |
| 6,902,515 | B2 | 6/2005 | Howell et al. |
| 6,905,440 | B2 | 6/2005 | Heppert |
| 6,905,446 | B2 | 6/2005 | Greenland |
| 6,908,416 | B2 | 6/2005 | Mercado et al. |
| 6,908,417 | B2 | 6/2005 | Jackson |
| 6,913,562 | B2 | 7/2005 | Chen |
| 6,913,563 | B2 | 7/2005 | Chen |
| 6,915,271 | B1 | 7/2005 | Meyer et al. |
| 6,916,278 | B2 | 7/2005 | Webber |
| 6,918,858 | B2 | 7/2005 | Watterson et al. |
| 6,918,859 | B1 | 7/2005 | Yeh |
| 6,918,860 | B1 | 7/2005 | Nusbaum |
| 6,921,351 | B1 | 7/2005 | Hickman et al. |
| 6,921,354 | B1 | 7/2005 | Shifferaw |
| 6,921,355 | B2 | 7/2005 | Campanaro et al. |
| 6,923,746 | B1 | 8/2005 | Skowronski et al. |
| 6,923,747 | B1 | 8/2005 | Chu |
| 6,926,644 | B2 | 8/2005 | Chen |
| 6,926,646 | B1 | 8/2005 | Nguyen |
| 6,932,745 | B1 | 8/2005 | Ellis |
| 6,934,658 | B2 | 8/2005 | Clabes et al. |
| 6,936,007 | B2 | 8/2005 | Quy |
| 6,937,289 | B1 | 8/2005 | Ranta et al. |
| 6,942,599 | B1 | 9/2005 | Racine |
| 6,944,294 | B2 | 9/2005 | Tsay |
| 6,945,912 | B2 | 9/2005 | Levi |
| 6,945,916 | B2 | 9/2005 | Schroeder |
| 6,945,917 | B1 | 9/2005 | Baatz |
| 6,949,053 | B1 | 9/2005 | Stearns |
| 6,949,054 | B1 | 9/2005 | Stearns |
| 6,952,221 | B1 | 10/2005 | Holtz et al. |
| 6,953,418 | B1 | 10/2005 | Chen |
| 6,955,542 | B2 | 10/2005 | Roncalez et al. |
| 6,960,156 | B2 | 11/2005 | Smith |
| 6,964,632 | B1 | 11/2005 | Ko |
| 6,966,872 | B2 | 11/2005 | Eschenbach |
| 6,971,972 | B1 | 12/2005 | Mcgovern |
| 6,971,973 | B2 | 12/2005 | Cohen et al. |
| 6,974,403 | B2 | 12/2005 | Wong et al. |
| 6,974,404 | B1 | 12/2005 | Watterson et al. |
| 6,975,910 | B1 | 12/2005 | Brown et al. |
| 6,976,624 | B2 | 12/2005 | Hsiao |
| 6,976,698 | B2 | 12/2005 | Kuiken |
| 6,976,958 | B2 | 12/2005 | Quy |
| 6,979,283 | B2 | 12/2005 | Pan |
| 6,991,586 | B2 | 1/2006 | Lapcevic |
| 6,991,588 | B1 | 1/2006 | Adams |
| 6,994,306 | B1 | 2/2006 | Sweere et al. |
| 6,994,657 | B1 | 2/2006 | Eschenbach |
| 6,996,852 | B1 | 2/2006 | Cabrera |
| 6,997,852 | B2 | 2/2006 | Watterson et al. |
| 6,997,853 | B1 | 2/2006 | Cuskaden et al. |
| 6,997,856 | B1 | 2/2006 | Krull |
| 7,001,288 | B2 | 2/2006 | Harrell |
| 7,003,122 | B2 | 2/2006 | Chen |
| 7,004,271 | B1 | 2/2006 | Kamen et al. |
| 7,004,887 | B2 | 2/2006 | Pan et al. |
| 7,004,888 | B1 | 2/2006 | Weng |
| 7,008,356 | B2 | 3/2006 | Hung |

(56) References Cited

U.S. PATENT DOCUMENTS

| | | | |
|---|---|---|---|
| 7,008,359 | B2 | 3/2006 | Fan et al. |
| 7,011,326 | B1 | 3/2006 | Schroeder et al. |
| 7,011,607 | B2 | 3/2006 | Kolda et al. |
| 7,011,609 | B1 | 3/2006 | Kuo |
| 7,015,950 | B1 | 3/2006 | Pryor |
| 7,016,812 | B2 | 3/2006 | Aritsuka et al. |
| 7,020,508 | B2 | 3/2006 | Stivoric |
| 7,022,047 | B2 | 4/2006 | Cohen et al. |
| 7,022,048 | B1 | 4/2006 | Fernandez |
| 7,022,051 | B2 | 4/2006 | Ota |
| 7,032,870 | B2 | 4/2006 | Sweere et al. |
| 7,033,176 | B2 | 4/2006 | Feldman |
| 7,033,306 | B2 | 4/2006 | Graber |
| 7,035,936 | B2 | 4/2006 | Fouquet |
| 7,038,855 | B2 | 5/2006 | French et al. |
| 7,039,263 | B2 | 5/2006 | Towle |
| 7,041,034 | B1 | 5/2006 | Stearns et al. |
| 7,041,038 | B2 | 5/2006 | Smith |
| 7,041,041 | B1 | 5/2006 | Evans |
| 7,041,049 | B1 | 5/2006 | Raniere |
| 7,044,891 | B1 | 5/2006 | Rivera |
| 7,051,049 | B2 | 5/2006 | Samn |
| 7,052,426 | B2 | 5/2006 | Battat et al. |
| 7,052,440 | B2 | 5/2006 | Pyles et al. |
| 7,052,444 | B2 | 5/2006 | Webber |
| 7,052,446 | B2 | 5/2006 | Morris et al. |
| 7,055,899 | B2 | 6/2006 | Zhurong et al. |
| 7,056,265 | B1 | 6/2006 | Shea |
| 7,060,005 | B2 | 6/2006 | Carlsen et al. |
| 7,060,006 | B1 | 6/2006 | Watterson et al. |
| 7,060,008 | B2 | 6/2006 | Watterson et al. |
| 7,060,031 | B2 | 6/2006 | Webb et al. |
| 7,063,644 | B2 | 6/2006 | Albert et al. |
| 7,065,768 | B1 | 6/2006 | Janzig et al. |
| 7,066,865 | B2 | 6/2006 | Radow |
| 7,070,415 | B2 | 7/2006 | Hojo et al. |
| 7,070,539 | B2 | 7/2006 | Brown et al. |
| 7,070,542 | B2 | 7/2006 | Reyes et al. |
| 7,070,545 | B2 | 7/2006 | Lull et al. |
| 7,072,789 | B2 | 7/2006 | Vock et al. |
| 7,073,852 | B1 | 7/2006 | Zheng |
| 7,077,788 | B2 | 7/2006 | Chang |
| 7,077,791 | B2 | 7/2006 | Krull |
| 7,081,073 | B1 | 7/2006 | Smith |
| 7,082,703 | B2 | 8/2006 | Greene et al. |
| 7,086,994 | B2 | 8/2006 | Turak et al. |
| 7,090,621 | B2 | 8/2006 | Loane |
| 7,090,622 | B2 | 8/2006 | Hetrick |
| 7,091,635 | B1 | 8/2006 | Gilliland et al. |
| 7,094,184 | B1 | 8/2006 | Chen et al. |
| 7,097,591 | B2 | 8/2006 | Moon |
| 7,097,593 | B2 | 8/2006 | Chang |
| 7,100,517 | B1 | 9/2006 | Godwin |
| 7,101,319 | B1 | 9/2006 | Potts |
| 7,101,322 | B2 | 9/2006 | Carle |
| 7,101,330 | B2 | 9/2006 | Elbaz et al. |
| 7,104,926 | B2 | 9/2006 | Carlson |
| 7,104,937 | B2 | 9/2006 | Arbuckle |
| 7,108,641 | B2 | 9/2006 | Pertegaz-Esteban |
| 7,108,659 | B2 | 9/2006 | Ross et al. |
| 7,113,166 | B1 | 9/2006 | Rosenberg et al. |
| 7,115,073 | B2 | 10/2006 | Nizamuddin |
| 7,115,076 | B2 | 10/2006 | Oglesby et al. |
| 7,121,980 | B2 | 10/2006 | Chen |
| 7,125,371 | B2 | 10/2006 | Henderson |
| 7,128,692 | B2 | 10/2006 | Black |
| 7,128,693 | B2 | 10/2006 | Brown et al. |
| 7,132,939 | B2 | 11/2006 | Tyndall et al. |
| 7,139,835 | B2 | 11/2006 | Fouquet et al. |
| 7,140,626 | B1 | 11/2006 | Keay |
| 7,141,008 | B2 | 11/2006 | Krull et al. |
| 7,148,879 | B2 | 12/2006 | Amento et al. |
| 7,151,214 | B2 | 12/2006 | Barry |
| 7,156,776 | B2 | 1/2007 | Maser |
| 7,156,808 | B2 | 1/2007 | Quy |
| 7,156,809 | B2 | 1/2007 | Quy |
| 7,158,938 | B2 | 1/2007 | Labbe et al. |
| 7,163,489 | B1 | 1/2007 | Nelson |
| 7,163,493 | B1 | 1/2007 | Kuo |
| 7,163,498 | B1 | 1/2007 | Abelbeck |
| 7,163,500 | B2 | 1/2007 | Endelman et al. |
| 7,166,062 | B1 | 1/2007 | Watterson et al. |
| 7,166,064 | B2 | 1/2007 | Watterson et al. |
| 7,166,067 | B2 | 1/2007 | Talish et al. |
| 7,168,668 | B2 | 1/2007 | Coyle |
| 7,169,087 | B2 | 1/2007 | Ercanbrack et al. |
| 7,169,088 | B2 | 1/2007 | Rodgers, Jr. |
| 7,169,093 | B2 | 1/2007 | Simonson et al. |
| 7,170,016 | B2 | 1/2007 | Dumornay |
| 7,171,331 | B2 | 1/2007 | Vock et al. |
| 7,172,531 | B2 | 2/2007 | Rodgers, Jr. |
| 7,175,193 | B2 | 2/2007 | Wu |
| 7,179,207 | B2 | 2/2007 | Gerschefske |
| 7,179,208 | B1 | 2/2007 | Nalley |
| 7,179,209 | B2 | 2/2007 | Sechrest et al. |
| 7,182,738 | B2 | 2/2007 | Bonutti et al. |
| 7,186,189 | B2 | 3/2007 | Huang |
| 7,187,961 | B2 | 3/2007 | Yamashita et al. |
| 7,188,439 | B2 | 3/2007 | DiBenedetto et al. |
| 7,192,387 | B2 | 3/2007 | Mendel |
| 7,192,388 | B2 | 3/2007 | Dalebout et al. |
| 7,195,568 | B2 | 3/2007 | Huang |
| 7,197,029 | B1 | 3/2007 | Osterhout et al. |
| 7,200,517 | B2 | 4/2007 | Darley et al. |
| 7,201,705 | B2 | 4/2007 | Rodgers, Jr. |
| 7,201,707 | B1 | 4/2007 | Moon |
| 7,204,328 | B2 | 4/2007 | LoPresti |
| 7,207,930 | B2 | 4/2007 | Bonutti |
| 7,211,029 | B2 | 5/2007 | Kau |
| 7,217,224 | B2 | 5/2007 | Thomas |
| 7,217,225 | B2 | 5/2007 | Husted et al. |
| 7,220,219 | B2 | 5/2007 | Papadopoulos et al. |
| 7,220,221 | B2 | 5/2007 | Mosimann et al. |
| 7,223,209 | B2 | 5/2007 | Lee |
| 7,223,213 | B2 | 5/2007 | Golesh |
| 7,223,216 | B1 | 5/2007 | McBride |
| 7,224,326 | B2 | 5/2007 | Sefton |
| 7,225,282 | B1 | 5/2007 | Lyle |
| 7,225,565 | B2 | 6/2007 | DiBenedetto et al. |
| 7,225,694 | B2 | 6/2007 | Said |
| 7,226,402 | B1 | 6/2007 | Joya |
| 7,235,942 | B2 | 6/2007 | Nagaoka et al. |
| 7,236,154 | B1 | 6/2007 | Kerr et al. |
| 7,238,147 | B2 | 7/2007 | Mills et al. |
| 7,247,128 | B2 | 7/2007 | Oga |
| 7,250,022 | B2 | 7/2007 | Dalebout |
| 7,254,516 | B2 | 8/2007 | Case, Jr. et al. |
| 7,257,468 | B1 | 8/2007 | Costa et al. |
| 7,258,651 | B2 | 8/2007 | Clarke |
| 7,259,906 | B1 | 8/2007 | Islam |
| 7,264,554 | B2 | 9/2007 | Bentley |
| 7,269,038 | B2 | 9/2007 | Shekhawat |
| 7,278,934 | B2 | 10/2007 | McBride et al. |
| 7,278,966 | B2 | 10/2007 | Hjelt et al. |
| 7,279,868 | B2 | 10/2007 | Lanni |
| 7,285,075 | B2 | 10/2007 | Cutler et al. |
| 7,285,090 | B2 | 10/2007 | Stivoric et al. |
| 7,287,770 | B2 | 10/2007 | Drabant et al. |
| 7,290,760 | B1 | 11/2007 | Lindsay |
| 7,291,096 | B2 | 11/2007 | Ho |
| 7,292,151 | B2 | 11/2007 | Ferguson |
| 7,293,510 | B1 | 11/2007 | Siao |
| 7,294,094 | B1 | 11/2007 | Howle |
| 7,294,095 | B2 | 11/2007 | Charnitski |
| 7,294,100 | B2 | 11/2007 | Bull |
| 7,303,508 | B2 | 12/2007 | Toyama et al. |
| 7,303,510 | B2 | 12/2007 | Gebhardt |
| 7,308,818 | B2 | 12/2007 | Considine et al. |
| 7,311,640 | B2 | 12/2007 | Baatz |
| 7,316,633 | B2 | 1/2008 | Liao et al. |
| 7,319,457 | B2 | 1/2008 | Lin et al. |
| 7,322,907 | B2 | 1/2008 | Bowser |
| 7,328,119 | B1 | 2/2008 | Pryor |
| 7,329,684 | B2 | 2/2008 | Mjalli et al. |

(56) References Cited

U.S. PATENT DOCUMENTS

| | | | |
|---|---|---|---|
| 7,334,350 | B2 | 2/2008 | Ellis, III |
| 7,335,139 | B2 | 2/2008 | Bartholomew et al. |
| 7,335,140 | B2 | 2/2008 | Webber et al. |
| 7,335,147 | B2 | 2/2008 | Jones |
| 7,336,178 | B2 | 2/2008 | Le |
| 7,344,481 | B2 | 3/2008 | Watterson et al. |
| 7,346,935 | B1 | 3/2008 | Patterson |
| 7,347,806 | B2 | 3/2008 | Nakano et al. |
| 7,350,787 | B2 | 4/2008 | Voss |
| 7,351,187 | B2 | 4/2008 | Seliber |
| 7,352,365 | B2 | 4/2008 | Trachte |
| 7,354,380 | B2 | 4/2008 | Volpe, Jr. |
| 7,357,756 | B2 | 4/2008 | Demas |
| 7,357,758 | B2 | 4/2008 | Polk, III |
| 7,359,121 | B2 | 4/2008 | French et al. |
| 7,361,125 | B2 | 4/2008 | Webber et al. |
| 7,364,538 | B2 | 4/2008 | Aucamp |
| 7,365,647 | B2 | 4/2008 | Nativ |
| 7,366,921 | B2 | 4/2008 | Ranganathan |
| 7,367,926 | B2 | 5/2008 | Clark |
| 7,369,121 | B2 | 5/2008 | Lane |
| 7,372,485 | B1 | 5/2008 | Bodnar et al. |
| 7,373,820 | B1 | 5/2008 | James |
| 7,374,519 | B2 | 5/2008 | Naidus |
| 7,374,522 | B2 | 5/2008 | Arnold |
| 7,377,881 | B2 | 5/2008 | Moon |
| 7,381,161 | B2 | 6/2008 | Ellis |
| 7,383,081 | B2 | 6/2008 | Butt et al. |
| 7,384,013 | B2 | 6/2008 | Yen |
| 7,393,308 | B1 | 7/2008 | Huang |
| 7,398,151 | B1 | 7/2008 | Burrell et al. |
| 7,401,918 | B2 | 7/2008 | Howell et al. |
| 7,402,125 | B2 | 7/2008 | Wang |
| 7,402,145 | B1 | 7/2008 | Woggon |
| 7,412,206 | B1 | 8/2008 | Hutchings et al. |
| 7,413,532 | B1 | 8/2008 | Monsrud et al. |
| 7,416,537 | B1 | 8/2008 | Stark et al. |
| 7,418,862 | B2 | 9/2008 | Gruben et al. |
| 7,425,189 | B1 | 9/2008 | Eschenbach |
| 7,428,760 | B2 | 9/2008 | McCrimmon |
| 7,429,236 | B2 | 9/2008 | Dalebout et al. |
| 7,432,184 | B2 | 10/2008 | Hosokawa et al. |
| 7,432,454 | B1 | 10/2008 | Sze et al. |
| 7,432,677 | B2 | 10/2008 | Heydt et al. |
| 7,435,202 | B2 | 10/2008 | Daly et al. |
| 7,435,205 | B2 | 10/2008 | Reyes et al. |
| 7,452,336 | B2 | 11/2008 | Thompson |
| 7,454,002 | B1 | 11/2008 | Gardner et al. |
| 7,455,621 | B1 | 11/2008 | Anthony |
| 7,455,622 | B2 | 11/2008 | Watterson et al. |
| 7,455,626 | B2 | 11/2008 | Trevino et al. |
| 7,455,628 | B1 | 11/2008 | Stearns |
| 7,462,141 | B1 | 12/2008 | Raboin et al. |
| 7,465,257 | B1 | 12/2008 | Morgan, Jr. |
| 7,470,234 | B1 | 12/2008 | Elhag et al. |
| 7,475,613 | B2 | 1/2009 | Bailey |
| 7,477,890 | B1 | 1/2009 | Narayanaswami |
| 7,480,512 | B2 | 1/2009 | Graham et al. |
| 7,488,277 | B1 | 2/2009 | Knapp |
| 7,489,979 | B2 | 2/2009 | Rosenberg |
| 7,491,159 | B2 | 2/2009 | Patterson |
| 7,494,450 | B2 | 2/2009 | Solomon |
| 7,497,784 | B2 | 3/2009 | Henry |
| 7,503,476 | B2 | 3/2009 | Bhavnani |
| 7,503,878 | B1 | 3/2009 | Amsbury et al. |
| 7,507,183 | B2 | 3/2009 | Anderson |
| 7,507,187 | B2 | 3/2009 | Dyer et al. |
| 7,507,189 | B2 | 3/2009 | Krull |
| 7,507,190 | B2 | 3/2009 | Piane, Jr. |
| 7,510,509 | B2 | 3/2009 | Hickman |
| 7,510,511 | B2 | 3/2009 | Von Detten |
| 7,517,303 | B2 | 4/2009 | Crawford et al. |
| 7,519,327 | B2 | 4/2009 | White |
| 7,519,537 | B2 | 4/2009 | Rosenberg |
| 7,520,840 | B2 | 4/2009 | Shifferaw |
| 7,521,623 | B2 | 4/2009 | Bowen |
| 7,524,272 | B2 | 4/2009 | Bruck et al. |
| 7,525,293 | B1 | 4/2009 | Notohamiprodjo et al. |
| 7,532,977 | B2 | 5/2009 | Chen |
| 7,534,206 | B1 | 5/2009 | Lovitt et al. |
| 7,537,546 | B2 | 5/2009 | Watterson et al. |
| 7,537,549 | B2 | 5/2009 | Nelson et al. |
| 7,537,550 | B1 | 5/2009 | Krull |
| 7,537,552 | B2 | 5/2009 | Dalebout et al. |
| 7,539,487 | B2 | 5/2009 | Sinclair et al. |
| 7,540,828 | B2 | 6/2009 | Watterson et al. |
| 7,540,829 | B1 | 6/2009 | Lin |
| 7,542,816 | B2 | 6/2009 | Rosenberg |
| 7,543,934 | B2 | 6/2009 | Howell et al. |
| 7,544,153 | B2 | 6/2009 | Trevino et al. |
| 7,549,947 | B2 | 6/2009 | Hickman et al. |
| 7,553,260 | B2 | 6/2009 | Piaget et al. |
| 7,553,262 | B2 | 6/2009 | Piane, Jr. |
| 7,556,590 | B2 | 7/2009 | Watterson et al. |
| 7,556,591 | B2 | 7/2009 | Chuang |
| 7,559,879 | B2 | 7/2009 | Anderson et al. |
| 7,561,989 | B2 | 7/2009 | Banks et al. |
| 7,562,117 | B2 | 7/2009 | Rosenberg |
| 7,563,203 | B2 | 7/2009 | Dalebout et al. |
| 7,563,205 | B2 | 7/2009 | Alling |
| 7,569,000 | B2 | 8/2009 | Wang |
| 7,569,004 | B2 | 8/2009 | Kolomeir |
| 7,575,536 | B1 | 8/2009 | Hickman |
| 7,575,537 | B2 | 8/2009 | Ellis |
| 7,575,538 | B1 | 8/2009 | Clark |
| 7,577,522 | B2 | 8/2009 | Rosenberg |
| 7,579,946 | B2 | 8/2009 | Case, Jr. |
| 7,585,251 | B2 | 9/2009 | Doody, Jr. et al. |
| 7,585,254 | B1 | 9/2009 | Vittone |
| 7,585,258 | B2 | 9/2009 | Watson et al. |
| 7,586,032 | B2 | 9/2009 | Louis |
| 7,591,770 | B2 | 9/2009 | Stewart et al. |
| 7,591,795 | B2 | 9/2009 | Whalen et al. |
| 7,594,877 | B2 | 9/2009 | Anderson et al. |
| 7,594,878 | B1 | 9/2009 | Joannou |
| 7,598,255 | B2 | 10/2009 | Dvorak |
| 7,601,096 | B2 | 10/2009 | Negrin |
| 7,601,097 | B2 | 10/2009 | Miyamaru et al. |
| 7,601,101 | B2 | 10/2009 | Jackson et al. |
| 7,602,301 | B1 | 10/2009 | Stirling et al. |
| 7,603,255 | B2 | 10/2009 | Case, Jr. et al. |
| 7,604,571 | B2 | 10/2009 | Wilkins et al. |
| 7,604,572 | B2 | 10/2009 | Stanford |
| 7,604,573 | B2 | 10/2009 | Dalebout et al. |
| 7,607,243 | B2 | 10/2009 | Berner, Jr. et al. |
| 7,608,015 | B2 | 10/2009 | Radow |
| 7,608,021 | B1 | 10/2009 | Nalley |
| 7,608,023 | B2 | 10/2009 | Casagrande |
| 7,614,639 | B2 | 11/2009 | Tholkes et al. |
| 7,614,981 | B2 | 11/2009 | Cao |
| 7,616,097 | B1 | 11/2009 | Whang |
| 7,618,345 | B2 | 11/2009 | Corbalis et al. |
| 7,618,346 | B2 | 11/2009 | Crawford et al. |
| 7,619,514 | B1 | 11/2009 | Stone |
| 7,621,850 | B2 | 11/2009 | Piaget et al. |
| 7,621,855 | B1 | 11/2009 | Krull |
| 7,625,314 | B2 | 12/2009 | Ungari |
| 7,625,315 | B2 | 12/2009 | Hickman |
| 7,625,316 | B1 | 12/2009 | Amsbury et al. |
| 7,628,730 | B1 | 12/2009 | Watterson et al. |
| 7,628,732 | B1 | 12/2009 | Porszasz et al. |
| 7,628,737 | B2 | 12/2009 | Kowallis et al. |
| 7,631,382 | B2 | 12/2009 | DiBenedetto et al. |
| 7,637,847 | B1 | 12/2009 | Hickman |
| 7,637,850 | B2 | 12/2009 | Lin |
| 7,639,520 | B1 | 12/2009 | Zansky et al. |
| 7,641,592 | B2 | 1/2010 | Roche |
| 7,643,895 | B2 | 1/2010 | Gupta et al. |
| 7,645,212 | B2 | 1/2010 | Ashby et al. |
| 7,645,213 | B2 | 1/2010 | Watterson |
| 7,645,214 | B2 | 1/2010 | Lull |
| 7,645,218 | B2 | 1/2010 | Potok et al. |
| 7,647,196 | B2 | 1/2010 | Kahn et al. |
| 7,648,443 | B2 | 1/2010 | Schenk |

(56) References Cited

U.S. PATENT DOCUMENTS

| | | | |
|---|---|---|---|
| 7,648,446 | B2 | 1/2010 | Chiles et al. |
| 7,648,463 | B1 | 1/2010 | Elhag et al. |
| 7,648,858 | B2 | 1/2010 | Tang et al. |
| 7,651,442 | B2 | 1/2010 | Carlson |
| 7,654,229 | B2 | 2/2010 | Smith |
| 7,654,948 | B2 | 2/2010 | Kaplan et al. |
| 7,658,695 | B1 | 2/2010 | Amsbury et al. |
| 7,658,698 | B2 | 2/2010 | Pacheco et al. |
| 7,662,065 | B1 | 2/2010 | Kahn et al. |
| 7,662,282 | B2 | 2/2010 | Lee et al. |
| 7,670,263 | B2 | 3/2010 | Ellis |
| 7,674,205 | B2 | 3/2010 | Dalebout et al. |
| 7,674,206 | B2 | 3/2010 | Jones |
| 7,676,332 | B2 | 3/2010 | Damen |
| 7,677,518 | B2 | 3/2010 | Chouinard et al. |
| 7,677,723 | B2 | 3/2010 | Howell et al. |
| 7,678,023 | B1 | 3/2010 | Shea |
| 7,682,286 | B2 | 3/2010 | Badarneh et al. |
| 7,682,287 | B1 | 3/2010 | Hsieh |
| 7,682,290 | B2 | 3/2010 | Liao et al. |
| 7,682,291 | B2 | 3/2010 | Gill et al. |
| 7,683,252 | B2 | 3/2010 | Oliver et al. |
| 7,689,437 | B1 | 3/2010 | Teller et al. |
| 7,690,556 | B1 | 4/2010 | Kahn et al. |
| 7,695,409 | B2 | 4/2010 | Helie et al. |
| 7,698,101 | B2 | 4/2010 | Alten et al. |
| 7,698,359 | B2 | 4/2010 | Wray et al. |
| 7,699,752 | B1 | 4/2010 | Anderson |
| 7,699,753 | B2 | 4/2010 | Daikeler |
| 7,699,754 | B2 | 4/2010 | Schneider |
| 7,699,755 | B2 | 4/2010 | Feldman et al. |
| 7,702,781 | B2 | 4/2010 | Devolites |
| 7,703,974 | B2 | 4/2010 | Bouille |
| 7,704,191 | B2 | 4/2010 | Smith et al. |
| 7,704,192 | B2 | 4/2010 | Dyer et al. |
| 7,705,230 | B2 | 4/2010 | Bowen |
| 7,708,668 | B2 | 5/2010 | Rodgers, Jr. |
| 7,708,672 | B2 | 5/2010 | Gibson et al. |
| 7,713,171 | B1 | 5/2010 | Hickman |
| 7,713,172 | B2 | 5/2010 | Watterson et al. |
| 7,713,177 | B2 | 5/2010 | Lo |
| 7,717,825 | B2 | 5/2010 | Van Der Hoeven |
| 7,717,826 | B2 | 5/2010 | Cox et al. |
| 7,717,827 | B2 | 5/2010 | Kurunmäki et al. |
| 7,717,828 | B2 | 5/2010 | Simonson et al. |
| 7,717,830 | B1 | 5/2010 | Charniga et al. |
| 7,717,866 | B2 | 5/2010 | Damen |
| 7,722,503 | B1 | 5/2010 | Damen |
| 7,722,509 | B2 | 5/2010 | Eder |
| 7,725,362 | B2 | 5/2010 | Weathers, Jr. |
| 7,727,117 | B2 | 6/2010 | Feldman et al. |
| 7,727,125 | B2 | 6/2010 | Day |
| 7,728,214 | B2 | 6/2010 | Oliver et al. |
| 7,731,634 | B2 | 6/2010 | Stewart et al. |
| 7,736,272 | B2 | 6/2010 | Martens |
| 7,736,273 | B2 | 6/2010 | Cox et al. |
| 7,736,279 | B2 | 6/2010 | Dalebout et al. |
| 7,736,280 | B2 | 6/2010 | Weier et al. |
| 7,736,281 | B2 | 6/2010 | Corbalis et al. |
| 7,739,076 | B1 | 6/2010 | Vock et al. |
| 7,740,562 | B2 | 6/2010 | Jones |
| 7,740,563 | B2 | 6/2010 | Dalebout et al. |
| 7,740,588 | B1 | 6/2010 | Sciarra |
| 7,745,716 | B1 | 6/2010 | Murphy |
| 7,747,671 | B2 | 6/2010 | Ku |
| 7,749,137 | B2 | 7/2010 | Watt et al. |
| 7,753,824 | B2 | 7/2010 | Wang |
| 7,753,825 | B2 | 7/2010 | Jaquish et al. |
| 7,753,830 | B1 | 7/2010 | Marsh et al. |
| 7,753,861 | B1 | 7/2010 | Kahn et al. |
| 7,758,469 | B2 | 7/2010 | Dyer et al. |
| 7,758,523 | B2 | 7/2010 | Collings et al. |
| 7,761,300 | B2 | 7/2010 | Klingler |
| 7,762,931 | B2 | 7/2010 | Fisher et al. |
| 7,762,934 | B1 | 7/2010 | Munson, Jr. et al. |
| 7,762,952 | B2 | 7/2010 | Lee et al. |
| 7,764,990 | B2 | 7/2010 | Martikka et al. |
| 7,765,348 | B2 | 7/2010 | Dybsetter |
| 7,766,794 | B2 | 8/2010 | Oliver et al. |
| 7,766,797 | B2 | 8/2010 | Dalebout |
| 7,766,798 | B2 | 8/2010 | Hamilton |
| 7,770,181 | B2 | 8/2010 | Snover et al. |
| 7,771,319 | B1 | 8/2010 | Lannon |
| 7,771,320 | B2 | 8/2010 | Riley et al. |
| 7,771,325 | B2 | 8/2010 | Baker |
| 7,771,329 | B2 | 8/2010 | Dalebout et al. |
| 7,775,128 | B2 | 8/2010 | Roessingh et al. |
| 7,775,936 | B2 | 8/2010 | Wilkinson |
| 7,775,943 | B2 | 8/2010 | Vittone |
| 7,780,578 | B2 | 8/2010 | Packham |
| 7,789,800 | B1 | 9/2010 | Watterson et al. |
| 7,794,014 | B2 | 9/2010 | Beall et al. |
| 7,794,363 | B2 | 9/2010 | Wang |
| 7,795,824 | B2 | 9/2010 | Shen et al. |
| 7,798,942 | B2 | 9/2010 | Digiulio |
| 7,805,149 | B2 | 9/2010 | Werner et al. |
| 7,806,780 | B1 | 10/2010 | Plunkett |
| 7,806,805 | B2 | 10/2010 | Barufka et al. |
| 7,806,806 | B2 | 10/2010 | Jaquish |
| 7,806,815 | B2 | 10/2010 | Fernandez |
| 7,809,153 | B2 | 10/2010 | Bravomalo et al. |
| 7,811,200 | B2 | 10/2010 | Lai |
| 7,811,201 | B1 | 10/2010 | Mikan et al. |
| 7,811,209 | B2 | 10/2010 | Crawford et al. |
| 7,813,715 | B2 | 10/2010 | McKillop et al. |
| 7,815,549 | B2 | 10/2010 | Crawford et al. |
| 7,815,550 | B2 | 10/2010 | Watterson et al. |
| 7,815,554 | B2 | 10/2010 | Gibson et al. |
| 7,822,547 | B2 | 10/2010 | Lindroos |
| 7,825,319 | B2 | 11/2010 | Turner |
| 7,827,000 | B2 | 11/2010 | Stirling et al. |
| 7,830,570 | B2 | 11/2010 | Morita et al. |
| 7,833,129 | B2 | 11/2010 | Badarneh |
| 7,833,135 | B2 | 11/2010 | Radow |
| 7,837,161 | B2 | 11/2010 | Chase |
| 7,837,595 | B2 | 11/2010 | Rice |
| 7,837,596 | B2 | 11/2010 | Astilean |
| 7,837,599 | B2 | 11/2010 | Kowalczewski et al. |
| 7,839,058 | B1 | 11/2010 | Churchill et al. |
| 7,840,346 | B2 | 11/2010 | Huhtala et al. |
| 7,841,967 | B1 | 11/2010 | Kahn |
| 7,846,067 | B2 | 12/2010 | Hanoun |
| 7,846,070 | B2 | 12/2010 | Oglesby et al. |
| 7,846,080 | B2 | 12/2010 | Boren |
| 7,850,514 | B2 | 12/2010 | Weber |
| 7,854,669 | B2 | 12/2010 | Marty et al. |
| 7,857,731 | B2 | 12/2010 | Hickman et al. |
| 7,857,732 | B2 | 12/2010 | Nielson |
| 7,862,476 | B2 | 1/2011 | Radow |
| 7,862,478 | B2 | 1/2011 | Watterson et al. |
| 7,862,483 | B2 | 1/2011 | Hendrickson et al. |
| 7,867,088 | B2 | 1/2011 | Prum |
| 7,871,355 | B2 | 1/2011 | Yeh |
| 7,871,357 | B2 | 1/2011 | Gibson et al. |
| 7,874,957 | B2 | 1/2011 | Hurwitz et al. |
| 7,878,950 | B1 | 2/2011 | Bastian |
| 7,883,448 | B2 | 2/2011 | Wang |
| 7,887,465 | B2 | 2/2011 | Uffelman |
| 7,892,148 | B1 | 2/2011 | Stauffer et al. |
| 7,892,149 | B2 | 2/2011 | Wu |
| 7,892,150 | B1 | 2/2011 | Colley |
| 7,894,177 | B2 | 2/2011 | Rothkopf |
| 7,894,849 | B2 | 2/2011 | Kass et al. |
| 7,896,782 | B2 | 3/2011 | Tamari |
| 7,901,292 | B1 | 3/2011 | Uhlir et al. |
| 7,901,323 | B2 | 3/2011 | Olason et al. |
| 7,901,325 | B2 | 3/2011 | Henderson |
| 7,908,981 | B2 | 3/2011 | Agee |
| 7,909,741 | B2 | 3/2011 | Kim et al. |
| 7,913,297 | B2 | 3/2011 | Wyld |
| 7,914,420 | B2 | 3/2011 | Daly et al. |
| 7,914,421 | B2 | 3/2011 | Weier et al. |
| 7,914,425 | B2 | 3/2011 | Hanoun |
| 7,914,468 | B2 | 3/2011 | Shalon et al. |

(56) References Cited

U.S. PATENT DOCUMENTS

| | | | |
|---|---|---|---|
| 7,917,148 | B2 | 3/2011 | Rosenberg |
| 7,918,732 | B2 | 4/2011 | Van Noland |
| 7,919,950 | B2 | 4/2011 | Uno et al. |
| 7,922,635 | B2 | 4/2011 | Lull et al. |
| 7,927,253 | B2 | 4/2011 | Vincent |
| 7,927,258 | B2 | 4/2011 | Irving et al. |
| 7,931,563 | B2 | 4/2011 | Shaw et al. |
| 7,934,983 | B1 | 5/2011 | Eisner |
| 7,938,751 | B2 | 5/2011 | Nicolas et al. |
| 7,938,752 | B1 | 5/2011 | Wang |
| 7,938,755 | B1 | 5/2011 | Dyer et al. |
| 7,942,783 | B2 | 5/2011 | Ochi |
| 7,942,788 | B2 | 5/2011 | Wu |
| 7,946,959 | B2 | 5/2011 | Shum et al. |
| 7,946,961 | B2 | 5/2011 | Blum et al. |
| 7,946,968 | B2 | 5/2011 | Kjellberg |
| 7,949,295 | B2 | 5/2011 | Kumar et al. |
| 7,950,297 | B2 | 5/2011 | Moore et al. |
| 7,951,046 | B1 | 5/2011 | Barber, Jr. |
| 7,953,549 | B2 | 5/2011 | Graham et al. |
| 7,955,219 | B2 | 6/2011 | Birrell et al. |
| 7,959,124 | B2 | 6/2011 | Phifer et al. |
| 7,959,567 | B2 | 6/2011 | Stivoric et al. |
| 7,963,889 | B2 | 6/2011 | Badarneh et al. |
| 7,967,728 | B2 | 6/2011 | Zavadsky |
| 7,968,574 | B2 | 6/2011 | Hangauer, Jr. |
| 7,972,245 | B2 | 7/2011 | Temple et al. |
| 7,972,247 | B2 | 7/2011 | Daikeler |
| 7,972,249 | B1 | 7/2011 | Napalan |
| 7,973,231 | B2 | 7/2011 | Bowen |
| 7,974,889 | B2 | 7/2011 | Raimbeault |
| 7,976,437 | B1 | 7/2011 | Von Detten |
| 7,976,518 | B2 | 7/2011 | Shaughnessy et al. |
| 7,978,081 | B2 | 7/2011 | Shears et al. |
| 7,980,996 | B2 | 7/2011 | Hickman |
| 7,981,000 | B2 | 7/2011 | Watterson et al. |
| 7,985,164 | B2 | 7/2011 | Ashby |
| 7,988,598 | B2 | 8/2011 | Trzecieski |
| 7,988,599 | B2 | 8/2011 | Ainsworth et al. |
| 7,988,600 | B2 | 8/2011 | Rodgers, Jr. |
| 8,001,472 | B2 | 8/2011 | Gilley et al. |
| 8,002,671 | B1 | 8/2011 | Vigilia |
| 8,002,674 | B2 | 8/2011 | Piaget et al. |
| 8,002,684 | B2 | 8/2011 | Sarf |
| 8,007,409 | B2 | 8/2011 | Elllis |
| RE42,698 | E | 9/2011 | Kuo et al. |
| 8,012,064 | B2 | 9/2011 | Martens |
| 8,012,067 | B2 | 9/2011 | Joannou |
| 8,012,068 | B1 | 9/2011 | Malcolm |
| 8,012,073 | B2 | 9/2011 | Barnett |
| 8,021,270 | B2 | 9/2011 | Eredita |
| 8,021,277 | B2 | 9/2011 | Baudhuin |
| 8,025,607 | B2 | 9/2011 | Ranky et al. |
| 8,025,612 | B1 | 9/2011 | Buzzanco |
| 8,028,443 | B2 | 10/2011 | Case, Jr. |
| 8,029,415 | B2 | 10/2011 | Ashby et al. |
| 8,033,959 | B2 | 10/2011 | Oleson et al. |
| 8,034,294 | B1 | 10/2011 | Goldberg |
| 8,037,017 | B2 | 10/2011 | Samn |
| 8,038,577 | B2 | 10/2011 | Mcintosh |
| 8,040,758 | B1 | 10/2011 | Dickinson |
| 8,043,173 | B2 | 10/2011 | Menalagha et al. |
| 8,046,803 | B1 | 10/2011 | Lee |
| 8,047,965 | B2 | 11/2011 | Shea |
| 8,047,966 | B2 | 11/2011 | Dorogusker et al. |
| 8,047,970 | B2 | 11/2011 | Nalley |
| 8,052,580 | B2 | 11/2011 | Saalasti et al. |
| 8,052,584 | B2 | 11/2011 | Keiser |
| 8,055,469 | B2 | 11/2011 | Kulach et al. |
| 8,056,687 | B2 | 11/2011 | Golden et al. |
| 8,057,360 | B2 | 11/2011 | Shea |
| 8,057,368 | B1 | 11/2011 | Lyszczarz |
| 8,062,182 | B2 | 11/2011 | Somers |
| 8,062,192 | B1 | 11/2011 | Arstein |
| 8,062,196 | B1 | 11/2011 | Khubani |
| 8,065,185 | B2 | 11/2011 | Foladare et al. |
| 8,066,514 | B2 | 11/2011 | Clarke |
| 8,070,655 | B1 | 12/2011 | Napolitano |
| 8,073,304 | B2 | 12/2011 | Rohlicek |
| 8,075,453 | B1 | 12/2011 | Wilkinson |
| 8,078,426 | B2 | 12/2011 | Pipinich et al. |
| 8,079,939 | B1 | 12/2011 | Wang |
| 8,082,029 | B2 | 12/2011 | Honda |
| 8,083,643 | B2 | 12/2011 | Ng et al. |
| 8,083,693 | B1 | 12/2011 | McKeon et al. |
| 8,086,421 | B2 | 12/2011 | Case, Jr. et al. |
| 8,088,043 | B2 | 1/2012 | Andren et al. |
| 8,088,044 | B2 | 1/2012 | Tchao et al. |
| 8,092,381 | B2 | 1/2012 | Edwards |
| 8,101,843 | B2 | 1/2012 | Turner |
| 8,103,379 | B2 | 1/2012 | Biba et al. |
| 8,103,517 | B2 | 1/2012 | Hinnebusch |
| 8,104,411 | B2 | 1/2012 | Fenton |
| 8,105,207 | B1 | 1/2012 | Lannon |
| 8,105,213 | B2 | 1/2012 | Stewart et al. |
| 8,106,563 | B2 | 1/2012 | Ritchey |
| 8,109,858 | B2 | 2/2012 | Redmann |
| 8,112,281 | B2 | 2/2012 | Yeung et al. |
| 8,113,990 | B2 | 2/2012 | Kolman et al. |
| 8,113,991 | B2 | 2/2012 | Kutliroff |
| 8,113,994 | B2 | 2/2012 | Piaget et al. |
| 8,116,841 | B2 | 2/2012 | Bly et al. |
| 8,121,785 | B2 | 2/2012 | Swisher et al. |
| 8,123,527 | B2 | 2/2012 | Holljes |
| 8,128,533 | B2 | 3/2012 | Nakagawa et al. |
| 8,141,276 | B2 | 3/2012 | Ellis |
| 8,142,298 | B2 | 3/2012 | King et al. |
| 8,142,370 | B2 | 3/2012 | Weinberg et al. |
| 8,147,385 | B2 | 4/2012 | Crawford et al. |
| 8,152,693 | B2 | 4/2012 | Nurmela et al. |
| 8,152,695 | B2 | 4/2012 | Riley et al. |
| 8,157,706 | B2 | 4/2012 | Ainsworth et al. |
| 8,157,731 | B2 | 4/2012 | Teller et al. |
| 8,162,804 | B2 | 4/2012 | Tagliabue |
| 8,162,857 | B2 | 4/2012 | Lanfermann et al. |
| 8,165,893 | B1 | 4/2012 | Goldberg et al. |
| 8,167,776 | B2 | 5/2012 | Lannon |
| 8,172,723 | B1 | 5/2012 | Yanev et al. |
| 8,172,729 | B2 | 5/2012 | Ellis |
| 8,172,882 | B2 | 5/2012 | Klyce et al. |
| 8,176,101 | B2 | 5/2012 | Rosenberg |
| 8,177,688 | B2 | 5/2012 | Burnfield et al. |
| 8,182,399 | B2 | 5/2012 | Davis et al. |
| 8,188,700 | B2 | 5/2012 | Tseng et al. |
| 8,188,868 | B2 | 5/2012 | Case, Jr. |
| 8,192,332 | B2 | 6/2012 | Baker et al. |
| 8,200,323 | B2 | 6/2012 | Dibenedetto et al. |
| 8,213,908 | B2 | 7/2012 | Sangster et al. |
| 8,221,290 | B2 | 7/2012 | Vincent et al. |
| 8,221,292 | B2 | 7/2012 | Barker et al. |
| 8,224,429 | B2 | 7/2012 | Prstojevich et al. |
| 8,225,024 | B2 | 7/2012 | Dybsetter |
| 8,231,506 | B2 | 7/2012 | Molyneux et al. |
| 8,235,724 | B2 | 8/2012 | Gilley et al. |
| 8,240,430 | B2 | 8/2012 | Downey |
| 8,241,118 | B2 | 8/2012 | Camhi |
| 8,241,186 | B2 | 8/2012 | Brodess et al. |
| 8,241,187 | B2 | 8/2012 | Moon et al. |
| 8,249,686 | B2 | 8/2012 | Libbus et al. |
| 8,251,874 | B2 | 8/2012 | Ashby et al. |
| 8,253,586 | B1 | 8/2012 | Matak |
| 8,257,228 | B2 | 9/2012 | Quatrochi et al. |
| 8,260,667 | B2 | 9/2012 | Graham et al. |
| 8,260,858 | B2 | 9/2012 | Belz et al. |
| 8,269,093 | B2 | 9/2012 | Naik et al. |
| 8,272,996 | B2 | 9/2012 | Weier |
| 8,275,143 | B2 | 9/2012 | Johnson |
| 8,275,265 | B2 | 9/2012 | Kobyakov et al. |
| 8,276,434 | B2 | 10/2012 | Senoo |
| 8,280,259 | B2 | 10/2012 | George et al. |
| 8,287,434 | B2 | 10/2012 | Zavadsky et al. |
| 8,296,172 | B2 | 10/2012 | Marci et al. |
| 8,298,123 | B2 | 10/2012 | Hickman |
| 8,306,635 | B2 | 11/2012 | Pryor |

(56) References Cited

U.S. PATENT DOCUMENTS

| | | | |
|---|---|---|---|
| 8,308,794 | B2 | 11/2012 | Martinson et al. |
| 8,314,840 | B1 | 11/2012 | Funk |
| 8,315,823 | B2 | 11/2012 | Berme et al. |
| 8,320,578 | B2 | 11/2012 | Kahn et al. |
| 8,321,004 | B2 | 11/2012 | Moon et al. |
| 8,323,157 | B2 | 12/2012 | Campanaro et al. |
| 8,332,544 | B1 | 12/2012 | Ralls et al. |
| 8,333,681 | B2 | 12/2012 | Schmidt |
| 8,337,335 | B2 | 12/2012 | Dugan |
| 8,341,557 | B2 | 12/2012 | Pisula et al. |
| 8,343,016 | B1 | 1/2013 | Astilean |
| 8,348,840 | B2 | 1/2013 | Heit et al. |
| 8,360,785 | B2 | 1/2013 | Park et al. |
| 8,360,904 | B2 | 1/2013 | Oleson et al. |
| 8,360,935 | B2 | 1/2013 | Olsen et al. |
| 8,360,936 | B2 | 1/2013 | Dibenedetto et al. |
| 8,363,913 | B2 | 1/2013 | Boushey et al. |
| 8,364,250 | B2 | 1/2013 | Moon et al. |
| 8,364,389 | B2 | 1/2013 | Dorogusker et al. |
| 8,368,329 | B1 | 2/2013 | Depew et al. |
| 8,369,936 | B2 | 2/2013 | Farringdon et al. |
| 8,371,990 | B2 | 2/2013 | Shea |
| 8,374,688 | B2 | 2/2013 | Libbus et al. |
| 8,376,910 | B2 | 2/2013 | Cheung et al. |
| 8,378,647 | B2 | 2/2013 | Yonezawa et al. |
| 8,384,551 | B2 | 2/2013 | Ross et al. |
| 8,394,005 | B2 | 3/2013 | Solow et al. |
| 8,395,366 | B2 | 3/2013 | Uno |
| 8,398,546 | B2 | 3/2013 | Pacione et al. |
| 8,403,845 | B2 | 3/2013 | Stivoric et al. |
| 8,407,623 | B2 | 3/2013 | Kerr et al. |
| 8,412,317 | B2 | 4/2013 | Mazar |
| 8,419,593 | B2 | 4/2013 | Ainsworth et al. |
| 8,429,223 | B2 | 4/2013 | Gilley et al. |
| 8,430,770 | B2 | 4/2013 | Dugan |
| 8,435,160 | B1 | 5/2013 | Clum |
| 8,437,824 | B2 | 5/2013 | Moon et al. |
| 8,446,275 | B2 | 5/2013 | Aliphcom |
| 8,449,620 | B2 | 5/2013 | Hakansson et al. |
| 8,452,259 | B2 | 5/2013 | Ellis et al. |
| 8,454,437 | B2 | 6/2013 | Dugan |
| 8,459,479 | B2 | 6/2013 | Yourist |
| 8,460,001 | B1 | 6/2013 | Chuang |
| 8,460,189 | B2 | 6/2013 | Libbus et al. |
| 8,475,338 | B2 | 7/2013 | Greenhill et al. |
| 8,475,346 | B2 | 7/2013 | Gerschefske et al. |
| 8,475,367 | B1 | 7/2013 | Yuen et al. |
| 8,475,370 | B2 | 7/2013 | McCombie et al. |
| 8,480,541 | B1 | 7/2013 | Brunts |
| 8,485,944 | B2 | 7/2013 | Drazan |
| 8,485,945 | B2 | 7/2013 | Leonhard |
| 8,485,982 | B2 | 7/2013 | Gavish et al. |
| 8,485,996 | B2 | 7/2013 | Bluman |
| 8,487,759 | B2 | 7/2013 | Hill |
| 8,491,446 | B2 | 7/2013 | Hinds et al. |
| 8,491,572 | B2 | 7/2013 | Martinson et al. |
| 8,493,822 | B2 | 7/2013 | Lee et al. |
| 8,503,086 | B2 | 8/2013 | French et al. |
| 8,505,597 | B2 | 8/2013 | Sharperson |
| 8,506,370 | B2 | 8/2013 | Homsi |
| 8,506,457 | B2 | 8/2013 | Baudhuin |
| 8,506,458 | B2 | 8/2013 | Dugan |
| 8,512,210 | B2 | 8/2013 | Shauli |
| 8,515,930 | B2 | 8/2013 | Hong |
| 8,516,723 | B2 | 8/2013 | Ferrigan et al. |
| 8,517,896 | B2 | 8/2013 | Robinette et al. |
| 8,517,899 | B2 | 8/2013 | Zhou |
| 8,523,789 | B2 | 9/2013 | Keiser |
| 8,527,038 | B2 | 9/2013 | Moon et al. |
| 8,529,409 | B1 | 9/2013 | Lesea-Ames |
| 8,531,386 | B1 | 9/2013 | Kerr et al. |
| 8,533,007 | B2 | 9/2013 | Egami et al. |
| 8,533,620 | B2 | 9/2013 | Hoffman et al. |
| 8,535,247 | B2 | 9/2013 | Williams |
| 8,538,333 | B2 | 9/2013 | Jain et al. |
| 8,538,723 | B2 | 9/2013 | Chang |
| 8,540,560 | B2 | 9/2013 | Crowley et al. |
| 8,540,641 | B2 | 9/2013 | Kroll et al. |
| 8,543,185 | B2 | 9/2013 | Yuen et al. |
| 8,545,417 | B2 | 10/2013 | Banet et al. |
| 8,550,962 | B2 | 10/2013 | Piaget et al. |
| 8,554,214 | B2 | 10/2013 | Sweeney et al. |
| 8,554,802 | B1 | 10/2013 | Barden et al. |
| 8,556,778 | B1 | 10/2013 | Dugan |
| 8,560,951 | B1 | 10/2013 | Snyder et al. |
| 8,562,489 | B2 | 10/2013 | Burton et al. |
| 8,568,278 | B2 | 10/2013 | Riley et al. |
| 8,571,880 | B2 | 10/2013 | Goldberg |
| 8,572,576 | B2 | 10/2013 | Elvanoglu et al. |
| 8,573,982 | B1 | 11/2013 | Chuang |
| 8,579,767 | B2 | 11/2013 | Ellis et al. |
| 8,591,411 | B2 | 11/2013 | Banet et al. |
| 8,594,772 | B2 | 11/2013 | Eggenberger et al. |
| RE44,650 | E | 12/2013 | Anderson et al. |
| 8,597,093 | B2 | 12/2013 | Engelberg et al. |
| 8,602,951 | B2 | 12/2013 | Morris |
| 8,602,997 | B2 | 12/2013 | Banet et al. |
| 8,605,048 | B2 | 12/2013 | Ye et al. |
| 8,608,624 | B2 | 12/2013 | Shabodyash et al. |
| 8,610,593 | B2 | 12/2013 | Van Acht et al. |
| 8,613,689 | B2 | 12/2013 | Dyer et al. |
| 8,614,595 | B2 | 12/2013 | Acatrinei |
| 8,614,902 | B2 | 12/2013 | Pansier et al. |
| 8,617,008 | B2 | 12/2013 | Marty et al. |
| 8,622,873 | B2 | 1/2014 | Mcgown |
| 8,628,333 | B2 | 1/2014 | Prinzel, III et al. |
| 8,628,453 | B2 | 1/2014 | Balakrishnan et al. |
| 8,639,020 | B1 | 1/2014 | Kutliroff et al. |
| 8,647,240 | B2 | 2/2014 | Heidecke |
| 8,649,890 | B2 | 2/2014 | Martin |
| 8,652,010 | B2 | 2/2014 | Ellis et al. |
| 8,654,198 | B2 | 2/2014 | Pryor |
| 8,655,004 | B2 | 2/2014 | Prest et al. |
| 8,657,724 | B2 | 2/2014 | Yang |
| 8,662,901 | B2 | 3/2014 | Tzao et al. |
| 8,663,106 | B2 | 3/2014 | Stivoric et al. |
| 8,667,194 | B2 | 3/2014 | Dybsetter et al. |
| 8,670,222 | B2 | 3/2014 | Rothkopf |
| 8,672,852 | B2 | 3/2014 | Gavish |
| 8,676,170 | B2 | 3/2014 | Porrati et al. |
| 8,676,541 | B2 | 3/2014 | Schrock et al. |
| 8,678,979 | B2 | 3/2014 | Stark et al. |
| 8,684,925 | B2 | 4/2014 | Manicka et al. |
| 8,690,578 | B1 | 4/2014 | Nusbaum et al. |
| 8,690,735 | B2 | 4/2014 | Watterson et al. |
| 8,690,738 | B1 | 4/2014 | Astilian |
| 8,701,567 | B1 | 4/2014 | Esfandiari et al. |
| 8,702,430 | B2 | 4/2014 | Dibenedetto et al. |
| 8,702,567 | B2 | 4/2014 | Hu |
| 8,704,068 | B2 | 4/2014 | Bowen |
| 8,706,530 | B2 | 4/2014 | Ohnemus et al. |
| 8,708,842 | B2 | 4/2014 | Ganuza |
| 8,708,870 | B2 | 4/2014 | Nalley |
| 8,712,510 | B2 | 4/2014 | Quy |
| 8,718,752 | B2 | 5/2014 | Libbus et al. |
| 8,719,202 | B1 | 5/2014 | Maeng |
| 8,727,947 | B2 | 5/2014 | Tagliabue |
| 8,734,157 | B1 | 5/2014 | Hummel, III |
| 8,734,296 | B1 | 5/2014 | Brumback et al. |
| 8,734,301 | B2 | 5/2014 | Remelius |
| 8,734,302 | B2 | 5/2014 | Hsieh |
| 8,738,732 | B2 | 5/2014 | Karidi |
| 8,740,751 | B2 | 6/2014 | Shum |
| 8,740,756 | B2 | 6/2014 | Stretch |
| 8,740,802 | B2 | 6/2014 | Banet et al. |
| 8,740,807 | B2 | 6/2014 | Banet et al. |
| 8,744,803 | B2 | 6/2014 | Park et al. |
| 8,745,104 | B1 | 6/2014 | Rosenberg |
| 8,745,496 | B2 | 6/2014 | Gilley et al. |
| 8,747,330 | B2 | 6/2014 | Banet et al. |
| 8,749,380 | B2 | 6/2014 | Vock et al. |
| 8,758,201 | B2 | 6/2014 | Ashby et al. |
| 8,762,101 | B2 | 6/2014 | Yuen et al. |
| 8,762,167 | B2 | 6/2014 | Blander et al. |

(56) References Cited

U.S. PATENT DOCUMENTS

| | | | |
|---|---|---|---|
| 8,762,313 | B2 | 6/2014 | Lahav et al. |
| 8,764,609 | B1 | 7/2014 | Elahmadie |
| 8,764,651 | B2 | 7/2014 | Tran |
| 8,768,769 | B2 | 7/2014 | Foladare et al. |
| 8,770,742 | B2 | 7/2014 | Howell et al. |
| 8,771,206 | B2 | 7/2014 | Gettelman et al. |
| 8,775,454 | B2 | 7/2014 | Geer |
| 8,776,264 | B2 | 7/2014 | Kiernan |
| 8,777,815 | B2 | 7/2014 | Case, Jr. et al. |
| 8,777,820 | B2 | 7/2014 | Lo |
| 8,781,568 | B2 | 7/2014 | Dugan |
| 8,783,326 | B1 | 7/2014 | Vaninger et al. |
| 8,784,271 | B2 | 7/2014 | Brumback et al. |
| 8,784,273 | B2 | 7/2014 | Dugan |
| 8,784,274 | B1 | 7/2014 | Chuang |
| 8,790,220 | B2 | 7/2014 | Karvonen |
| 8,790,222 | B2 | 7/2014 | Burger |
| 8,790,259 | B2 | 7/2014 | Katra et al. |
| 8,795,138 | B1 | 8/2014 | Yeh et al. |
| 8,799,200 | B2 | 8/2014 | Lahav |
| 8,801,581 | B2 | 8/2014 | Lai et al. |
| 8,805,844 | B2 | 8/2014 | Schorzman et al. |
| 8,805,941 | B2 | 8/2014 | Barak et al. |
| 8,814,754 | B2 | 8/2014 | Weast et al. |
| 8,821,350 | B2 | 9/2014 | Maertz |
| 8,821,351 | B2 | 9/2014 | Abuelsaad et al. |
| 8,824,697 | B2 | 9/2014 | Christoph |
| 8,825,445 | B2 | 9/2014 | Hoffman et al. |
| 8,827,870 | B2 | 9/2014 | Dyer et al. |
| 8,831,407 | B2 | 9/2014 | Meschter et al. |
| 8,831,538 | B2 | 9/2014 | Yuen |
| 8,838,471 | B1 | 9/2014 | Shum et al. |
| 8,845,497 | B2 | 9/2014 | Turner |
| 8,847,988 | B2 | 9/2014 | Geisner et al. |
| 8,851,565 | B2 | 10/2014 | Hontz et al. |
| 8,861,860 | B2 | 10/2014 | Gupta |
| 8,864,587 | B2 | 10/2014 | Framel et al. |
| 8,864,627 | B2 | 10/2014 | Bayerlein et al. |
| 8,868,448 | B2 | 10/2014 | Freishtat et al. |
| 8,870,791 | B2 | 10/2014 | Sabatino |
| 8,876,661 | B2 | 11/2014 | Lu |
| 8,882,637 | B2 | 11/2014 | Ainsworth et al. |
| 8,882,666 | B1 | 11/2014 | Goldberg et al. |
| 8,888,583 | B2 | 11/2014 | Dugan et al. |
| 8,888,660 | B1 | 11/2014 | Oteman |
| 8,888,700 | B2 | 11/2014 | Banet et al. |
| 8,894,551 | B2 | 11/2014 | Kerdjoudj |
| 8,897,868 | B2 | 11/2014 | Mazar et al. |
| 8,900,099 | B1 | 12/2014 | Boyette |
| 8,902,714 | B2 | 12/2014 | Gossweiler, III et al. |
| 8,903,671 | B2 | 12/2014 | Park et al. |
| 8,908,894 | B2 | 12/2014 | Amento et al. |
| 8,915,823 | B2 | 12/2014 | McKirdy et al. |
| 8,918,465 | B2 | 12/2014 | Barak |
| 8,918,543 | B2 | 12/2014 | Karstens |
| 8,920,291 | B2 | 12/2014 | Chen et al. |
| 8,920,332 | B2 | 12/2014 | Hong et al. |
| 8,920,343 | B2 | 12/2014 | Sabatino |
| 8,926,475 | B2 | 1/2015 | Lin et al. |
| 8,926,479 | B2 | 1/2015 | Chen et al. |
| 8,939,831 | B2 | 1/2015 | Dugan |
| 8,943,002 | B2 | 1/2015 | Zelenko et al. |
| 8,944,958 | B1 | 2/2015 | Brumback et al. |
| 8,944,968 | B2 | 2/2015 | Baudhuin |
| 8,945,328 | B2 | 2/2015 | Longinotti-Buitoni et al. |
| 8,947,226 | B2 | 2/2015 | Dugan |
| 8,951,106 | B2 | 2/2015 | Cowley |
| 8,951,164 | B2 | 2/2015 | Morris et al. |
| 8,951,168 | B2 | 2/2015 | Baudhuin |
| 8,954,135 | B2 | 2/2015 | Yuen et al. |
| 8,954,290 | B2 | 2/2015 | Yuen et al. |
| 8,956,268 | B2 | 2/2015 | Huang et al. |
| 8,956,290 | B2 | 2/2015 | Gilley et al. |
| 8,956,303 | B2 | 2/2015 | Hong et al. |
| 8,956,715 | B2 | 2/2015 | Kim |
| 8,958,631 | B2 | 2/2015 | Kutliroff et al. |
| 8,961,371 | B2 | 2/2015 | Sultan et al. |
| 8,961,413 | B2 | 2/2015 | Teller et al. |
| 8,961,414 | B2 | 2/2015 | Teller et al. |
| 8,965,348 | B1 | 2/2015 | Cronin |
| 8,965,498 | B2 | 2/2015 | Katra et al. |
| 8,965,541 | B2 | 2/2015 | Martinez et al. |
| 8,965,732 | B2 | 2/2015 | Robinette et al. |
| 8,968,161 | B2 | 3/2015 | Shapiro et al. |
| 8,968,163 | B1 | 3/2015 | Vidmar |
| 8,972,199 | B2 | 3/2015 | Liang |
| 8,976,007 | B2 | 3/2015 | Dugan |
| 8,977,194 | B2 | 3/2015 | Jain et al. |
| 8,979,709 | B2 | 3/2015 | Toback et al. |
| 8,979,765 | B2 | 3/2015 | Banet et al. |
| 8,986,165 | B2 | 3/2015 | Ashby |
| 8,992,383 | B2 | 3/2015 | Bilang |
| 8,992,387 | B2 | 3/2015 | Watterson et al. |
| 9,005,085 | B2 | 4/2015 | Astilean |
| 9,005,129 | B2 | 4/2015 | Venkatraman et al. |
| 9,011,291 | B2 | 4/2015 | Birrell |
| 9,011,292 | B2 | 4/2015 | Weast et al. |
| 9,011,293 | B2 | 4/2015 | Shavit et al. |
| 9,011,301 | B2 | 4/2015 | Balandis et al. |
| 9,015,952 | B2 | 4/2015 | Magosaki |
| 9,017,230 | B1 | 4/2015 | Pitts |
| 9,026,927 | B2 | 5/2015 | Brumback et al. |
| 9,028,368 | B2 | 5/2015 | Ashby et al. |
| 9,028,441 | B2 | 5/2015 | Kuhn |
| 9,031,812 | B2 | 5/2015 | Roberts et al. |
| 9,037,578 | B2 | 5/2015 | Brust et al. |
| 9,038,218 | B1 | 5/2015 | Heil et al. |
| 9,039,578 | B2 | 5/2015 | Dalebout |
| 9,039,581 | B2 | 5/2015 | Chia et al. |
| 9,039,614 | B2 | 5/2015 | Yuen et al. |
| 9,042,596 | B2 | 5/2015 | Connor |
| 9,050,491 | B2 | 6/2015 | Gordon et al. |
| 9,050,498 | B2 | 6/2015 | Lu et al. |
| 9,052,798 | B1 | 6/2015 | Klassen et al. |
| 9,055,868 | B2 | 6/2015 | Islam |
| 9,064,342 | B2 | 6/2015 | Yuen et al. |
| 9,069,380 | B2 | 6/2015 | Rahman et al. |
| 9,072,930 | B2 | 7/2015 | Ashby et al. |
| 9,072,932 | B2 | 7/2015 | Piaget et al. |
| 9,083,826 | B2 | 7/2015 | Lu et al. |
| 9,084,912 | B2 | 7/2015 | Jaquish et al. |
| 9,089,732 | B2 | 7/2015 | Andon et al. |
| 9,089,733 | B2 | 7/2015 | Fisbein et al. |
| 9,095,740 | B2 | 8/2015 | Wu |
| 9,107,586 | B2 | 8/2015 | Tran |
| 9,108,079 | B2 | 8/2015 | Solow et al. |
| 9,114,275 | B2 | 8/2015 | Lu et al. |
| 9,114,276 | B2 | 8/2015 | Bayerlein et al. |
| 9,119,983 | B2 | 9/2015 | Rhea |
| 9,123,317 | B2 | 9/2015 | Watterson et al. |
| 9,123,380 | B2 | 9/2015 | Holtz et al. |
| 9,128,981 | B1 | 9/2015 | Geer |
| 9,132,051 | B2 | 9/2015 | Heil |
| 9,135,347 | B2 | 9/2015 | Damman et al. |
| 9,137,309 | B2 | 9/2015 | Ananny et al. |
| 9,138,614 | B2 | 9/2015 | Lu et al. |
| 9,138,615 | B2 | 9/2015 | Olson et al. |
| 9,141,087 | B2 | 9/2015 | Brown et al. |
| 9,143,881 | B2 | 9/2015 | Fan et al. |
| 9,144,703 | B2 | 9/2015 | Dalebout et al. |
| 9,144,709 | B2 | 9/2015 | Reich |
| 9,146,147 | B1 | 9/2015 | Bakhsh |
| 9,162,102 | B1 | 10/2015 | Eder et al. |
| 9,162,106 | B1 | 10/2015 | Scheiman |
| 9,162,142 | B2 | 10/2015 | Shum et al. |
| 9,168,001 | B2 | 10/2015 | Stivoric et al. |
| 9,168,414 | B2 | 10/2015 | Liu et al. |
| 9,173,593 | B2 | 11/2015 | Banet et al. |
| 9,173,594 | B2 | 11/2015 | Banet et al. |
| 9,174,084 | B2 | 11/2015 | Morris et al. |
| 9,174,085 | B2 | 11/2015 | Foley |
| 9,178,635 | B2 | 11/2015 | Ben-Shlomo |
| 9,183,498 | B2 | 11/2015 | Landers |
| 9,186,537 | B2 | 11/2015 | Arnold et al. |

(56) References Cited

U.S. PATENT DOCUMENTS

| | | | |
|---|---|---|---|
| 9,186,549 | B2 | 11/2015 | Watterson et al. |
| 9,186,552 | B1 | 11/2015 | Deal |
| 9,189,021 | B2 | 11/2015 | Jerauld |
| 9,192,800 | B1 | 11/2015 | Meyer et al. |
| 9,192,816 | B2 | 11/2015 | Molyneux et al. |
| 9,199,115 | B2 | 12/2015 | Yim et al. |
| 9,199,123 | B2 | 12/2015 | Solow |
| 9,201,405 | B2 | 12/2015 | Clarkson et al. |
| 9,201,458 | B2 | 12/2015 | Hunt et al. |
| 9,205,301 | B2 | 12/2015 | Cohen |
| 9,208,764 | B2 | 12/2015 | Ghosh et al. |
| 9,211,440 | B2 | 12/2015 | Lagree |
| 9,213,803 | B2 | 12/2015 | Rolley |
| 9,220,940 | B2 | 12/2015 | Al Kuwari |
| 9,221,545 | B2 | 12/2015 | Popescu et al. |
| 9,223,936 | B2 | 12/2015 | Aragones et al. |
| 9,224,291 | B2 | 12/2015 | Moll-Carrillo et al. |
| 9,226,692 | B2 | 1/2016 | Haas |
| 9,229,476 | B2 | 1/2016 | Yanev et al. |
| 9,230,064 | B2 | 1/2016 | Yanev et al. |
| 9,233,269 | B2 | 1/2016 | Lannon |
| 9,241,635 | B2 | 1/2016 | Yuen et al. |
| 9,242,142 | B2 | 1/2016 | Vincent et al. |
| 9,245,428 | B2 | 1/2016 | Weddle et al. |
| 9,247,543 | B2 | 1/2016 | Berlin et al. |
| 9,253,168 | B2 | 2/2016 | Panther |
| 9,254,099 | B2 | 2/2016 | Connor |
| 9,256,910 | B2 | 2/2016 | Goldberg |
| 9,257,054 | B2 | 2/2016 | Coza et al. |
| 9,258,670 | B2 | 2/2016 | Goyal et al. |
| 9,259,633 | B2 | 2/2016 | Meyers |
| 9,262,064 | B2 | 2/2016 | Yanev et al. |
| 9,269,119 | B2 | 2/2016 | Warner |
| 9,272,183 | B2 | 3/2016 | Quy |
| 9,272,186 | B2 | 3/2016 | Reich |
| 9,275,617 | B2 | 3/2016 | Regnier |
| 9,279,734 | B2 | 3/2016 | Walker |
| 9,283,429 | B2 | 3/2016 | Aragones et al. |
| 9,288,298 | B2 | 3/2016 | Choudhary et al. |
| 9,289,063 | B2 | 3/2016 | Baugh et al. |
| 9,295,422 | B2 | 3/2016 | Tai |
| 9,295,894 | B2 | 3/2016 | Papadopolous |
| 9,305,141 | B2 | 4/2016 | Fabrizio |
| 9,308,415 | B2 | 4/2016 | Crawford et al. |
| 9,311,802 | B1 | 4/2016 | Chin et al. |
| 9,317,662 | B2 | 4/2016 | Bangera et al. |
| 9,318,030 | B2 | 4/2016 | Harris et al. |
| 9,329,053 | B2 | 5/2016 | Lakovic et al. |
| 9,332,363 | B2 | 5/2016 | Jain et al. |
| 9,333,388 | B2 | 5/2016 | Lee et al. |
| 9,339,209 | B2 | 5/2016 | Banet et al. |
| 9,339,681 | B1 | 5/2016 | Nalley |
| 9,339,683 | B2 | 5/2016 | Dilli et al. |
| 9,339,691 | B2 | 5/2016 | Brammer |
| 9,339,692 | B2 | 5/2016 | Hashish |
| 9,345,947 | B2 | 5/2016 | Harris et al. |
| 9,349,280 | B2 | 5/2016 | Baldwin et al. |
| 9,350,598 | B2 | 5/2016 | Barak et al. |
| 9,352,185 | B2 | 5/2016 | Hendrickson et al. |
| 9,352,186 | B2 | 5/2016 | Watterson |
| 9,352,187 | B2 | 5/2016 | Piaget et al. |
| 9,357,551 | B2 | 5/2016 | Gutman |
| 9,357,921 | B2 | 6/2016 | Chang et al. |
| 9,358,422 | B2 | 6/2016 | Brontman |
| 9,358,426 | B2 | 6/2016 | Aragones et al. |
| 9,364,158 | B2 | 6/2016 | Banet et al. |
| 9,364,706 | B2 | 6/2016 | Lo |
| 9,364,708 | B2 | 6/2016 | Luger et al. |
| 9,364,714 | B2 | 6/2016 | Koduri et al. |
| 9,367,668 | B2 | 6/2016 | Shankle et al. |
| 9,370,679 | B2 | 6/2016 | Lagree et al. |
| 9,370,687 | B2 | 6/2016 | Hao |
| 9,374,279 | B2 | 6/2016 | Yuen et al. |
| 9,375,629 | B2 | 6/2016 | Schieffer et al. |
| 9,377,314 | B2 | 6/2016 | Tseng et al. |
| 9,378,336 | B2 | 6/2016 | Ohnemus et al. |
| 9,381,420 | B2 | 7/2016 | Burroughs |
| 9,381,445 | B2 | 7/2016 | Ventura et al. |
| 9,385,810 | B2 | 7/2016 | Hazani |
| 9,387,387 | B2 | 7/2016 | Dalebout |
| 9,389,057 | B2 | 7/2016 | Meschter et al. |
| 9,389,718 | B1 | 7/2016 | Letourneur |
| 9,389,754 | B2 | 7/2016 | Reese et al. |
| 9,390,229 | B1 | 7/2016 | Kahn et al. |
| 9,392,941 | B2 | 7/2016 | Powch et al. |
| 9,395,754 | B2 | 7/2016 | Cronin |
| 9,401,078 | B2 | 7/2016 | Barrett |
| 9,403,048 | B2 | 8/2016 | Balandis et al. |
| 9,403,053 | B2 | 8/2016 | Kaiser et al. |
| 9,405,892 | B2 | 8/2016 | Baldwin et al. |
| 9,409,050 | B2 | 8/2016 | Mintz |
| 9,409,052 | B2 | 8/2016 | Werner |
| 9,411,936 | B2 | 8/2016 | Landrum et al. |
| 9,411,940 | B2 | 8/2016 | Burroughs et al. |
| 9,415,257 | B2 | 8/2016 | Habing |
| 9,420,083 | B2 | 8/2016 | Roberts et al. |
| 9,420,542 | B2 | 8/2016 | Henia |
| 9,421,422 | B2 | 8/2016 | Yuen et al. |
| 9,421,448 | B2 | 8/2016 | Tropper et al. |
| 9,422,018 | B2 | 8/2016 | Pelot et al. |
| 9,430,043 | B1 | 8/2016 | Amento et al. |
| 9,430,920 | B2 | 8/2016 | Munro et al. |
| 9,439,574 | B2 | 9/2016 | McCombie et al. |
| 9,440,134 | B2 | 9/2016 | Nicora |
| 9,442,100 | B2 | 9/2016 | Connor |
| 9,446,288 | B1 | 9/2016 | Pazan |
| 9,451,897 | B2 | 9/2016 | Mazar et al. |
| 9,452,315 | B1 | 9/2016 | Murray et al. |
| 9,452,320 | B2 | 9/2016 | Yang |
| 9,455,784 | B2 | 9/2016 | Cune et al. |
| 9,457,224 | B2 | 10/2016 | Giannelli et al. |
| 9,457,256 | B2 | 10/2016 | Aragones et al. |
| 9,460,421 | B2 | 10/2016 | Lai et al. |
| 9,462,844 | B2 | 10/2016 | Schrock et al. |
| 9,463,349 | B1 | 10/2016 | Chang |
| 9,463,572 | B2 | 10/2016 | Parente |
| 9,468,382 | B2 | 10/2016 | Hanoun |
| 9,468,793 | B2 | 10/2016 | Salmon |
| 9,468,794 | B2 | 10/2016 | Barton |
| 9,473,593 | B2 | 10/2016 | Wallace |
| 9,474,925 | B1 | 10/2016 | Hsiung |
| 9,474,935 | B2 | 10/2016 | Abbondanza et al. |
| 9,477,303 | B2 | 10/2016 | Fleischmann et al. |
| 9,480,874 | B2 | 11/2016 | Cutler |
| 9,486,070 | B2 | 11/2016 | Labrosse et al. |
| 9,486,382 | B1 | 11/2016 | Boss |
| 9,486,658 | B2 | 11/2016 | Alexander |
| 9,491,562 | B2 | 11/2016 | Cronin |
| 9,495,015 | B1 | 11/2016 | Kahn et al. |
| 9,495,860 | B2 | 11/2016 | Lett |
| 9,498,066 | B2 | 11/2016 | Christianson et al. |
| 9,498,671 | B1 | 11/2016 | Softky |
| 9,498,704 | B1 | 11/2016 | Cohen et al. |
| 9,500,464 | B2 | 11/2016 | Coza |
| 9,504,414 | B2 | 11/2016 | Coza et al. |
| 9,505,241 | B2 | 11/2016 | Lyon |
| 9,509,269 | B1 | 11/2016 | Rosenberg |
| 9,511,259 | B2 | 12/2016 | Mountain |
| 9,517,378 | B2 | 12/2016 | Ashby et al. |
| 9,517,406 | B2 | 12/2016 | Shum et al. |
| 9,529,385 | B2 | 12/2016 | Connor |
| 9,529,437 | B2 | 12/2016 | Kahn et al. |
| 9,532,002 | B2 | 12/2016 | Glass et al. |
| 9,532,734 | B2 | 1/2017 | Hoffman et al. |
| 9,533,228 | B2 | 1/2017 | Dugan |
| 9,535,505 | B2 | 1/2017 | Erkkila et al. |
| 9,536,449 | B2 | 1/2017 | Connor |
| 9,539,458 | B1 | 1/2017 | Ross |
| 9,540,071 | B2 | 1/2017 | Jordan et al. |
| 9,540,174 | B2 | 1/2017 | Josserond et al. |
| 9,545,535 | B2 | 1/2017 | Lagree |
| 9,545,541 | B2 | 1/2017 | Aragones et al. |
| 9,549,585 | B2 | 1/2017 | Amos et al. |
| 9,560,917 | B2 | 2/2017 | Roslund, Jr. |

(56) References Cited

U.S. PATENT DOCUMENTS

| | | | |
|---|---|---|---|
| 9,563,336 | B2 | 2/2017 | Barak et al. |
| 9,563,700 | B2 | 2/2017 | Garmark et al. |
| 9,573,017 | B2 | 2/2017 | Chang |
| 9,579,534 | B2 | 2/2017 | Sutkowski et al. |
| 9,579,544 | B2 | 2/2017 | Watterson |
| 9,582,071 | B2 | 2/2017 | Baldwin et al. |
| 9,582,976 | B2 | 2/2017 | Chin et al. |
| 9,585,563 | B2 | 3/2017 | Mensinger et al. |
| 9,586,090 | B2 | 3/2017 | Watterson et al. |
| 9,589,482 | B2 | 3/2017 | Baldwin et al. |
| 9,594,433 | B2 | 3/2017 | Baldwin et al. |
| 9,597,540 | B2 | 3/2017 | Arnold |
| 9,599,981 | B2 | 3/2017 | Crabtree |
| 9,600,079 | B2 | 3/2017 | Baldwin et al. |
| 9,602,210 | B2 | 3/2017 | Berlin et al. |
| 9,604,096 | B2 | 3/2017 | Arnold et al. |
| 9,604,099 | B2 | 3/2017 | Taylor |
| 9,610,475 | B1 | 4/2017 | DeKnock et al. |
| 9,610,506 | B2 | 4/2017 | Dugan |
| 9,615,215 | B2 | 4/2017 | Yuen et al. |
| 9,615,785 | B2 | 4/2017 | Rocker et al. |
| 9,616,281 | B2 | 4/2017 | Hsiung |
| 9,621,959 | B2 | 4/2017 | Mountain |
| 9,622,537 | B2 | 4/2017 | Amos et al. |
| 9,623,286 | B1 | 4/2017 | Chen |
| 9,628,286 | B1 | 4/2017 | Nguyen et al. |
| 9,632,746 | B2 | 4/2017 | Keipert et al. |
| 9,636,543 | B2 | 5/2017 | Dyer et al. |
| 9,636,567 | B2 | 5/2017 | Brammer et al. |
| 9,642,764 | B2 | 5/2017 | Kuehne et al. |
| 9,646,137 | B2 | 5/2017 | Gilley et al. |
| 9,646,481 | B2 | 5/2017 | Messenger et al. |
| 9,647,758 | B2 | 5/2017 | Hazani |
| 9,655,053 | B2 | 5/2017 | Park et al. |
| 9,658,066 | B2 | 5/2017 | Yuen et al. |
| 9,661,355 | B2 | 5/2017 | Ho |
| 9,661,781 | B2 | 5/2017 | Anolik et al. |
| 9,669,261 | B2 | 6/2017 | Eder |
| 9,672,196 | B2 | 6/2017 | Shachar et al. |
| 9,672,754 | B2 | 6/2017 | Yuen et al. |
| 9,673,904 | B2 | 6/2017 | Palanisamy et al. |
| 9,678,626 | B2 | 6/2017 | Whang |
| 9,681,313 | B2 | 6/2017 | Malach |
| 9,682,306 | B2 | 6/2017 | Lin et al. |
| 9,687,689 | B2 | 6/2017 | Lin |
| 9,692,844 | B2 | 6/2017 | Messenger et al. |
| RE46,481 | E | 7/2017 | Sako et al. |
| 9,694,234 | B2 | 7/2017 | Dalebout et al. |
| 9,694,247 | B2 | 7/2017 | Nurnberg |
| 9,697,740 | B2 | 7/2017 | Zhang et al. |
| 9,700,780 | B2 | 7/2017 | Riley et al. |
| 9,700,802 | B2 | 7/2017 | Dugan |
| 9,701,530 | B2 | 7/2017 | Kline |
| 9,707,441 | B2 | 7/2017 | Yang |
| 9,707,447 | B1 | 7/2017 | Lopez Babodilla |
| 9,710,711 | B2 | 7/2017 | Dibenedetto et al. |
| 9,712,629 | B2 | 7/2017 | Molettiere et al. |
| 9,713,739 | B2 | 7/2017 | Dalmia |
| 9,715,774 | B2 | 7/2017 | Baldwin et al. |
| 9,719,797 | B2 | 8/2017 | Fino et al. |
| 9,720,443 | B2 | 8/2017 | Malhotra |
| 9,723,393 | B2 | 8/2017 | Nguyen et al. |
| 9,724,563 | B2 | 8/2017 | Schmidt |
| 9,724,589 | B2 | 8/2017 | Baudhuin |
| 9,728,059 | B2 | 8/2017 | Arnold et al. |
| 9,729,921 | B2 | 8/2017 | Kim et al. |
| 9,729,989 | B2 | 8/2017 | Marten |
| 9,730,025 | B2 | 8/2017 | Yuen et al. |
| 9,730,228 | B2 | 8/2017 | Harel |
| 9,730,619 | B2 | 8/2017 | Messenger et al. |
| 9,731,158 | B1 | 8/2017 | Lo |
| 9,734,184 | B1 | 8/2017 | Lagace et al. |
| 9,737,261 | B2 | 8/2017 | Coza et al. |
| 9,737,747 | B1 | 8/2017 | Walsh et al. |
| 9,743,861 | B2 | 8/2017 | Giedwoyn et al. |
| 9,756,895 | B2 | 9/2017 | Rice et al. |
| 9,757,605 | B2 | 9/2017 | Olson et al. |
| 9,757,611 | B1 | 9/2017 | Colburn |
| 9,763,581 | B2 | 9/2017 | Bonutti et al. |
| 9,764,184 | B2 | 9/2017 | Kueker et al. |
| 9,767,212 | B2 | 9/2017 | Lavi et al. |
| 9,769,522 | B2 | 9/2017 | Richardson |
| 9,772,612 | B2 | 9/2017 | McCarthy, III et al. |
| 9,775,123 | B2 | 9/2017 | Harel |
| 9,776,039 | B1 | 10/2017 | Xu |
| 9,776,042 | B2 | 10/2017 | Prokhorov |
| 9,778,280 | B2 | 10/2017 | Yuen et al. |
| 9,782,125 | B2 | 10/2017 | Berner, Jr. et al. |
| 9,782,625 | B1 | 10/2017 | Blum et al. |
| 9,789,362 | B1 | 10/2017 | Su et al. |
| 9,792,361 | B1 | 10/2017 | Geer |
| 9,795,827 | B2 | 10/2017 | Wiener et al. |
| 9,795,828 | B2 | 10/2017 | Andrade |
| 9,797,920 | B2 | 10/2017 | Kahn et al. |
| 9,798,309 | B2 | 10/2017 | Tirpak |
| 9,801,547 | B2 | 10/2017 | Yuen et al. |
| 9,802,081 | B2 | 10/2017 | Ridgel et al. |
| 9,808,202 | B2 | 11/2017 | Wu et al. |
| 9,808,673 | B2 | 11/2017 | Robinson |
| 9,811,639 | B2 | 11/2017 | Aragones et al. |
| 9,814,920 | B1 | 11/2017 | Monterrey |
| 9,814,927 | B2 | 11/2017 | Forystek |
| 9,814,928 | B2 | 11/2017 | Taylor |
| 9,814,929 | B2 | 11/2017 | Moser |
| 9,814,930 | B2 | 11/2017 | Manzke et al. |
| 9,818,285 | B2 | 11/2017 | Clarke et al. |
| 9,819,561 | B2 | 11/2017 | Freishtat et al. |
| 9,819,754 | B2 | 11/2017 | Park et al. |
| 9,821,191 | B2 | 11/2017 | Abbondanza |
| 9,821,212 | B2 | 11/2017 | Kolman et al. |
| 9,824,110 | B2 | 11/2017 | Giudici et al. |
| 9,824,578 | B2 | 11/2017 | Burton et al. |
| 9,827,458 | B2 | 11/2017 | Dalton |
| 9,829,068 | B2 | 11/2017 | Marchetti |
| 9,829,327 | B2 | 11/2017 | Nagy et al. |
| 9,833,141 | B2 | 12/2017 | Kampman et al. |
| 9,833,658 | B2 | 12/2017 | Wiener et al. |
| 9,838,736 | B2 | 12/2017 | Smith et al. |
| 9,841,077 | B2 | 12/2017 | Modrezejewski et al. |
| 9,849,330 | B2 | 12/2017 | Lagree |
| 9,849,333 | B2 | 12/2017 | Fung |
| 9,849,361 | B2 | 12/2017 | Coza et al. |
| 9,852,271 | B2 | 12/2017 | Aragones et al. |
| 9,858,307 | B2 | 1/2018 | Sultan |
| 9,861,300 | B2 | 1/2018 | Gettelman et al. |
| 9,864,844 | B2 | 1/2018 | Durham et al. |
| 9,866,596 | B2 | 1/2018 | Das et al. |
| 9,880,805 | B1 | 1/2018 | Guralnick |
| 9,881,326 | B2 | 1/2018 | Gilley et al. |
| 9,882,736 | B2 | 1/2018 | Lett |
| 9,882,992 | B2 | 1/2018 | Baldwin et al. |
| 9,886,309 | B2 | 2/2018 | Pfannenberg |
| 9,886,871 | B1 | 2/2018 | Rauhala et al. |
| 9,889,334 | B2 | 2/2018 | Ashby et al. |
| 9,892,417 | B2 | 2/2018 | Shachar et al. |
| 9,901,767 | B2 | 2/2018 | Kuo |
| 9,901,772 | B2 | 2/2018 | Crowley et al. |
| 9,901,780 | B2 | 2/2018 | DeLuca et al. |
| 9,901,805 | B2 | 2/2018 | Hughes, Jr. |
| 9,906,572 | B2 | 2/2018 | Wang et al. |
| 9,907,396 | B1 | 3/2018 | Labrosse et al. |
| 9,910,498 | B2 | 3/2018 | Kutliroff et al. |
| 9,914,003 | B2 | 3/2018 | Kuehne et al. |
| 9,914,011 | B2 | 3/2018 | Downey et al. |
| 9,914,014 | B2 | 3/2018 | Lagree et al. |
| 9,919,198 | B2 | 3/2018 | Romeo et al. |
| 9,921,726 | B1 | 3/2018 | Sculley et al. |
| 9,937,375 | B2 | 4/2018 | Zhu |
| 9,940,161 | B1 | 4/2018 | Kahn et al. |
| 9,940,682 | B2 | 4/2018 | Hoffman et al. |
| 9,943,159 | B1 | 4/2018 | Novikova |
| 9,943,719 | B2 | 4/2018 | Smith et al. |
| 9,943,722 | B2 | 4/2018 | Dalebout |
| 9,946,857 | B2 | 4/2018 | Beals |

(56) References Cited

U.S. PATENT DOCUMENTS

| | | | |
|---|---|---|---|
| 9,948,349 | B2 | 4/2018 | Malach |
| 9,948,477 | B2 | 4/2018 | Marten |
| 9,950,209 | B2 | 4/2018 | Yim et al. |
| 9,956,450 | B2 | 5/2018 | Bayerlein et al. |
| 9,959,902 | B2 | 5/2018 | McNamee |
| 9,960,980 | B2 | 5/2018 | Wilson |
| 9,962,081 | B2 | 5/2018 | Mensinger et al. |
| 9,962,305 | B2 | 5/2018 | Yamada et al. |
| 9,962,576 | B2 | 5/2018 | Anderson |
| 9,965,059 | B2 | 5/2018 | Myers et al. |
| 9,967,614 | B2 | 5/2018 | McCarthy, III |
| 9,968,821 | B2 | 5/2018 | Finlayson et al. |
| 9,968,823 | B2 | 5/2018 | Cutler |
| 9,974,997 | B2 | 5/2018 | Cei |
| 9,977,874 | B2 | 5/2018 | Aragones et al. |
| 9,983,011 | B2 | 5/2018 | Mountain |
| 9,986,315 | B2 | 5/2018 | Oleson et al. |
| 9,987,513 | B2 | 6/2018 | Yim et al. |
| 9,987,517 | B1 | 6/2018 | Kuo |
| 9,989,507 | B2 | 6/2018 | Benn |
| 9,993,680 | B2 | 6/2018 | Gordon |
| 9,996,066 | B2 | 6/2018 | Beals |
| 10,004,656 | B2 | 6/2018 | Whalen et al. |
| 10,004,940 | B2 | 6/2018 | Badarneh |
| 10,008,090 | B2 | 6/2018 | Yuen et al. |
| 10,013,986 | B1 | 7/2018 | Bhaya et al. |
| 10,015,216 | B2 | 7/2018 | Wang et al. |
| 10,016,655 | B2 | 7/2018 | Wang et al. |
| 10,021,188 | B2 | 7/2018 | Oleson et al. |
| 10,022,589 | B2 | 7/2018 | Case, Jr. et al. |
| 10,022,590 | B2 | 7/2018 | Foley et al. |
| 10,029,172 | B2 | 7/2018 | Galasso et al. |
| 10,035,010 | B1 | 7/2018 | Wagstaff |
| 10,037,053 | B2 | 7/2018 | Malhotra |
| 10,038,952 | B2 | 7/2018 | Labrosse et al. |
| 2001/0001303 | A1 | 5/2001 | Ohsuga et al. |
| 2001/0008053 | A1 | 7/2001 | Belli |
| 2001/0028350 | A1 | 10/2001 | Matsuoka et al. |
| 2001/0049320 | A1 | 12/2001 | Cohen |
| 2001/0053883 | A1 | 12/2001 | Yoshimura et al. |
| 2002/0004439 | A1 | 1/2002 | Galbraith et al. |
| 2002/0013717 | A1 | 1/2002 | Ando |
| 2002/0016235 | A1 | 2/2002 | Ashby et al. |
| 2002/0022555 | A1 | 2/2002 | Nesci |
| 2002/0024521 | A1 | 2/2002 | Goden |
| 2002/0025888 | A1 | 2/2002 | Germanton |
| 2002/0026130 | A1 | 2/2002 | West |
| 2002/0026292 | A1 | 2/2002 | Isami |
| 2002/0031756 | A1 | 3/2002 | Holtz |
| 2002/0042912 | A1 | 4/2002 | Iijima |
| 2002/0043909 | A1 | 4/2002 | Nielsen |
| 2002/0047867 | A1 | 4/2002 | Mault |
| 2002/0054244 | A1 | 5/2002 | Holtz |
| 2002/0055418 | A1 | 5/2002 | Pyles et al. |
| 2002/0055420 | A1 | 5/2002 | Stearns et al. |
| 2002/0055422 | A1 | 5/2002 | Airmet |
| 2002/0055857 | A1 | 5/2002 | Mault |
| 2002/0060335 | A1 | 5/2002 | Edgar |
| 2002/0062236 | A1 | 5/2002 | Murashita |
| 2002/0066735 | A1 | 6/2002 | Hewlitt et al. |
| 2002/0068887 | A1 | 6/2002 | Kikumoto |
| 2002/0068991 | A1 | 6/2002 | Fitzsimmons, Jr. |
| 2002/0070954 | A1 | 6/2002 | Lang |
| 2002/0077219 | A1 | 6/2002 | Cohen |
| 2002/0077221 | A1 | 6/2002 | Dalebout et al. |
| 2002/0083122 | A1 | 6/2002 | Lemchen |
| 2002/0086779 | A1 | 7/2002 | Wilkinson |
| 2002/0088337 | A1 | 7/2002 | Devecka |
| 2002/0091043 | A1 | 7/2002 | Rexach |
| 2002/0091796 | A1 | 7/2002 | Higginson |
| 2002/0094914 | A1 | 7/2002 | Maresh et al. |
| 2002/0106617 | A1 | 8/2002 | Hersh |
| 2002/0107058 | A1 | 8/2002 | Namba et al. |
| 2002/0109710 | A1 | 8/2002 | Holtz et al. |
| 2002/0111541 | A1 | 8/2002 | Bibl et al. |
| 2002/0116266 | A1 | 8/2002 | Marshall |
| 2002/0128119 | A1 | 9/2002 | Arai |
| 2002/0128127 | A1 | 9/2002 | Chen |
| 2002/0138023 | A1 | 9/2002 | Kume et al. |
| 2002/0147078 | A1 | 10/2002 | Wu |
| 2002/0156387 | A1 | 10/2002 | Dardik |
| 2002/0164929 | A1 | 11/2002 | Pinson |
| 2002/0169634 | A1 | 11/2002 | Nishi |
| 2002/0171070 | A1 | 11/2002 | Shim |
| 2002/0173407 | A1 | 11/2002 | Bowman |
| 2002/0194604 | A1 | 12/2002 | Sanchez et al. |
| 2002/0198084 | A1 | 12/2002 | Stearns et al. |
| 2002/0198776 | A1 | 12/2002 | Nara |
| 2003/0004424 | A1 | 1/2003 | Birnbaum |
| 2003/0013072 | A1 | 1/2003 | Thomas |
| 2003/0022763 | A1 | 1/2003 | Ryan et al. |
| 2003/0032524 | A1 | 2/2003 | Lamar et al. |
| 2003/0033600 | A1 | 2/2003 | Cliff et al. |
| 2003/0040348 | A1 | 2/2003 | Martens |
| 2003/0041076 | A1 | 2/2003 | Lucovsky |
| 2003/0043986 | A1 | 3/2003 | Creamer et al. |
| 2003/0043989 | A1 | 3/2003 | Creamer et al. |
| 2003/0044021 | A1 | 3/2003 | Wilkinson et al. |
| 2003/0045406 | A1 | 3/2003 | Stone |
| 2003/0060344 | A1 | 3/2003 | David |
| 2003/0063133 | A1 | 4/2003 | Foote et al. |
| 2003/0065561 | A1 | 4/2003 | Brown et al. |
| 2003/0069108 | A1 | 4/2003 | Rubinstein |
| 2003/0073545 | A1 | 4/2003 | Liu |
| 2003/0088196 | A1 | 5/2003 | Steve |
| 2003/0092532 | A1 | 5/2003 | Giannelli et al. |
| 2003/0092540 | A1 | 5/2003 | Gillen |
| 2003/0096675 | A1 | 5/2003 | Wang |
| 2003/0100406 | A1 | 5/2003 | Millington |
| 2003/0104907 | A1 | 6/2003 | Sankrithi |
| 2003/0104908 | A1 | 6/2003 | Tung |
| 2003/0105390 | A1 | 6/2003 | Alessandri |
| 2003/0115157 | A1 | 6/2003 | Circenis |
| 2003/0126593 | A1 | 7/2003 | Mault |
| 2003/0128186 | A1 | 7/2003 | Laker |
| 2003/0134714 | A1 | 7/2003 | Oishi et al. |
| 2003/0134718 | A1 | 7/2003 | Kim |
| 2003/0138761 | A1 | 7/2003 | Pesnell |
| 2003/0139254 | A1 | 7/2003 | Chang |
| 2003/0142951 | A1 | 7/2003 | Tsurugai |
| 2003/0148853 | A1 | 8/2003 | Alessandri |
| 2003/0148857 | A1 | 8/2003 | Yu |
| 2003/0149344 | A1 | 8/2003 | Nizan |
| 2003/0153436 | A1 | 8/2003 | Ho |
| 2003/0158014 | A1 | 8/2003 | Valentin-Sivico |
| 2003/0163287 | A1 | 8/2003 | Vock et al. |
| 2003/0165802 | A1 | 9/2003 | Murphy |
| 2003/0166434 | A1 | 9/2003 | Lopez-Santillana et al. |
| 2003/0171189 | A1 | 9/2003 | Kaufman |
| 2003/0171190 | A1 | 9/2003 | Rice |
| 2003/0171192 | A1 | 9/2003 | Wu |
| 2003/0176815 | A1 | 9/2003 | Baba et al. |
| 2003/0181289 | A1 | 9/2003 | Oscar Moavro |
| 2003/0183027 | A1 | 10/2003 | Koch |
| 2003/0207237 | A1 | 11/2003 | Glezerman |
| 2003/0208113 | A1 | 11/2003 | Mault et al. |
| 2003/0211449 | A1 | 11/2003 | Seiller |
| 2003/0211916 | A1 | 11/2003 | Capuano |
| 2003/0212536 | A1 | 11/2003 | Wang |
| 2003/0214530 | A1 | 11/2003 | Wang |
| 2003/0216228 | A1 | 11/2003 | Rast |
| 2003/0220143 | A1 | 11/2003 | Shteyn et al. |
| 2003/0222419 | A1 | 12/2003 | Geary |
| 2003/0227473 | A1 | 12/2003 | Shih |
| 2003/0236153 | A1 | 12/2003 | Pan et al. |
| 2004/0005958 | A1 | 1/2004 | Kamen et al. |
| 2004/0005959 | A1 | 1/2004 | Takizawa |
| 2004/0005961 | A1* | 1/2004 | Iund ..... A63B 22/0023 482/54 |
| 2004/0008220 | A1 | 1/2004 | Snyder et al. |
| 2004/0010420 | A1 | 1/2004 | Rooks |
| 2004/0012335 | A1 | 1/2004 | Shon et al. |
| 2004/0014014 | A1 | 1/2004 | Hess |
| 2004/0014571 | A1 | 1/2004 | Haynes |

(56) References Cited

U.S. PATENT DOCUMENTS

2004/0018918 A1 1/2004 Reyes
2004/0019654 A1 1/2004 Powers
2004/0023759 A1 2/2004 Duncan et al.
2004/0023761 A1 2/2004 Emery
2004/0023766 A1 2/2004 Slone
2004/0023778 A1 2/2004 Kusumoto et al.
2004/0025754 A1 2/2004 Dye
2004/0027368 A1 2/2004 Snyder et al.
2004/0029645 A1 2/2004 Chen
2004/0030762 A1 2/2004 Silverthorne
2004/0043873 A1 3/2004 Wilkinson et al.
2004/0046692 A1 3/2004 Robson
2004/0051392 A1 3/2004 Badarneh
2004/0053748 A1 3/2004 Lo et al.
2004/0054350 A1 3/2004 Shaughnessy
2004/0063549 A1 4/2004 Kuo
2004/0072652 A1 4/2004 Alessandri et al.
2004/0077975 A1 4/2004 Zimmerman
2004/0078208 A1 4/2004 Burwell
2004/0097331 A1 5/2004 Zillig
2004/0100484 A1 5/2004 Barrett
2004/0103146 A1 5/2004 Park
2004/0103432 A1 5/2004 Barrett
2004/0114768 A1 6/2004 Luo
2004/0116837 A1 6/2004 Yamaguchi
2004/0116899 A1 6/2004 Shaughnessy
2004/0117072 A1 6/2004 Takeda
2004/0117214 A1 6/2004 Shea
2004/0127285 A1 7/2004 Kavana
2004/0132586 A1 7/2004 Leighton et al.
2004/0132587 A1 7/2004 Leighton et al.
2004/0136750 A1 7/2004 Yoshioka et al.
2004/0138030 A1 7/2004 Wang
2004/0144626 A1 7/2004 Saeki
2004/0152566 A1 8/2004 Yeh
2004/0155622 A1 8/2004 Mayhew et al.
2004/0157546 A1 8/2004 Fantaay
2004/0160336 A1 8/2004 Hoch
2004/0162188 A1 8/2004 Watterson
2004/0163574 A1 8/2004 Schoenbach
2004/0166999 A1 8/2004 Dodge
2004/0171464 A1 9/2004 Ashby et al.
2004/0171465 A1 9/2004 Hald
2004/0176215 A1 9/2004 Gramaccioni
2004/0176217 A1 9/2004 Watterson
2004/0180719 A1 9/2004 Feldman
2004/0181972 A1 9/2004 Csorba
2004/0198559 A1 10/2004 Grossi
2004/0198571 A1 10/2004 Howell et al.
2004/0208943 A1 10/2004 Miketin
2004/0210661 A1 10/2004 Thompson
2004/0220017 A1 11/2004 Gordon
2004/0224740 A1 11/2004 Ball et al.
2004/0224825 A1 11/2004 Giannelli et al.
2004/0224827 A1 11/2004 Ashley
2004/0225239 A1 11/2004 Yamamoto
2004/0225532 A1 11/2004 Gadiyak
2004/0229730 A1 11/2004 Ainsworth et al.
2004/0230138 A1 11/2004 Inoue et al.
2004/0242378 A1 12/2004 Pan
2004/0242379 A1 12/2004 Juva
2004/0242380 A1 12/2004 Kuivala
2004/0242388 A1 12/2004 Kusminsky
2004/0248713 A1 12/2004 Campanaro
2004/0254020 A1 12/2004 Dragusin
2004/0256524 A1 12/2004 Beck et al.
2004/0259689 A1 12/2004 Wilkins et al.
2004/0266587 A1 12/2004 Miller
2005/0003338 A1 1/2005 Norcott et al.
2005/0003931 A1 1/2005 Mills et al.
2005/0008992 A1 1/2005 Westergaard et al.
2005/0009668 A1 1/2005 Savettiere
2005/0012622 A1 1/2005 Sutton
2005/0013433 A1 1/2005 Ghassabian
2005/0014571 A1 1/2005 Varner
2005/0015281 A1 1/2005 Clark et al.
2005/0020887 A1 1/2005 Goldberg
2005/0023292 A1 2/2005 Market et al.
2005/0026811 A1 2/2005 Mjalli
2005/0032611 A1 2/2005 Webber
2005/0037904 A1 2/2005 Chang
2005/0038698 A1 2/2005 Lukose
2005/0038699 A1 2/2005 Lillibridge
2005/0043145 A1 2/2005 Anderson et al.
2005/0043146 A1 2/2005 Lo et al.
2005/0043155 A1 2/2005 Yannitte
2005/0048461 A1 3/2005 Lahteenmaki
2005/0049117 A1 3/2005 Rodgers
2005/0054492 A1 3/2005 Neff
2005/0054940 A1 3/2005 Almen
2005/0060238 A1 3/2005 Gravina et al.
2005/0062841 A1 3/2005 Rivera-Cintron
2005/0064994 A1 3/2005 Matsumoto
2005/0071462 A1 3/2005 Bodin et al.
2005/0071463 A1 3/2005 Bodin et al.
2005/0075213 A1 4/2005 Arick
2005/0075222 A1 4/2005 Adley
2005/0075903 A1 4/2005 Piccionelli
2005/0079905 A1 4/2005 Martens
2005/0090770 A1 4/2005 Chen
2005/0096187 A1 5/2005 Hsu
2005/0096189 A1 5/2005 Chen
2005/0102172 A1 5/2005 Sirmans, Jr.
2005/0107216 A1 5/2005 Lee et al.
2005/0107220 A1 5/2005 Wang
2005/0107226 A1 5/2005 Monda
2005/0107723 A1 5/2005 Wehman et al.
2005/0107726 A1 5/2005 Oyen
2005/0112601 A1 5/2005 Hassibi
2005/0113158 A1 5/2005 Sterchi et al.
2005/0113652 A1 5/2005 Stark et al.
2005/0113723 A1 5/2005 Ueyama
2005/0124463 A1 6/2005 Yeo et al.
2005/0129903 A1 6/2005 Carr
2005/0131319 A1 6/2005 Der Meer
2005/0132838 A1 6/2005 Lin
2005/0143226 A1 6/2005 Heidecke
2005/0143228 A1 6/2005 Lee
2005/0148398 A1 7/2005 Lochtefeld et al.
2005/0148439 A1 7/2005 Wu
2005/0148440 A1 7/2005 Denton
2005/0148442 A1 7/2005 Watterson
2005/0159273 A1 7/2005 Chen
2005/0159277 A1 7/2005 Mcvay
2005/0159278 A1 7/2005 Mcvay
2005/0159712 A1 7/2005 Andersen
2005/0160141 A1 7/2005 Galley
2005/0164832 A1 7/2005 Maschke
2005/0164839 A1 7/2005 Watterson
2005/0167907 A1 8/2005 Curkendall et al.
2005/0170935 A1 8/2005 Manser
2005/0170936 A1 8/2005 Quinn
2005/0172311 A1 8/2005 Hjelt et al.
2005/0178210 A1 8/2005 Lanham
2005/0181347 A1 8/2005 Barnes et al.
2005/0181911 A1 8/2005 Porth
2005/0187704 A1 8/2005 Peters
2005/0195094 A1 9/2005 White
2005/0196737 A1 9/2005 Mann
2005/0202862 A1 9/2005 Shuman et al.
2005/0202934 A1 9/2005 Olrik et al.
2005/0209050 A1 9/2005 Bartels
2005/0209051 A1 9/2005 Santomassimo et al.
2005/0209062 A1 9/2005 Anderson et al.
2005/0209887 A1 9/2005 Pollner
2005/0210169 A1 9/2005 Chou
2005/0212202 A1 9/2005 Meyer
2005/0213442 A1 9/2005 Sako
2005/0215335 A1 9/2005 Marquardt
2005/0227811 A1 10/2005 Shum et al.
2005/0228883 A1 10/2005 Brown
2005/0233859 A1 10/2005 Takai
2005/0233866 A1 10/2005 Miyamaru et al.
2005/0233871 A1 10/2005 Anders

(56) References Cited

U.S. PATENT DOCUMENTS

2005/0238182 A1 10/2005 Shih et al.
2005/0239600 A1 10/2005 Liang
2005/0239607 A1 10/2005 Chang
2005/0240444 A1 10/2005 Wooten
2005/0245370 A1 11/2005 Boland
2005/0245431 A1 11/2005 Demmer et al.
2005/0266961 A1 12/2005 Shum et al.
2005/0269601 A1 12/2005 Tsubaki
2005/0272561 A1 12/2005 Cammerata
2005/0272562 A1 12/2005 Alessandri et al.
2005/0272564 A1 12/2005 Pyles et al.
2005/0272577 A1 12/2005 Olson
2005/0274188 A1 12/2005 Cabanis et al.
2005/0277520 A1 12/2005 Van Waes
2005/0281963 A1 12/2005 Cook
2005/0283911 A1 12/2005 Roussy
2005/0288155 A1 12/2005 Yang
2005/0288954 A1 12/2005 McCarthy et al.
2006/0003869 A1 1/2006 Huang et al.
2006/0004265 A1 1/2006 Pulkkinen et al.
2006/0013351 A1 1/2006 Crider
2006/0019224 A1 1/2006 Behar et al.
2006/0019804 A1 1/2006 Young
2006/0020174 A1 1/2006 Matsumura
2006/0020556 A1 1/2006 Hamnen
2006/0020990 A1 1/2006 McEneaney
2006/0034161 A1 2/2006 Muller
2006/0035754 A1 2/2006 Giannelli et al.
2006/0035757 A1 2/2006 Flick et al.
2006/0035758 A1 2/2006 Rogozinski
2006/0035774 A1 2/2006 Marks
2006/0040244 A1 2/2006 Kain
2006/0040246 A1 2/2006 Ding et al.
2006/0040797 A1 2/2006 Chang
2006/0046807 A1 3/2006 Sanchez
2006/0046898 A1 3/2006 Harvey
2006/0047447 A1 3/2006 Brady et al.
2006/0053586 A1 3/2006 Chase
2006/0053587 A1 3/2006 Chase
2006/0058155 A1 3/2006 Kumar
2006/0058158 A1 3/2006 McAvoy
2006/0058162 A1 3/2006 Vieno et al.
2006/0063644 A1 3/2006 Yang
2006/0063980 A1 3/2006 Hwang et al.
2006/0069102 A1 3/2006 Leban et al.
2006/0075544 A1 4/2006 Kriesel
2006/0089238 A1 4/2006 Huang et al.
2006/0097453 A1 5/2006 Feldman
2006/0100069 A1 5/2006 Dibble et al.
2006/0100546 A1 5/2006 Silk
2006/0104047 A1 5/2006 Guzman
2006/0111944 A1 5/2006 Sirmans, Jr.
2006/0116558 A1 6/2006 Jang
2006/0122034 A1 6/2006 Chen
2006/0122035 A1 6/2006 Felix
2006/0122038 A1 6/2006 Chou Lin
2006/0122044 A1 6/2006 Ho
2006/0122468 A1 6/2006 Tavor
2006/0122474 A1 6/2006 Teller et al.
2006/0123814 A1 6/2006 Choi et al.
2006/0128534 A1 6/2006 Roque
2006/0129432 A1 6/2006 Choi et al.
2006/0135274 A1 6/2006 Henry
2006/0135322 A1 6/2006 Rocker
2006/0142665 A1 6/2006 Garay et al.
2006/0148622 A1 7/2006 Chen
2006/0151303 A1 7/2006 Motoda
2006/0155576 A1 7/2006 Deluz
2006/0160639 A1 7/2006 Klein
2006/0160665 A1 7/2006 Tai
2006/0160666 A1 7/2006 Wang
2006/0160667 A1 7/2006 Oglesby et al.
2006/0161455 A1 7/2006 Anastasia
2006/0161621 A1 7/2006 Rosenberg
2006/0161656 A1 7/2006 Sorvisto
2006/0161850 A1 7/2006 Seaberg
2006/0166791 A1 7/2006 Liao
2006/0166799 A1 7/2006 Boland et al.
2006/0172862 A1 8/2006 Badarneh et al.
2006/0173556 A1 8/2006 Rosenberg
2006/0173828 A1 8/2006 Rosenberg
2006/0179044 A1 8/2006 Rosenberg
2006/0179056 A1 8/2006 Rosenberg
2006/0183602 A1 8/2006 Astilean
2006/0183980 A1 8/2006 Yang
2006/0184427 A1 8/2006 Singh
2006/0186197 A1 8/2006 Rosenberg
2006/0189440 A1 8/2006 Gravagne
2006/0189462 A1 8/2006 Pearson et al.
2006/0189854 A1 8/2006 Webb et al.
2006/0194679 A1 8/2006 Hatcher
2006/0195361 A1 8/2006 Rosenberg
2006/0198613 A1 9/2006 Lee
2006/0199155 A1 9/2006 Mosher
2006/0199706 A1 9/2006 Wehrell
2006/0203972 A1 9/2006 Hays
2006/0205349 A1 9/2006 Passier
2006/0205564 A1 9/2006 Peterson
2006/0205568 A1 9/2006 Huang
2006/0217231 A1 9/2006 Parks et al.
2006/0217236 A1 9/2006 Watterson
2006/0217245 A1 9/2006 Golesh et al.
2006/0218253 A1 9/2006 Hays
2006/0223635 A1 10/2006 Rosenberg
2006/0223637 A1 10/2006 Rosenberg
2006/0223674 A1 10/2006 Korkie
2006/0223680 A1 10/2006 Chang
2006/0223681 A1 10/2006 Loane
2006/0228683 A1 10/2006 Jianping
2006/0229058 A1 10/2006 Rosenberg
2006/0229163 A1 10/2006 Waters
2006/0229164 A1 10/2006 Einav
2006/0229170 A1 10/2006 Ozawa et al.
2006/0232147 A1 10/2006 Cheng
2006/0234832 A1 10/2006 Toyama et al.
2006/0234840 A1 10/2006 Watson
2006/0240947 A1 10/2006 Qu
2006/0240951 A1 10/2006 Wang
2006/0240959 A1 10/2006 Huang
2006/0244187 A1 11/2006 Downey
2006/0247095 A1 11/2006 Rummerfield
2006/0247098 A1 11/2006 Raniere
2006/0247109 A1 11/2006 Powell
2006/0248965 A1 11/2006 Wyatt
2006/0251638 A1 11/2006 Guenzler-Pukall
2006/0252600 A1 11/2006 Grogan
2006/0252602 A1 11/2006 Brown
2006/0252608 A1 11/2006 Kang et al.
2006/0253010 A1 11/2006 Brady et al.
2006/0253210 A1 11/2006 Rosenberg
2006/0256007 A1 11/2006 Rosenberg
2006/0256008 A1 11/2006 Rosenberg
2006/0258513 A1 11/2006 Routley
2006/0258515 A1 11/2006 Kang et al.
2006/0259275 A1 11/2006 Maschke
2006/0259574 A1 11/2006 Rosenberg
2006/0262752 A1 11/2006 Moore et al.
2006/0264299 A1 11/2006 Farinelli et al.
2006/0264306 A1 11/2006 Tischler
2006/0264730 A1 11/2006 Stivoric et al.
2006/0265469 A1 11/2006 Estrade
2006/0269251 A1 11/2006 Hsu
2006/0270522 A1 11/2006 Yonehana et al.
2006/0271286 A1 11/2006 Rosenberg
2006/0276306 A1 12/2006 Pan et al.
2006/0279294 A1 12/2006 Cehelnik
2006/0281605 A1 12/2006 Lo
2006/0283050 A1 12/2006 Carnes et al.
2006/0287089 A1 12/2006 Addington et al.
2006/0287147 A1 12/2006 Kriesel
2006/0287163 A1 12/2006 Wang
2006/0288846 A1 12/2006 Logan
2006/0293608 A1 12/2006 Rothman et al.
2006/0293617 A1 12/2006 Einav et al.

(56) References Cited

U.S. PATENT DOCUMENTS

2007/0004561 A1 1/2007 Yoo
2007/0004562 A1 1/2007 Pan et al.
2007/0004569 A1 1/2007 Cao
2007/0004736 A1 1/2007 Kubo
2007/0005395 A1 1/2007 Singh
2007/0006489 A1 1/2007 Case, Jr. et al.
2007/0010383 A1 1/2007 Pertegaz-Esteban
2007/0011027 A1 1/2007 Melendez
2007/0011391 A1 1/2007 Kim et al.
2007/0011920 A1 1/2007 DiBenedetto et al.
2007/0013655 A1 1/2007 Rosenberg et al.
2007/0014422 A1 1/2007 Wesemann et al.
2007/0015635 A1 1/2007 Donner
2007/0015636 A1 1/2007 Molter
2007/0016444 A1 1/2007 Holkkola
2007/0016930 A1 1/2007 Wesemann
2007/0026958 A1 2/2007 Barasch et al.
2007/0026999 A1 2/2007 Merolle et al.
2007/0027000 A1 2/2007 Shirai et al.
2007/0027002 A1 2/2007 Clark et al.
2007/0028749 A1 2/2007 Basson
2007/0032345 A1 2/2007 Padmanabhan
2007/0032351 A1 2/2007 Reyes
2007/0033068 A1 2/2007 Rao
2007/0033069 A1 2/2007 Rao
2007/0037667 A1 2/2007 Gordon
2007/0038137 A1 2/2007 Arand et al.
2007/0038153 A1 2/2007 Basson
2007/0042866 A1 2/2007 Skilken
2007/0042868 A1 2/2007 Fisher
2007/0049461 A1 3/2007 Kim et al.
2007/0049462 A1 3/2007 Asukai et al.
2007/0049464 A1 3/2007 Chou
2007/0049465 A1 3/2007 Wu
2007/0049466 A1 3/2007 Hubbard
2007/0049470 A1 3/2007 Pyles et al.
2007/0051369 A1 3/2007 Choi et al.
2007/0054778 A1 3/2007 Blanarovich
2007/0054790 A1 3/2007 Dodge et al.
2007/0060408 A1 3/2007 Schultz et al.
2007/0060446 A1 3/2007 Asukai et al.
2007/0060449 A1 3/2007 Lo
2007/0060450 A1 3/2007 Lo
2007/0060451 A1 3/2007 Lucas
2007/0060898 A1 3/2007 Shaughnessy
2007/0061314 A1 3/2007 Rosenberg
2007/0063033 A1 3/2007 Silverbrook et al.
2007/0066448 A1 3/2007 Pan et al.
2007/0072156 A1 3/2007 Kaufman et al.
2007/0072748 A1 3/2007 Lee
2007/0072752 A1 3/2007 Koch
2007/0074617 A1 4/2007 Vergo
2007/0075127 A1 4/2007 Rosenberg
2007/0083095 A1 4/2007 Rippo et al.
2007/0083323 A1 4/2007 Rosenberg
2007/0083975 A1 4/2007 Senegal
2007/0087908 A1 4/2007 Pan et al.
2007/0093360 A1 4/2007 Neff
2007/0093369 A1 4/2007 Bocchicchio
2007/0100595 A1 5/2007 Earles
2007/0100666 A1 5/2007 Stivoric et al.
2007/0106484 A1 5/2007 Sweatman et al.
2007/0111753 A1 5/2007 Vock
2007/0111858 A1 5/2007 Dugan
2007/0111866 A1 5/2007 McVay et al.
2007/0117680 A1 5/2007 Neff
2007/0117683 A1 5/2007 Ercanbrack et al.
2007/0117693 A1 5/2007 Ilioi
2007/0122786 A1 5/2007 Relan et al.
2007/0123389 A1 5/2007 Martin
2007/0123390 A1 5/2007 Mathis
2007/0123396 A1 5/2007 Ellis
2007/0124762 A1 5/2007 Chickering et al.
2007/0129220 A1 6/2007 Bardha
2007/0129907 A1 6/2007 Demon
2007/0131409 A1 6/2007 Asahi
2007/0135264 A1 6/2007 Rosenberg
2007/0135738 A1 6/2007 Bonutti
2007/0136093 A1 6/2007 Rankin et al.
2007/0137331 A1 6/2007 Kachouh
2007/0140403 A1 6/2007 Yuguchi et al.
2007/0142175 A1 6/2007 Morgan
2007/0142179 A1 6/2007 Terao et al.
2007/0142183 A1 6/2007 Chang
2007/0146347 A1 6/2007 Rosenberg
2007/0149362 A1 6/2007 Leao
2007/0149363 A1 6/2007 Wang
2007/0150188 A1 6/2007 Rosenberg
2007/0151489 A1 7/2007 Byrne
2007/0153639 A1 7/2007 Lafever
2007/0155277 A1 7/2007 Amitai et al.
2007/0155495 A1 7/2007 Goo
2007/0155589 A1 7/2007 Feldman
2007/0156335 A1 7/2007 McBride et al.
2007/0161459 A1 7/2007 Watson
2007/0161468 A1 7/2007 Yanagisawa
2007/0167291 A1 7/2007 Kuo
2007/0167292 A1 7/2007 Kuo
2007/0167293 A1 7/2007 Nally
2007/0169381 A1 7/2007 Gordon
2007/0173355 A1 7/2007 Klein
2007/0176035 A1 8/2007 Campbell
2007/0179023 A1 8/2007 Dyer
2007/0179359 A1 8/2007 Goodwin
2007/0180737 A1 8/2007 DiBenedetto et al.
2007/0184953 A1 8/2007 Luberski et al.
2007/0189544 A1 8/2007 Rosenberg
2007/0190508 A1 8/2007 Dalton
2007/0191190 A1 8/2007 Kuo
2007/0197193 A1 8/2007 Zhou
2007/0197345 A1 8/2007 Wallace et al.
2007/0197353 A1 8/2007 Hundley
2007/0197920 A1 8/2007 Adams
2007/0201727 A1 8/2007 Birrell et al.
2007/0202992 A1 8/2007 Grasshoff
2007/0203004 A1 8/2007 Campanaro et al.
2007/0204430 A1 9/2007 Chase
2007/0207733 A1 9/2007 Wong et al.
2007/0208392 A1 9/2007 Kuschner et al.
2007/0208530 A1 9/2007 Vock
2007/0213110 A1 9/2007 Rosenberg
2007/0213126 A1 9/2007 Deutsch et al.
2007/0213178 A1 9/2007 Lemmela
2007/0213183 A1 9/2007 Menektchiev
2007/0214630 A1 9/2007 Kim
2007/0218432 A1 9/2007 Glass
2007/0219057 A1 9/2007 Fleishman
2007/0219058 A1 9/2007 Fleishman
2007/0219059 A1 9/2007 Schwartz
2007/0219066 A1 9/2007 Wang
2007/0219068 A1 9/2007 Korfmacher
2007/0219074 A1 9/2007 Pride
2007/0219457 A1 9/2007 Lo
2007/0225118 A1 9/2007 Giorno
2007/0225119 A1 9/2007 Schenk
2007/0225126 A1 9/2007 Yoo
2007/0225127 A1 9/2007 Pan et al.
2007/0225622 A1 9/2007 Huang et al.
2007/0232450 A1 10/2007 Hanoun
2007/0232452 A1 10/2007 Hanoun
2007/0232455 A1 10/2007 Hanoun
2007/0232461 A1 10/2007 Jenkins et al.
2007/0232463 A1 10/2007 Wu
2007/0233743 A1 10/2007 Rosenberg
2007/0239479 A1 10/2007 Arrasvuori
2007/0243974 A1 10/2007 Li
2007/0245258 A1 10/2007 Ginggen et al.
2007/0245612 A1 10/2007 Tresenfeld
2007/0247320 A1 10/2007 Morahan
2007/0249467 A1 10/2007 Hong et al.
2007/0249468 A1 10/2007 Chen
2007/0254778 A1 11/2007 Ashby
2007/0270294 A1 11/2007 Sheets
2007/0270663 A1 11/2007 Ng et al.

(56) References Cited

U.S. PATENT DOCUMENTS

2007/0270667 A1 11/2007 Coppi et al.
2007/0270726 A1 11/2007 Chou
2007/0271116 A1 11/2007 Wysocki et al.
2007/0271387 A1 11/2007 Lydon et al.
2007/0272011 A1 11/2007 Chapa, Jr.
2007/0275825 A1 11/2007 O'brien
2007/0275826 A1 11/2007 Niemimaki et al.
2007/0275830 A1 11/2007 Lee
2007/0276870 A1 11/2007 Rosenberg
2007/0281828 A1 12/2007 Rice
2007/0281831 A1 12/2007 Wang
2007/0283853 A1 12/2007 Sun
2007/0284495 A1 12/2007 Charles
2007/0287141 A1 12/2007 Milner
2007/0287597 A1 12/2007 Cameron
2007/0287930 A1 12/2007 Sutton
2007/0288204 A1 12/2007 Gienke et al.
2007/0288251 A1 12/2007 Ebrom et al.
2007/0288331 A1 12/2007 Ebrom et al.
2007/0288476 A1 12/2007 Flanagan, III
2007/0293781 A1 12/2007 Sims et al.
2007/0296313 A1 12/2007 Wang
2007/0298405 A1 12/2007 Ebrom et al.
2007/0298935 A1 12/2007 Badarneh
2007/0298937 A1 12/2007 Shah
2008/0001772 A1 1/2008 Saito
2008/0001866 A1 1/2008 Martin
2008/0004162 A1 1/2008 Chen
2008/0005276 A1 1/2008 Frederick
2008/0015061 A1 1/2008 Klein
2008/0015088 A1 1/2008 Del Monaco
2008/0018211 A1 1/2008 Dye
2008/0020898 A1 1/2008 Pyles et al.
2008/0020902 A1 1/2008 Arnold
2008/0020907 A1 1/2008 Lin
2008/0026658 A1 1/2008 Kriesel
2008/0026838 A1 1/2008 Dunstan et al.
2008/0027673 A1 1/2008 Trumm
2008/0032864 A1 2/2008 Hakki
2008/0032865 A1 2/2008 Wu
2008/0032870 A1 2/2008 Wu
2008/0032871 A1 2/2008 Yeh
2008/0037375 A1 2/2008 Ellner et al.
2008/0039301 A1 2/2008 Halbridge
2008/0045384 A1 2/2008 Matsubara
2008/0046246 A1 2/2008 Hakki
2008/0051258 A1 2/2008 Ashby et al.
2008/0051261 A1 2/2008 Lewis
2008/0051919 A1 2/2008 Sakai et al.
2008/0057889 A1 3/2008 Jan
2008/0058169 A1 3/2008 Fox
2008/0058170 A1 3/2008 Giannascoli et al.
2008/0059064 A1 3/2008 Werner
2008/0062818 A1 3/2008 Plancon et al.
2008/0064571 A1 3/2008 Lee
2008/0067302 A1 3/2008 Olivera
2008/0070756 A1 3/2008 Chu
2008/0076969 A1 3/2008 Kraft
2008/0076972 A1 3/2008 Dorogusker et al.
2008/0077489 A1 3/2008 Gilley et al.
2008/0082311 A1 4/2008 Meijer et al.
2008/0089551 A1 4/2008 Heather et al.
2008/0090703 A1 4/2008 Rosenberg
2008/0096745 A1 4/2008 Perry
2008/0097633 A1 4/2008 Jochelson et al.
2008/0098797 A1 5/2008 Considine
2008/0103023 A1 5/2008 Chung
2008/0103024 A1 5/2008 Habing
2008/0103034 A1 5/2008 Mihara et al.
2008/0108481 A1 5/2008 Limma
2008/0108917 A1 5/2008 Joutras et al.
2008/0109121 A1 5/2008 Takeda
2008/0109243 A1 5/2008 Ebrom et al.
2008/0109295 A1 5/2008 McConochie et al.
2008/0109310 A1 5/2008 Ebrom et al.
2008/0109841 A1 5/2008 Healther et al.
2008/0109851 A1 5/2008 Healther et al.
2008/0119332 A1 5/2008 Roman
2008/0119333 A1 5/2008 Bowser
2008/0119337 A1 5/2008 Wilkins
2008/0120436 A1 5/2008 Cowgill et al.
2008/0129825 A1 6/2008 DeAngelis et al.
2008/0132798 A1 6/2008 Hong et al.
2008/0139370 A1 6/2008 Charnitski
2008/0141135 A1 6/2008 Mason et al.
2008/0146334 A1 6/2008 Kil
2008/0146336 A1 6/2008 Feldman
2008/0146416 A1 6/2008 Mueller et al.
2008/0146890 A1 6/2008 LeBoeuf et al.
2008/0146892 A1 6/2008 LeBoeuf et al.
2008/0147502 A1 6/2008 Baker
2008/0153670 A1 6/2008 Mckirdy
2008/0153671 A1 6/2008 Ogg et al.
2008/0153682 A1 6/2008 Chen et al.
2008/0155077 A1 6/2008 James
2008/0161168 A1 7/2008 Hsiao
2008/0161170 A1 7/2008 Lumpee
2008/0161653 A1 7/2008 Lin et al.
2008/0167535 A1 7/2008 Stivoric et al.
2008/0167536 A1 7/2008 Teller
2008/0167958 A1 7/2008 Balmadur
2008/0171636 A1 7/2008 Usui
2008/0171640 A1 7/2008 Chang
2008/0171922 A1 7/2008 Teller
2008/0171945 A1 7/2008 Dotter
2008/0172328 A1 7/2008 Ajilian
2008/0176655 A1 7/2008 James
2008/0176713 A1 7/2008 Olivera Brizzio
2008/0176717 A1 7/2008 Wang
2008/0176718 A1 7/2008 Wang
2008/0176721 A1 7/2008 Boren
2008/0179214 A1 7/2008 Hall
2008/0182685 A1 7/2008 Marty et al.
2008/0182724 A1 7/2008 Guthrie
2008/0183049 A1 7/2008 Karkanias et al.
2008/0183052 A1 7/2008 Teller
2008/0187689 A1 8/2008 Dierkens et al.
2008/0188354 A1 8/2008 Pauws et al.
2008/0188362 A1 8/2008 Chen
2008/0189733 A1 8/2008 Apostolopoulos
2008/0190745 A1 8/2008 Taniguchi
2008/0191864 A1 8/2008 Wolfson
2008/0195258 A1 8/2008 Schendel
2008/0200287 A1 8/2008 Marty et al.
2008/0200778 A1 8/2008 Taskinen
2008/0204225 A1 8/2008 Kitchen
2008/0207401 A1 8/2008 Harding et al.
2008/0207402 A1 8/2008 Fisher et al.
2008/0207407 A1 8/2008 Yeh
2008/0214358 A1 9/2008 Ogg et al.
2008/0214359 A1 9/2008 Niva et al.
2008/0214903 A1 9/2008 Orbach
2008/0214971 A1 9/2008 Talish
2008/0216717 A1 9/2008 Jones
2008/0218307 A1 9/2008 Schoettle
2008/0224988 A1 9/2008 Whang
2008/0228110 A1 9/2008 Berme
2008/0229875 A1 9/2008 Ray
2008/0234023 A1 9/2008 Mullahkhel et al.
2008/0234110 A1 9/2008 Webber et al.
2008/0234111 A1 9/2008 Packham
2008/0234113 A1 9/2008 Einav
2008/0242510 A1 10/2008 Topel
2008/0242511 A1 10/2008 Munoz et al.
2008/0242513 A1 10/2008 Skilken et al.
2008/0244870 A1 10/2008 Chase
2008/0245944 A1 10/2008 Chase
2008/0248926 A1 10/2008 Cole et al.
2008/0248935 A1 10/2008 Solow
2008/0249736 A1 10/2008 Prstojevich
2008/0250729 A1 10/2008 Kriesel
2008/0253378 A1 10/2008 Curry
2008/0254420 A1 10/2008 Nerenberg
2008/0254947 A1 10/2008 Mackay

(56) References Cited

U.S. PATENT DOCUMENTS

2008/0255430 A1 10/2008 Alexandersson et al.
2008/0255794 A1 10/2008 Levine
2008/0261636 A1 10/2008 Lau et al.
2008/0261776 A1 10/2008 Skiba
2008/0262381 A1 10/2008 Kolen
2008/0262392 A1 10/2008 Ananny et al.
2008/0267444 A1 10/2008 Simons-Nikolova et al.
2008/0269017 A1 10/2008 Ungari
2008/0273008 A1 11/2008 Chang
2008/0279896 A1 11/2008 Heinen et al.
2008/0280733 A1 11/2008 Dickie et al.
2008/0280734 A1 11/2008 Dickie et al.
2008/0280735 A1 11/2008 Dickie et al.
2008/0287262 A1 11/2008 Chou
2008/0293023 A1 11/2008 Diehl
2008/0295129 A1 11/2008 Laut
2008/0296883 A1 12/2008 Burkhardtsmaier
2008/0300109 A1 12/2008 Karkanias et al.
2008/0300110 A1 12/2008 Smith et al.
2008/0300114 A1 12/2008 Dalebout
2008/0300115 A1 12/2008 Erlandson
2008/0300914 A1 12/2008 Karkanias
2008/0305934 A1 12/2008 Medina
2008/0306762 A1 12/2008 James
2008/0312039 A1 12/2008 Bucay-Bissu
2008/0312041 A1 12/2008 Schwabe et al.
2008/0312047 A1 12/2008 Feng
2008/0318737 A1 12/2008 Chu
2008/0319787 A1 12/2008 Stivoric
2008/0319796 A1 12/2008 Stivoric
2008/0319855 A1 12/2008 Stivoric
2009/0001831 A1 1/2009 Cho et al.
2009/0017991 A1 1/2009 Hung
2009/0023553 A1 1/2009 Shim
2009/0023554 A1 1/2009 Shim
2009/0024233 A1 1/2009 Shirai et al.
2009/0027925 A1 1/2009 Kanouda et al.
2009/0028005 A1 1/2009 You et al.
2009/0029831 A1 1/2009 Weier
2009/0036276 A1 2/2009 Loach
2009/0040231 A1 2/2009 Sano et al.
2009/0040301 A1 2/2009 Sandler et al.
2009/0041298 A1 2/2009 Sandler et al.
2009/0042174 A1 2/2009 Aries
2009/0042698 A1 2/2009 Wang
2009/0048073 A1 2/2009 Roimicher
2009/0048079 A1 2/2009 Nalley
2009/0048493 A1 2/2009 James et al.
2009/0048939 A1 2/2009 Williams
2009/0049092 A1 2/2009 Capio et al.
2009/0053682 A1 2/2009 Stern
2009/0054207 A1 2/2009 Lin et al.
2009/0054214 A1 2/2009 Kadar
2009/0054751 A1 2/2009 Babashan et al.
2009/0061870 A1 3/2009 Finkelstein et al.
2009/0062598 A1 3/2009 Haisma et al.
2009/0069159 A1 3/2009 Wang
2009/0069722 A1 3/2009 Flaction et al.
2009/0075781 A1 3/2009 Schwarzberg et al.
2009/0075784 A1 3/2009 Hoggan
2009/0076335 A1 3/2009 Schwarzberg et al.
2009/0076903 A1 3/2009 Schwarzberg et al.
2009/0080808 A1 3/2009 Hagen
2009/0082880 A1 3/2009 Saunders
2009/0085873 A1 4/2009 Betts et al.
2009/0088248 A1 4/2009 Stevens
2009/0088299 A1 4/2009 Chen
2009/0093341 A1 4/2009 James
2009/0093347 A1 4/2009 Wang
2009/0098980 A1 4/2009 Waters
2009/0098981 A1 4/2009 Del Giorno
2009/0100718 A1 4/2009 Gerber
2009/0105047 A1 4/2009 Guidi et al.
2009/0105052 A1 4/2009 Dalebout et al.
2009/0105548 A1 4/2009 Bart
2009/0105560 A1 4/2009 Solomon
2009/0109346 A1 4/2009 Viarani et al.
2009/0111656 A1 4/2009 Sullivan et al.
2009/0111658 A1 4/2009 Juan
2009/0111664 A1 4/2009 Kau
2009/0111665 A1 4/2009 Wang
2009/0111666 A1 4/2009 Wang
2009/0111670 A1 4/2009 Williams
2009/0117890 A1 5/2009 Jacobsen et al.
2009/0118098 A1 5/2009 Yeh
2009/0118099 A1 5/2009 Fisher
2009/0119032 A1 5/2009 Meyer
2009/0120208 A1 5/2009 Meyer
2009/0120210 A1 5/2009 Phillips et al.
2009/0124460 A1 5/2009 Chen
2009/0124463 A1 5/2009 Lin
2009/0124464 A1 5/2009 Kastelic
2009/0124465 A1 5/2009 Wang
2009/0124466 A1 5/2009 Zhang
2009/0128342 A1 5/2009 Cohen
2009/0128516 A1 5/2009 Rimon et al.
2009/0144080 A1 6/2009 Gray et al.
2009/0144084 A1 6/2009 Neumaier
2009/0144639 A1 6/2009 Nims et al.
2009/0149299 A1 6/2009 Tchao et al.
2009/0149721 A1 6/2009 Yang
2009/0150178 A1 6/2009 Sutton et al.
2009/0156363 A1 6/2009 Guidi et al.
2009/0156364 A1 6/2009 Simeoni
2009/0158871 A1 6/2009 Chuo
2009/0163262 A1 6/2009 Kang
2009/0163323 A1 6/2009 Bocchicchio
2009/0163326 A1 6/2009 Wang
2009/0163327 A1 6/2009 Huang et al.
2009/0170667 A1 7/2009 Irving et al.
2009/0170672 A1 7/2009 Mcmullen
2009/0171229 A1 7/2009 Saldarelli
2009/0174558 A1 7/2009 White
2009/0176526 A1 7/2009 Altman
2009/0176581 A1 7/2009 Barnes et al.
2009/0176625 A1 7/2009 Giannelli et al.
2009/0176628 A1 7/2009 Radding et al.
2009/0177068 A1 7/2009 Stivoric et al.
2009/0180646 A1 7/2009 Vulfson et al.
2009/0181826 A1 7/2009 Turner
2009/0181829 A1 7/2009 Wu
2009/0181830 A1 7/2009 Wu
2009/0181831 A1 7/2009 Kuo
2009/0181833 A1 7/2009 Cassidy
2009/0191988 A1 7/2009 Klein
2009/0192391 A1 7/2009 Lovitt et al.
2009/0192871 A1 7/2009 Deacon et al.
2009/0193344 A1 7/2009 Smyers
2009/0195350 A1 8/2009 Tsern et al.
2009/0197739 A1 8/2009 Hashimoto
2009/0197740 A1 8/2009 Julskjaer et al.
2009/0204422 A1 8/2009 James
2009/0204668 A1 8/2009 Huang
2009/0205482 A1 8/2009 Shirai et al.
2009/0209393 A1 8/2009 Crater et al.
2009/0210078 A1 8/2009 Crowley
2009/0216629 A1 8/2009 James
2009/0217178 A1 8/2009 Niyogi et al.
2009/0221405 A1 9/2009 Wang
2009/0221407 A1 9/2009 Hauk
2009/0227424 A1 9/2009 Hirata et al.
2009/0227432 A1 9/2009 Pacheco
2009/0232420 A1 9/2009 Eisenberg et al.
2009/0238400 A1 9/2009 Im
2009/0239714 A1 9/2009 Sellers
2009/0240858 A1 9/2009 Takebayashi
2009/0246746 A1 10/2009 Roerdink et al.
2009/0247366 A1 10/2009 Frumer
2009/0253109 A1 10/2009 Anvari
2009/0257323 A1 10/2009 Soltani
2009/0258710 A1 10/2009 Quatrochi et al.
2009/0258763 A1 10/2009 Richter
2009/0262088 A1 10/2009 Moll-Carrillo et al.
2009/0263772 A1 10/2009 Root

(56) References Cited

U.S. PATENT DOCUMENTS

2009/0265649 A1 10/2009 Schlossberg et al.
2009/0267783 A1 10/2009 Vock et al.
2009/0269728 A1 10/2009 Verstegen et al.
2009/0270743 A1 10/2009 Dugan
2009/0278707 A1 11/2009 Biggins et al.
2009/0282080 A1 11/2009 Schlossberg et al.
2009/0286653 A1 11/2009 Wiber
2009/0288887 A1 11/2009 Chen
2009/0292178 A1 11/2009 Ellis et al.
2009/0293319 A1 12/2009 Avni
2009/0309891 A1 12/2009 Karkanias et al.
2009/0312151 A1 12/2009 Thieberger
2009/0312658 A1 12/2009 Thieberger
2010/0003647 A1 1/2010 Brown et al.
2010/0009809 A1 1/2010 Carrington
2010/0015585 A1 1/2010 Baker
2010/0016127 A1 1/2010 Farnsworth et al.
2010/0016742 A1 1/2010 James
2010/0017402 A1 1/2010 Fleming et al.
2010/0019593 A1 1/2010 Ritchey
2010/0022354 A1 1/2010 Fisher
2010/0024590 A1 2/2010 O'neill
2010/0031803 A1 2/2010 Lozada et al.
2010/0032533 A1 2/2010 Chen et al.
2010/0034665 A1 2/2010 Zhong et al.
2010/0035726 A1 2/2010 Fisher et al.
2010/0036736 A1 2/2010 McGee et al.
2010/0038149 A1 2/2010 Corel
2010/0041000 A1 2/2010 Glass
2010/0041516 A1 2/2010 Kodama
2010/0050082 A1 2/2010 Katz et al.
2010/0056339 A1 3/2010 Chen
2010/0056340 A1 3/2010 Ellis
2010/0056876 A1 3/2010 Ellis
2010/0062818 A1 3/2010 Crawford et al.
2010/0062904 A1 3/2010 Crawford et al.
2010/0062914 A1 3/2010 Splane
2010/0063426 A1 3/2010 Planke
2010/0064255 A1 3/2010 Rottler et al.
2010/0068684 A1 3/2010 Sabel
2010/0076278 A1 3/2010 van der Zande et al.
2010/0077564 A1 4/2010 Saier et al.
2010/0079291 A1 4/2010 Kroll et al.
2010/0081116 A1 4/2010 Barasch et al.
2010/0081548 A1 4/2010 Labedz
2010/0087298 A1 4/2010 Zaccherini
2010/0087701 A1 4/2010 Berka et al.
2010/0093493 A1 4/2010 Eldridge
2010/0099437 A1 4/2010 Moerdijk
2010/0099541 A1 4/2010 Patel
2010/0099954 A1 4/2010 Dickinson et al.
2010/0105527 A1 4/2010 Johnson
2010/0112536 A1 5/2010 Claassen et al.
2010/0113222 A1 5/2010 Radow
2010/0113223 A1 5/2010 Chiles et al.
2010/0113948 A1 5/2010 Yang et al.
2010/0125183 A1 5/2010 Vayalattu et al.
2010/0130337 A1 5/2010 Stewart
2010/0137049 A1 6/2010 Epstein
2010/0137105 A1 6/2010 McLaughlin
2010/0137106 A1 6/2010 Oshima et al.
2010/0144501 A1 6/2010 Berhanu
2010/0146055 A1 6/2010 Hannuksela
2010/0152546 A1 6/2010 Behan et al.
2010/0156625 A1 6/2010 Ruha
2010/0156760 A1 6/2010 Cheswick
2010/0160013 A1 6/2010 Sanders
2010/0160014 A1 6/2010 Galasso et al.
2010/0160115 A1 6/2010 Morris et al.
2010/0167801 A1 7/2010 Karkanias et al.
2010/0167876 A1 7/2010 Cheng
2010/0167883 A1 7/2010 Grind
2010/0173276 A1 7/2010 Vasin
2010/0173755 A1 7/2010 P Erez De Lazarraga
2010/0175634 A1 7/2010 Chang et al.
2010/0179035 A1 7/2010 Carnahan
2010/0179883 A1 7/2010 Devolites
2010/0182436 A1 7/2010 Boman et al.
2010/0184565 A1 7/2010 Avellino
2010/0184568 A1 7/2010 Schippers
2010/0188405 A1 7/2010 Haughay, Jr. et al.
2010/0190610 A1 7/2010 Pryor
2010/0191462 A1 7/2010 Kobuya et al.
2010/0192715 A1 8/2010 Vauchel et al.
2010/0197462 A1 8/2010 Piane, Jr.
2010/0197465 A1 8/2010 Stevenson
2010/0204013 A1 8/2010 Chen
2010/0208038 A1 8/2010 Kutliroff et al.
2010/0208082 A1 8/2010 Buchner et al.
2010/0210418 A1 8/2010 Park
2010/0211439 A1 8/2010 Marci et al.
2010/0216536 A1 8/2010 Gagner
2010/0216599 A1 8/2010 Watterson
2010/0216600 A1 8/2010 Noffsinger
2010/0216607 A1 8/2010 Mueller
2010/0217096 A1 8/2010 Nanikashvili
2010/0217099 A1 8/2010 Leboeuf
2010/0217102 A1 8/2010 LeBoeuf et al.
2010/0222165 A1 9/2010 Nurnberg et al.
2010/0222182 A1 9/2010 Park
2010/0227542 A1 9/2010 Goldmann
2010/0227740 A1 9/2010 Liu
2010/0234184 A1 9/2010 Le Page
2010/0234693 A1 9/2010 Srinivasan et al.
2010/0235667 A1 9/2010 Mucignat et al.
2010/0240458 A1 9/2010 Gaiba et al.
2010/0240495 A1 9/2010 Law
2010/0240945 A1 9/2010 Bikko
2010/0241018 A1 9/2010 Vogel
2010/0243514 A1 9/2010 Samain et al.
2010/0247081 A1 9/2010 Victoria Pons
2010/0248899 A1 9/2010 Bedell et al.
2010/0248901 A1 9/2010 Martens
2010/0255884 A1 10/2010 Konkka
2010/0255959 A1 10/2010 Dalebout et al.
2010/0255965 A1 10/2010 Chen
2010/0259043 A1 10/2010 Balsamo
2010/0261580 A1 10/2010 Lannon
2010/0267524 A1 10/2010 Stewart
2010/0271367 A1 10/2010 Vaden et al.
2010/0273610 A1 10/2010 Johnson
2010/0274100 A1 10/2010 Behar
2010/0279822 A1 11/2010 Ford
2010/0279823 A1 11/2010 Waters
2010/0281463 A1 11/2010 Estrade
2010/0283601 A1 11/2010 Tai et al.
2010/0285933 A1 11/2010 Nalley
2010/0289466 A1 11/2010 Telefus
2010/0289772 A1 11/2010 Miller
2010/0292599 A1 11/2010 Oleson et al.
2010/0298098 A1 11/2010 Ercan
2010/0298655 A1 11/2010 McCombie et al.
2010/0298656 A1 11/2010 McCombie et al.
2010/0298661 A1 11/2010 McCombie et al.
2010/0300272 A1 12/2010 Scherf
2010/0302250 A1 12/2010 Hoebel
2010/0304931 A1 12/2010 Stumpf
2010/0311552 A1 12/2010 Sumners
2010/0312596 A1 12/2010 Saffari et al.
2010/0320956 A1 12/2010 Lumsden et al.
2010/0324387 A1 12/2010 Moon
2010/0327603 A1 12/2010 Suaan
2011/0003663 A1 1/2011 Chiu et al.
2011/0009240 A1 1/2011 Chiu et al.
2011/0015039 A1 1/2011 Shea
2011/0015468 A1 1/2011 Aarts et al.
2011/0021319 A1 1/2011 Nissila et al.
2011/0021953 A1 1/2011 Sanematsu et al.
2011/0028277 A1 2/2011 Merli
2011/0028282 A1 2/2011 Sbragia
2011/0032105 A1 2/2011 Hoffman et al.
2011/0034300 A1 2/2011 Hall
2011/0039659 A1 2/2011 Kim et al.
2011/0046519 A1 2/2011 Raheman

(56) References Cited

U.S. PATENT DOCUMENTS

2011/0053131 A1 3/2011 Regnier
2011/0054242 A1 3/2011 Bender
2011/0054270 A1 3/2011 Derchak
2011/0054272 A1 3/2011 Derchak
2011/0054359 A1 3/2011 Sazonov
2011/0054809 A1 3/2011 Templeman
2011/0056328 A1 3/2011 Ko
2011/0061840 A1 3/2011 Goldmann
2011/0063114 A1 3/2011 Ikoyan
2011/0065371 A1 3/2011 Leff
2011/0065373 A1 3/2011 Goldmann
2011/0066056 A1 3/2011 Huang
2011/0067361 A1 3/2011 Sloan
2011/0072955 A1 3/2011 Turner
2011/0073743 A1 3/2011 Shamie
2011/0077055 A1 3/2011 Pakula et al.
2011/0082006 A1 4/2011 Ishii
2011/0082013 A1 4/2011 Bastian
2011/0082015 A1 4/2011 Dreissigacker
2011/0082397 A1 4/2011 Alberts
2011/0086707 A1 4/2011 Loveland
2011/0087076 A1 4/2011 Brynelsen et al.
2011/0087137 A1 4/2011 Hanoun
2011/0087445 A1 4/2011 Sobolewski
2011/0087446 A1 4/2011 Redmond
2011/0091842 A1 4/2011 Dugan
2011/0093100 A1 4/2011 Ramsay
2011/0096764 A1 4/2011 Tunioli et al.
2011/0098157 A1 4/2011 Whalen et al.
2011/0098615 A1 4/2011 Whalen et al.
2011/0105278 A1 5/2011 Fabbri
2011/0105279 A1 5/2011 Herranen
2011/0105920 A1 5/2011 Haataja
2011/0106597 A1 5/2011 Ferdman et al.
2011/0109283 A1 5/2011 Kapels et al.
2011/0112771 A1 5/2011 French
2011/0117529 A1 5/2011 Barash
2011/0118084 A1 5/2011 Tsai et al.
2011/0118086 A1 5/2011 Radow
2011/0118089 A1 5/2011 Ellis
2011/0124466 A1 5/2011 Nishimura
2011/0124469 A1 5/2011 Uhlir
2011/0124476 A1 5/2011 Holley
2011/0124978 A1 5/2011 Williams
2011/0125063 A1 5/2011 Shalon et al.
2011/0131005 A1 6/2011 Ueshima et al.
2011/0136627 A1 6/2011 Williams
2011/0140904 A1 6/2011 Kashi
2011/0143769 A1 6/2011 Jones et al.
2011/0143898 A1 6/2011 Trees
2011/0152033 A1 6/2011 Yang
2011/0152037 A1 6/2011 Tsou
2011/0152038 A1 6/2011 Freitag
2011/0152039 A1 6/2011 Hendrickson
2011/0152635 A1 6/2011 Morris et al.
2011/0152696 A1 6/2011 Ryan
2011/0163939 A1 7/2011 Tam et al.
2011/0164044 A1 7/2011 Huang
2011/0164175 A1 7/2011 Chung et al.
2011/0165995 A1 7/2011 Paulus
2011/0165996 A1 7/2011 Paulus
2011/0165997 A1 7/2011 Reich
2011/0165998 A1 7/2011 Lau et al.
2011/0167447 A1 7/2011 Wong
2011/0172058 A1 7/2011 Deaconu
2011/0172059 A1 7/2011 Watterson et al.
2011/0172060 A1 7/2011 Morales et al.
2011/0175744 A1 7/2011 Englert et al.
2011/0175989 A1 7/2011 Islam
2011/0176943 A1 7/2011 Tran et al.
2011/0177919 A1 7/2011 Tamari
2011/0179068 A1 7/2011 O'brien
2011/0181420 A1 7/2011 Mack et al.
2011/0183307 A1 7/2011 Shum et al.
2011/0184225 A1 7/2011 Whitall et al.
2011/0184247 A1 7/2011 Contant et al.
2011/0188269 A1 8/2011 Hosotani
2011/0188668 A1 8/2011 Donaldson
2011/0191123 A1 8/2011 Buzynski
2011/0195819 A1 8/2011 Shaw
2011/0199393 A1 8/2011 Nurse et al.
2011/0199799 A1 8/2011 Hui et al.
2011/0201476 A1 8/2011 Solomon
2011/0201481 A1 8/2011 Lo
2011/0202236 A1 8/2011 Galasso et al.
2011/0205164 A1 8/2011 Hansen et al.
2011/0214148 A1 9/2011 Gossweiler, III et al.
2011/0218086 A1 9/2011 Boren
2011/0221672 A1 9/2011 Osterhout et al.
2011/0222375 A1 9/2011 Tsubata et al.
2011/0224057 A1 9/2011 Wu
2011/0224498 A1 9/2011 Banet et al.
2011/0229862 A1 9/2011 Parikh
2011/0230732 A1 9/2011 Edman et al.
2011/0238217 A1 9/2011 Kume
2011/0245633 A1 10/2011 Goldberg et al.
2011/0247530 A1 10/2011 Coffman
2011/0252597 A1 10/2011 Burris et al.
2011/0257797 A1 10/2011 Burris et al.
2011/0263385 A1 10/2011 Shea
2011/0264305 A1 10/2011 Choe
2011/0267196 A1 11/2011 Hu et al.
2011/0269517 A1 11/2011 Englert et al.
2011/0269604 A1 11/2011 Tseng
2011/0270135 A1 11/2011 Dooley
2011/0275489 A1 11/2011 Apau
2011/0275499 A1 11/2011 Eschenbach
2011/0276312 A1 11/2011 Shalon et al.
2011/0281691 A1 11/2011 Ellis
2011/0283188 A1 11/2011 Farrenkopf et al.
2011/0283231 A1 11/2011 Richstein et al.
2011/0295083 A1 12/2011 Doelling et al.
2011/0308919 A1 12/2011 Hahn
2011/0311955 A1 12/2011 Forsten et al.
2011/0312473 A1 12/2011 Chu et al.
2011/0319229 A1 12/2011 Corbalis et al.
2011/0320380 A1 12/2011 Zahn et al.
2012/0004074 A1 1/2012 Schelzig
2012/0004075 A1 1/2012 Kissel et al.
2012/0004076 A1 1/2012 Fenster
2012/0004080 A1 1/2012 Webb
2012/0010053 A1 1/2012 Bayerlein et al.
2012/0015778 A1 1/2012 Lee et al.
2012/0015784 A1 1/2012 Reed
2012/0020135 A1 1/2012 McCune
2012/0021873 A1 1/2012 Brunner
2012/0021875 A1 1/2012 Karl
2012/0024237 A1 2/2012 Rice
2012/0028761 A1 2/2012 Dorogusker et al.
2012/0032896 A1 2/2012 Vesely
2012/0035487 A1 2/2012 Werner et al.
2012/0036557 A1 2/2012 Li
2012/0050818 A1 3/2012 Watanabe
2012/0055718 A1 3/2012 Chen
2012/0065031 A1 3/2012 Buzzanco
2012/0071301 A1 3/2012 Kaylor et al.
2012/0078127 A1 3/2012 McDonald et al.
2012/0079429 A1 3/2012 Stathacopoulos et al.
2012/0079529 A1 3/2012 Harris et al.
2012/0081531 A1 4/2012 DeAngelis et al.
2012/0083669 A1 4/2012 Abujbara
2012/0083705 A1 4/2012 Yuen et al.
2012/0084807 A1 4/2012 Thompson et al.
2012/0084811 A1 4/2012 Thompson
2012/0084812 A1 4/2012 Thompson et al.
2012/0088633 A1 4/2012 Crafton
2012/0088640 A1 4/2012 Wissink
2012/0090446 A1 4/2012 Moreno
2012/0092327 A1 4/2012 Adhikari
2012/0096357 A1 4/2012 Folgner et al.
2012/0096405 A1 4/2012 Seo
2012/0105867 A1 5/2012 Komatsu
2012/0108914 A1 5/2012 Bravomalo
2012/0115695 A1 5/2012 Watterson et al.

(56) References Cited

U.S. PATENT DOCUMENTS

2012/0116550 A1 5/2012 Hoffman et al.
2012/0116684 A1 5/2012 Ingrassia et al.
2012/0116806 A1 5/2012 Stark et al.
2012/0122063 A1 5/2012 Chen et al.
2012/0125559 A1 5/2012 Fadell et al.
2012/0129139 A1 5/2012 Partovi
2012/0132877 A1 5/2012 Wang
2012/0133192 A1 5/2012 Simpson
2012/0143358 A1 6/2012 Adams et al.
2012/0149996 A1 6/2012 Stivoric et al.
2012/0153015 A1 6/2012 Gomez et al.
2012/0157265 A1 6/2012 Kao
2012/0159563 A1 6/2012 Gomez et al.
2012/0165162 A1 6/2012 Lu
2012/0165703 A1 6/2012 Bottum
2012/0169603 A1 7/2012 Peterson et al.
2012/0174608 A1 7/2012 Kumamoto et al.
2012/0174833 A1 7/2012 Early
2012/0178590 A1 7/2012 Lu
2012/0187012 A1 7/2012 TeVault et al.
2012/0190502 A1 7/2012 Paulus et al.
2012/0190504 A1 7/2012 Lee et al.
2012/0202656 A1 8/2012 Dorsay
2012/0208153 A1 8/2012 Bolla et al.
2012/0214590 A1 8/2012 Newhouse et al.
2012/0217758 A1 8/2012 Chen
2012/0218184 A1 8/2012 Wissmar
2012/0225412 A1 9/2012 Wagner
2012/0228385 A1 9/2012 Deluca
2012/0230504 A1 9/2012 Kuroda
2012/0233002 A1 9/2012 Abujbara
2012/0237906 A9 9/2012 Glass
2012/0237911 A1 9/2012 Watterson
2012/0238800 A1 9/2012 Naujokat et al.
2012/0238851 A1 9/2012 Kamen et al.
2012/0242774 A1 9/2012 Numano et al.
2012/0248263 A1 10/2012 Grotenhuis
2012/0251983 A1 10/2012 Golden
2012/0253234 A1 10/2012 Yang et al.
2012/0253489 A1 10/2012 Dugan
2012/0258433 A1 10/2012 Hope et al.
2012/0263892 A1 10/2012 Rodgers
2012/0270705 A1 10/2012 Lo
2012/0271121 A1 10/2012 Della Torre et al.
2012/0285986 A1 11/2012 Irvin
2012/0293141 A1 11/2012 Zhang et al.
2012/0298017 A1 11/2012 Chen
2012/0300515 A1 11/2012 Carletti et al.
2012/0315986 A1 12/2012 Walling
2012/0315987 A1 12/2012 Walling
2012/0316406 A1 12/2012 Rahman et al.
2012/0316455 A1 12/2012 Rahman et al.
2012/0316456 A1 12/2012 Rahman et al.
2012/0316458 A1 12/2012 Rahman et al.
2012/0317024 A1 12/2012 Rahman et al.
2012/0319604 A1 12/2012 Walters
2012/0322628 A1 12/2012 Gautier
2012/0323496 A1 12/2012 Burroughs
2012/0326873 A1 12/2012 Utter, II
2012/0329027 A1 12/2012 Lewolt
2012/0329611 A1 12/2012 Bouchard
2013/0002533 A1 1/2013 Burroughs et al.
2013/0004010 A1 1/2013 Royer
2013/0009993 A1 1/2013 Horseman
2013/0011818 A1 1/2013 Shum et al.
2013/0014155 A1 1/2013 Clarke et al.
2013/0015945 A1 1/2013 Chang
2013/0017888 A1 1/2013 King et al.
2013/0018494 A1 1/2013 Amini
2013/0018668 A1 1/2013 Goldberg et al.
2013/0029807 A1 1/2013 Amsel
2013/0034671 A1 2/2013 George
2013/0035209 A1 2/2013 Gilley et al.
2013/0035612 A1 2/2013 Mason et al.
2013/0040271 A1 2/2013 Rytky et al.
2013/0040783 A1 2/2013 Duda et al.
2013/0041590 A1 2/2013 Burich et al.
2013/0041617 A1 2/2013 Pease et al.
2013/0044521 A1 2/2013 Zhao et al.
2013/0050973 A1 2/2013 Rohrbach
2013/0053218 A1 2/2013 Barker
2013/0053222 A1 2/2013 Lo
2013/0053717 A1 2/2013 Vandine et al.
2013/0053990 A1 2/2013 Ackland
2013/0065680 A1 3/2013 Zavadsky
2013/0073093 A1 3/2013 Songkakul
2013/0083003 A1 4/2013 Perez et al.
2013/0085038 A1 4/2013 Fischer
2013/0090565 A1 4/2013 Quy
2013/0092647 A1 4/2013 Chen
2013/0095959 A1 4/2013 Marty
2013/0095978 A1 4/2013 Sauter
2013/0097635 A1 4/2013 Yerli
2013/0105565 A1 5/2013 Kamprath
2013/0108995 A1 5/2013 DePasqua et al.
2013/0116091 A1 5/2013 Fritz
2013/0116514 A1 5/2013 Kroner et al.
2013/0127636 A1 5/2013 Aryanpur et al.
2013/0130868 A1 5/2013 Hou
2013/0130869 A1 5/2013 Hou
2013/0135115 A1 5/2013 Johnson et al.
2013/0137552 A1 5/2013 Kemp et al.
2013/0139736 A1 6/2013 Flaherty
2013/0141235 A1 6/2013 Utter, II
2013/0144464 A1 6/2013 Dorogusker et al.
2013/0147411 A1 6/2013 Pang et al.
2013/0148861 A1 6/2013 Ferlatte et al.
2013/0150214 A1 6/2013 Wu
2013/0154441 A1 6/2013 Redmond
2013/0158368 A1 6/2013 Pacione et al.
2013/0165195 A1 6/2013 Watterson
2013/0165297 A1 6/2013 Daly
2013/0172152 A1 7/2013 Watterson
2013/0173156 A1 7/2013 Wither et al.
2013/0174273 A1 7/2013 Grab et al.
2013/0177884 A1 7/2013 Root
2013/0178334 A1 7/2013 Brammer
2013/0182781 A1 7/2013 Matsutani
2013/0184843 A1 7/2013 Ellis et al.
2013/0185003 A1 7/2013 Carbeck et al.
2013/0190136 A1 7/2013 Watterson
2013/0190143 A1 7/2013 Greenhill et al.
2013/0190657 A1 7/2013 Flaction et al.
2013/0191034 A1 7/2013 Weast et al.
2013/0196821 A1 8/2013 Watterson et al.
2013/0196822 A1 8/2013 Watterson et al.
2013/0196826 A1 8/2013 Colledge
2013/0196827 A1 8/2013 Chang
2013/0203557 A1 8/2013 Su
2013/0208576 A1 8/2013 Loree, IV et al.
2013/0209972 A1 8/2013 Carter et al.
2013/0210581 A1 8/2013 Watterson et al.
2013/0210582 A1 8/2013 Bkool
2013/0216982 A1 8/2013 Bennett et al.
2013/0216990 A1 8/2013 Chu et al.
2013/0228063 A1 9/2013 Turner
2013/0228422 A1 9/2013 Mathieu
2013/0231219 A1 9/2013 Huang
2013/0231226 A1 9/2013 Bonutti
2013/0231575 A1 9/2013 Erkkila et al.
2013/0233097 A1 9/2013 Hayner
2013/0237383 A1 9/2013 Chen
2013/0245966 A1 9/2013 Burroughs et al.
2013/0260965 A1 10/2013 Chia et al.
2013/0263418 A1 10/2013 Johnson
2013/0267386 A1 10/2013 Her
2013/0273509 A1 10/2013 Mutti
2013/0274067 A1 10/2013 Watterson et al.
2013/0274071 A1 10/2013 Wang
2013/0274635 A1 10/2013 Coza et al.
2013/0280682 A1 10/2013 Levine et al.
2013/0282157 A1 10/2013 Shin et al.
2013/0282447 A1 10/2013 Himanen et al.
2013/0288223 A1 10/2013 Watterson et al.

(56) References Cited

U.S. PATENT DOCUMENTS

2013/0289886 A1 10/2013 Ricks
2013/0289932 A1 10/2013 Baechler
2013/0290364 A1 10/2013 Minvielle
2013/0297642 A1 11/2013 Minvielle
2013/0298019 A1 11/2013 Henderson
2013/0303837 A1 11/2013 Berka et al.
2013/0310221 A1 11/2013 Norris
2013/0310230 A1 11/2013 Norris
2013/0310658 A1 11/2013 Ricks
2013/0316830 A1 11/2013 Sedzin et al.
2013/0325394 A1 12/2013 Yuen et al.
2013/0328416 A1 12/2013 Whitworth et al.
2013/0337974 A1 12/2013 Yanev et al.
2013/0338802 A1 12/2013 Winsper et al.
2013/0345978 A1 12/2013 Lush et al.
2013/0346043 A1 12/2013 Mewes et al.
2014/0011645 A1 1/2014 Johnson et al.
2014/0026788 A1 1/2014 Kallio et al.
2014/0031174 A1 1/2014 Huang
2014/0031703 A1 1/2014 Rayner et al.
2014/0039329 A1 2/2014 Kampman et al.
2014/0039840 A1 2/2014 Yuen et al.
2014/0045656 A1 2/2014 Zhang
2014/0052280 A1 2/2014 Yuen et al.
2014/0056461 A1 2/2014 Afshar
2014/0058806 A1 2/2014 Guenette et al.
2014/0063180 A1 3/2014 Sharma
2014/0066264 A1 3/2014 Haddon
2014/0069838 A1 3/2014 Minvielle
2014/0073488 A1 3/2014 Wu
2014/0074265 A1 3/2014 Arginsky
2014/0080678 A1 3/2014 Wu
2014/0085077 A1 3/2014 Luna et al.
2014/0087923 A1 3/2014 Warren
2014/0089836 A1 3/2014 Damani et al.
2014/0094941 A1 4/2014 Ellis et al.
2014/0099614 A1 4/2014 Hu et al.
2014/0100464 A1 4/2014 Kaleal et al.
2014/0102340 A1 4/2014 Kooistra
2014/0106322 A1 4/2014 Durand
2014/0113779 A1 4/2014 Loach
2014/0121066 A1 5/2014 Huang et al.
2014/0121471 A1 5/2014 Walker
2014/0125618 A1 5/2014 Panther et al.
2014/0129240 A1 5/2014 Zhang
2014/0134582 A1 5/2014 Konishi
2014/0135173 A1 5/2014 Watterson
2014/0135631 A1 5/2014 Brumback et al.
2014/0139450 A1 5/2014 Levesque et al.
2014/0141396 A1 5/2014 Spratt
2014/0142403 A1 5/2014 Brumback et al.
2014/0145935 A1 5/2014 Sztuk
2014/0150042 A1 5/2014 Pacor et al.
2014/0156041 A1 6/2014 Martin
2014/0156084 A1 6/2014 Rahman et al.
2014/0156228 A1 6/2014 Molettiere et al.
2014/0156308 A1 6/2014 Ohnemus et al.
2014/0156645 A1 6/2014 Brust et al.
2014/0162230 A1 6/2014 Akopian
2014/0163429 A1 6/2014 Tropper et al.
2014/0164611 A1 6/2014 Molettiere et al.
2014/0171266 A1 6/2014 Hawkins, III et al.
2014/0171272 A1 6/2014 Hawkins et al.
2014/0172873 A1 6/2014 Varoglu et al.
2014/0173660 A1 6/2014 Correa et al.
2014/0180480 A1 6/2014 Lee et al.
2014/0187383 A1 7/2014 Martin
2014/0194260 A1 7/2014 Campanaro et al.
2014/0195103 A1 7/2014 Nassef
2014/0197946 A1 7/2014 Park et al.
2014/0200691 A1 7/2014 Lee et al.
2014/0203943 A1 7/2014 Kates
2014/0205980 A1 7/2014 Braier et al.
2014/0206506 A1 7/2014 Huang
2014/0212857 A1 7/2014 Sullivan et al.
2014/0213416 A1 7/2014 Wang
2014/0214446 A1 7/2014 Pera, Jr.
2014/0220514 A1 8/2014 Waldron et al.
2014/0221160 A1 8/2014 Hardy et al.
2014/0221168 A1 8/2014 Chen
2014/0221784 A1 8/2014 Pacione et al.
2014/0221854 A1 8/2014 Wai
2014/0222173 A1 8/2014 Giedwoyn et al.
2014/0228118 A1 8/2014 Hardy et al.
2014/0228649 A1 8/2014 Rayner et al.
2014/0235411 A1 8/2014 Dailey
2014/0249440 A1 9/2014 Banet
2014/0257535 A1 9/2014 Morris et al.
2014/0257537 A1 9/2014 Stroupe et al.
2014/0265072 A1 9/2014 Chiu
2014/0265690 A1 9/2014 Henderson
2014/0266939 A1 9/2014 Baringer et al.
2014/0270375 A1 9/2014 Canavan et al.
2014/0272894 A1 9/2014 Grimes et al.
2014/0273858 A1 9/2014 Panther et al.
2014/0274564 A1 9/2014 Greenbaum
2014/0274574 A1 9/2014 Shorten
2014/0274579 A1 9/2014 Olson
2014/0275852 A1 9/2014 Hong et al.
2014/0275854 A1 9/2014 Venkatraman et al.
2014/0278139 A1 9/2014 Hong et al.
2014/0278218 A1 9/2014 Chang
2014/0278220 A1 9/2014 Yuen
2014/0288438 A1 9/2014 Venkatraman et al.
2014/0288680 A1 9/2014 Hoffman et al.
2014/0308629 A1 10/2014 Dugan
2014/0309085 A1 10/2014 Watterson
2014/0316192 A1 10/2014 de Zambotti et al.
2014/0335490 A1 11/2014 Baarman et al.
2014/0336796 A1 11/2014 Agnew
2014/0351150 A1 11/2014 Ainsworth et al.
2014/0358012 A1 12/2014 Richards et al.
2014/0358473 A1 12/2014 Goel et al.
2014/0360413 A1 12/2014 Schenk
2014/0363797 A1 12/2014 Hu et al.
2014/0363800 A1 12/2014 Harris et al.
2014/0371887 A1 12/2014 Hoffman et al.
2014/0380167 A1 12/2014 Bloch et al.
2015/0001048 A1 1/2015 Koppes et al.
2015/0003621 A1 1/2015 Trammell
2015/0004579 A1 1/2015 Shelton
2015/0004580 A1 1/2015 Shum et al.
2015/0011362 A1 1/2015 Oh et al.
2015/0016623 A1 1/2015 Trammell
2015/0018989 A1 1/2015 Chen
2015/0019135 A1 1/2015 Kacyvenski et al.
2015/0025660 A1 1/2015 Prassler et al.
2015/0031964 A1 1/2015 Bly et al.
2015/0044648 A1 2/2015 White et al.
2015/0048807 A1 2/2015 Fan et al.
2015/0065273 A1 3/2015 Lake
2015/0065301 A1 3/2015 Oteman
2015/0079562 A1 3/2015 Yeh et al.
2015/0081209 A1 3/2015 Yeh et al.
2015/0081210 A1 3/2015 Yeh et al.
2015/0082408 A1 3/2015 Yeh et al.
2015/0087478 A1 3/2015 Zhang et al.
2015/0092972 A1 4/2015 Lai et al.
2015/0097700 A1 4/2015 Holthouse
2015/0099952 A1 4/2015 Lain et al.
2015/0105220 A1 4/2015 Hong
2015/0105881 A1 4/2015 Guerrero et al.
2015/0106868 A1 4/2015 Lo
2015/0118657 A1 4/2015 Shrake et al.
2015/0119197 A1 4/2015 Liu
2015/0126873 A1 5/2015 Connor
2015/0135284 A1 5/2015 Bogard
2015/0141202 A1 5/2015 Ellis et al.
2015/0151160 A1 6/2015 Balakrishnan et al.
2015/0154452 A1 6/2015 Bentley et al.
2015/0157918 A1 6/2015 Tracy
2015/0165269 A1 6/2015 Herrala et al.
2015/0181314 A1 6/2015 Swanson
2015/0186609 A1 7/2015 Utter, II

(56) References Cited

U.S. PATENT DOCUMENTS

2015/0190679 A1 7/2015 Carbone
2015/0192929 A1 7/2015 Rihn et al.
2015/0199494 A1 7/2015 Koduri et al.
2015/0201722 A1 7/2015 Brouard
2015/0202487 A1 7/2015 Wu
2015/0209610 A1 7/2015 Dalebout et al.
2015/0209617 A1 7/2015 Hsiao
2015/0224363 A1 8/2015 Clark et al.
2015/0238815 A1 8/2015 Lee
2015/0246751 A1 9/2015 Spivack et al.
2015/0248844 A1 9/2015 Ellis et al.
2015/0250304 A1 9/2015 Dalebout
2015/0250420 A1 9/2015 Longinotti-Buitoni et al.
2015/0251047 A1 9/2015 Maaniitty
2015/0251048 A1 9/2015 Dalebout
2015/0251055 A1 9/2015 Ashby
2015/0253210 A1 9/2015 Ashby et al.
2015/0255002 A1 9/2015 Harris et al.
2015/0258382 A1 9/2015 Nolan et al.
2015/0258384 A1 9/2015 Suzuki
2015/0262459 A1 9/2015 Munro et al.
2015/0265903 A1 9/2015 Kolen et al.
2015/0269354 A1 9/2015 Klassen
2015/0272262 A1 10/2015 Escamilla
2015/0272473 A1 10/2015 Zafiroglu
2015/0273272 A1 10/2015 Wang
2015/0288926 A1 10/2015 Glass et al.
2015/0295397 A1 10/2015 Lin et al.
2015/0296020 A1 10/2015 Granqvist et al.
2015/0305961 A1 10/2015 Broerman et al.
2015/0306456 A1 10/2015 Pasini et al.
2015/0310062 A1 10/2015 Wang et al.
2015/0314184 A1 11/2015 Moya Saez
2015/0318015 A1 11/2015 Bose et al.
2015/0320588 A1 11/2015 Connor
2015/0324751 A1 11/2015 Orenstein et al.
2015/0327804 A1 11/2015 Lefever et al.
2015/0331449 A1 11/2015 Ng
2015/0335288 A1 11/2015 Toth et al.
2015/0339946 A1 11/2015 Pacione et al.
2015/0342815 A1 12/2015 Watson
2015/0346994 A1 12/2015 Chanyontpatanakul
2015/0351690 A1 12/2015 Toth et al.
2015/0352396 A1 12/2015 Dalebout
2015/0352401 A1 12/2015 Johnson
2015/0352402 A1 12/2015 Arnold et al.
2015/0352404 A1 12/2015 Schwenger
2015/0360133 A1 12/2015 MacCallum et al.
2015/0364026 A1 12/2015 Rubin et al.
2015/0364058 A1 12/2015 Lagree
2015/0366746 A1 12/2015 Ashby
2015/0367158 A1 12/2015 Pretz et al.
2015/0367176 A1 12/2015 Bejestan et al.
2015/0370320 A1 12/2015 Connor
2015/0379239 A1 12/2015 Basta et al.
2015/0381736 A1 12/2015 Seltzer
2016/0008650 A1 1/2016 Jue et al.
2016/0012749 A1 1/2016 Connor
2016/0016035 A1 1/2016 Hao
2016/0018119 A1 1/2016 Desmet et al.
2016/0027325 A1 1/2016 Malhotra
2016/0038785 A1 2/2016 Netter
2016/0047446 A1 2/2016 Hung
2016/0051184 A1 2/2016 Wisbey et al.
2016/0058245 A1 3/2016 Smith et al.
2016/0059077 A1 3/2016 Paul et al.
2016/0059078 A1 3/2016 Liao
2016/0059079 A1 3/2016 Watterson
2016/0061300 A1 3/2016 Aoto et al.
2016/0063615 A1 3/2016 Watterson
2016/0066818 A1 3/2016 Cowley et al.
2016/0071014 A1 3/2016 Brand et al.
2016/0077547 A1 3/2016 Aimone et al.
2016/0089569 A1 3/2016 Blahnik
2016/0096064 A1 4/2016 Gatti
2016/0107029 A1 4/2016 Kim et al.
2016/0112684 A1 4/2016 Connor
2016/0136483 A1 5/2016 Reich
2016/0148535 A1 5/2016 Ashby
2016/0148536 A1 5/2016 Ashby
2016/0151603 A1 6/2016 Shouldice et al.
2016/0157740 A1 6/2016 Kampman et al.
2016/0171110 A1 6/2016 Gao et al.
2016/0184635 A1 6/2016 Kwon
2016/0193518 A1 7/2016 Baxter
2016/0206922 A1 7/2016 Dalebout et al.
2016/0211841 A1 7/2016 Harrison
2016/0219968 A1 8/2016 Martin
2016/0232811 A9 8/2016 Connor
2016/0249365 A1 8/2016 Harel
2016/0250519 A1 9/2016 Watterson
2016/0253918 A1 9/2016 Watterson
2016/0256082 A1 9/2016 Ely et al.
2016/0256745 A1 9/2016 Brammer
2016/0263426 A1 9/2016 Mueller et al.
2016/0279462 A1 9/2016 Sutherland
2016/0279470 A1 9/2016 Hampton
2016/0296053 A1 10/2016 Bakhsh
2016/0303421 A1 10/2016 Tyger
2016/0317861 A1 11/2016 Dalebout
2016/0321932 A1 11/2016 Mitchell
2016/0346616 A1 12/2016 Kirby et al.
2016/0351070 A1 12/2016 Aillon-Sohl
2016/0367851 A1 12/2016 Astilean et al.
2016/0367857 A1 12/2016 Aragones et al.
2016/0371998 A1 12/2016 Fazeel
2017/0007886 A1 1/2017 Alessandri
2017/0011210 A1 1/2017 Cheong et al.
2017/0020440 A1 1/2017 Flitsch et al.
2017/0036106 A1 2/2017 Stechschulte et al.
2017/0050069 A1 2/2017 Ky
2017/0050102 A1 2/2017 Kelly
2017/0056726 A1 3/2017 Dalebout et al.
2017/0063567 A1 3/2017 Kabushiki
2017/0065187 A1 3/2017 Hsieh et al.
2017/0065947 A1 3/2017 Haney et al.
2017/0068782 A1 3/2017 Pillai et al.
2017/0082983 A1 3/2017 Katzer et al.
2017/0093451 A1 3/2017 Chen et al.
2017/0097717 A1 4/2017 Anisetti et al.
2017/0100636 A1 4/2017 Umetsu et al.
2017/0104425 A1 4/2017 Meloche
2017/0113093 A1 4/2017 Bellavista et al.
2017/0120102 A1 5/2017 Chen
2017/0128783 A1 5/2017 Hasegawa et al.
2017/0128784 A1 5/2017 Molins et al.
2017/0136280 A1 5/2017 Lee
2017/0136288 A1 5/2017 Huang
2017/0136289 A1 5/2017 Frank
2017/0136291 A1 5/2017 Huang
2017/0136293 A1 5/2017 Caccia
2017/0136301 A1 5/2017 Cameron
2017/0136339 A1 5/2017 Habiche
2017/0144051 A1 5/2017 Oleson et al.
2017/0164876 A1 6/2017 Hyde et al.
2017/0165523 A1 6/2017 Chou
2017/0180535 A1 6/2017 Esenwein et al.
2017/0189745 A1 7/2017 Hamilton et al.
2017/0193578 A1 7/2017 Watterson
2017/0216660 A1 8/2017 Lernihan
2017/0225034 A1 8/2017 Kass et al.
2017/0235922 A1 8/2017 Weast et al.
2017/0252623 A1 9/2017 Sharifi
2017/0252641 A1 9/2017 Morimura et al.
2017/0266483 A1 9/2017 Dalebout et al.
2017/0266503 A1 9/2017 Watterson et al.
2017/0266532 A1 9/2017 Watterson
2017/0266533 A1 9/2017 Dalebout
2017/0266534 A1 9/2017 Watterson
2017/0266535 A1 9/2017 Watterson
2017/0270820 A1 9/2017 Ashby
2017/0274237 A1 9/2017 Chang
2017/0274242 A1 9/2017 Corbalis
2017/0311817 A9 11/2017 Hsieh et al.

(56) References Cited

U.S. PATENT DOCUMENTS

| | | | |
|---|---|---|---|
| 2017/0326411 | A1 | 11/2017 | Watterson |
| 2017/0333755 | A1 | 11/2017 | Rider |
| 2017/0340917 | A1 | 11/2017 | Chang |
| 2017/0354846 | A1 | 12/2017 | Von Rueckmann |
| 2017/0364661 | A1 | 12/2017 | Hamilton, II et al. |
| 2017/0365048 | A1 | 12/2017 | Hamilton, II et al. |
| 2017/0368442 | A1 | 12/2017 | Baudhuin |
| 2018/0001135 | A1 | 1/2018 | Powell |
| 2018/0008865 | A9 | 1/2018 | Lannon et al. |
| 2018/0036572 | A1 | 2/2018 | Hsu |
| 2018/0036585 | A1 | 2/2018 | Powell |
| 2018/0056111 | A1 | 3/2018 | Chiang et al. |
| 2018/0084817 | A1 | 3/2018 | Capell et al. |
| 2018/0085630 | A1 | 3/2018 | Capell et al. |
| 2018/0085654 | A1 | 3/2018 | Black et al. |
| 2018/0089396 | A1 | 3/2018 | Capell et al. |
| 2018/0092603 | A1 | 4/2018 | Duan et al. |
| 2018/0099116 | A1 | 4/2018 | Ashby |
| 2018/0099179 | A1 | 4/2018 | Chatterton et al. |
| 2018/0099180 | A1 | 4/2018 | Wilkinson |
| 2018/0099181 | A1 | 4/2018 | Powell et al. |
| 2018/0099184 | A1 | 4/2018 | Eder |
| 2018/0099205 | A1 | 4/2018 | Watterson |
| 2018/0104533 | A1 | 4/2018 | Powell et al. |
| 2018/0109838 | A1 | 4/2018 | Garcia et al. |
| 2018/0111018 | A1 | 4/2018 | Lee |
| 2018/0111034 | A1 | 4/2018 | Watterson |
| 2018/0116599 | A1 | 5/2018 | Bastide et al. |
| 2018/0117383 | A1 | 5/2018 | Workman |
| 2018/0117385 | A1 | 5/2018 | Watterson et al. |
| 2018/0117388 | A1 | 5/2018 | Porter |
| 2018/0117419 | A1 | 5/2018 | Jackson |
| 2018/0147440 | A1 | 5/2018 | Lin |
| 2018/0154205 | A1 | 6/2018 | Watterson |
| 2018/0154206 | A1 | 6/2018 | Kim |
| 2018/0154208 | A1 | 6/2018 | Powell et al. |

* cited by examiner

LIGHTED PACE FEATURE IN A TREADMILL

RELATED APPLICATIONS

This application claims priority to U.S. patent application Ser. No. 62/310,300 titled "Lighted Pace Feature in a Treadmill" and filed on 18 Mar. 2016, which application is herein incorporated by reference for all that it discloses.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Typically, the human body can adequately supply enough oxygen to meet the body's demands at the intensity levels involved with aerobic exercise. Popular forms of aerobic exercise include running, jogging, swimming, and cycling among others activities. In contrast, anaerobic exercise typically involves high intensity exercises over a short duration of time. Popular forms of anaerobic exercise include strength training and short distance running.

Many choose to perform aerobic exercises indoors, such as in a gym or their home. Often, a user will use an aerobic exercise machine to have an aerobic workout indoors. One type of aerobic exercise machine is a treadmill, which is a machine that has a running deck attached to a support frame. The running deck can support the weight of a person using the machine. The running deck incorporates a conveyor belt that is driven by a motor. A user can run or walk in place on the conveyor belt by running or walking at the conveyor belt's speed. The speed and other operations of the treadmill are generally controlled through a control module that is also attached to the support frame and within a convenient reach of the user. The control module can include a display, buttons for increasing or decreasing a speed of the conveyor belt, controls for adjusting a tilt angle of the running deck, or other controls. Other popular exercise machines that allow a user to perform aerobic exercises indoors include elliptical trainers, rowing machines, stepper machines, and stationary bikes to name a few.

One type of treadmill is disclosed in U.S. Patent Publication No. 2009/0176629 issued to Hwa Cho Yi. In this reference, an automatic speed-controlled treadmill uses a pressure sensor array. The automatic speed-controlled treadmill includes a walking belt, a pressure sensor array including pressure sensors for detecting loads of the exerciser's feet and outputting the detected loads of the feet as load detection signals, a pace speed status storage unit for storing a pace speed and variation in pace speed of the exerciser, and a control unit provided with an algorithm for calculating a pace speed of the exerciser using the load detection signals, calculating a difference between a previous pace speed and a current pace speed as the variation in pace speed, calculating the exercise center of the exerciser, and proportionally accelerating/decelerating a driving speed of the walking belt in consideration of the variation in pace speed and the exercise center.

SUMMARY

In one embodiment, a treadmill includes an exercise deck. The exercise deck includes a platform, a first pulley attached to the platform in a front portion, a second pulley attached to the platform in a second portion, a tread belt surrounding the first and second pulley, and a pacing mechanism incorporated into the platform.

The pacing mechanism may include multiple lights distributed along a length of the platform that illuminate sequentially based at least in part on a speed of the tread belt.

The pacing mechanism may include a light.

The light may be set to temporarily illuminate during predetermined duration of time at a frequency based on at least in part on a speed of the tread belt.

The pace may be based on at least in part on a speed of the treadmill.

The treadmill may include a console, memory, and a processor. The memory may include programmed instructions, when executed, that cause the processor to selectively illuminate one of multiple lights based on a pace.

The programmed instructions, when executed, may cause the processor to receive a pace input from a user.

The programmed instructions, when executed, may cause the processor to execute a programmed exercise routine where the exercise routine contains the pace.

The pacing mechanism may include a first portion on a first side of the platform between the front portion and the rear portion and a second portion on a second side of the platform between the front portion and the portion.

The first portion may include a first subset of multiple lights distributed along a length of the platform that illuminate sequentially based on a pace and a second subset of the multiple lights distributed along the length of the platform that illuminate sequentially based on the pace.

The first subset of the multiple lights may illuminate sequentially based on at least in part on a speed and a movement that a user's first foot has to travel to maintain the pace and wherein the second subset of the multiple lights illuminate sequentially based on at least in part on the speed and the movement that a user's second foot has to travel to maintain the pace.

In one embodiment, a treadmill includes an exercise deck. The exercise deck includes a platform, a first pulley attached to the platform in a front portion, a second pulley attached to the platform in a second portion, a tread belt surrounding the first and second pulley, and multiple lights distributed along a length of the platform.

The multiple lights may illuminate sequentially based on at least in part on a speed of the tread belt.

The treadmill may include a console, memory, and a processor. The memory may include programmed instructions, when executed, that cause the processor to selectively illuminate one of multiple lights based on a pace.

The programmed instructions, when executed, may cause the processor to receive a pace input from a user.

The programmed instructions, when executed, may cause the processor to execute a programmed exercise routine where the exercise routine contains the pace.

The pacing mechanism may include a first portion on a first side of the platform between the front portion and the rear portion and a second portion on a second side of the platform between the front portion and the portion.

The first portion may include a first subset of multiple lights distributed along a length of the platform that illuminate sequentially based on a pace and a second subset of the multiple lights distributed along the length of the platform that illuminate sequentially based on the pace.

The first subset of the multiple lights may illuminate sequentially based on at least in part on a speed and a movement that a user's first foot has to travel to maintain the pace and wherein the second subset of the multiple lights illuminate sequentially based on at least in part on the speed and the movement that a user's second foot has to travel to maintain the pace.

In one embodiment, a treadmill includes an exercise deck. The exercise deck includes a platform, a first pulley attached to the platform in a front portion, a second pulley attached to the platform in a second portion, a tread belt surrounding the first and second pulley, a pacing mechanism incorporated into the platform, the pacing mechanism includes multiple lights distributed along a length of the platform that illuminate sequentially based at least in part on a speed of the tread belt, a first portion on a first side of the platform between the front portion and the rear portion where a first subset of multiple lights are distributed along a length of the platform that illuminate sequentially based at least in part on the speed of the tread belt, and a second portion on a second side of the platform between the front portion and the portion where a second subset of the multiple lights distributed along the length of the platform that illuminate sequentially based at least in part on the speed of the tread belt.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

Figure 1:
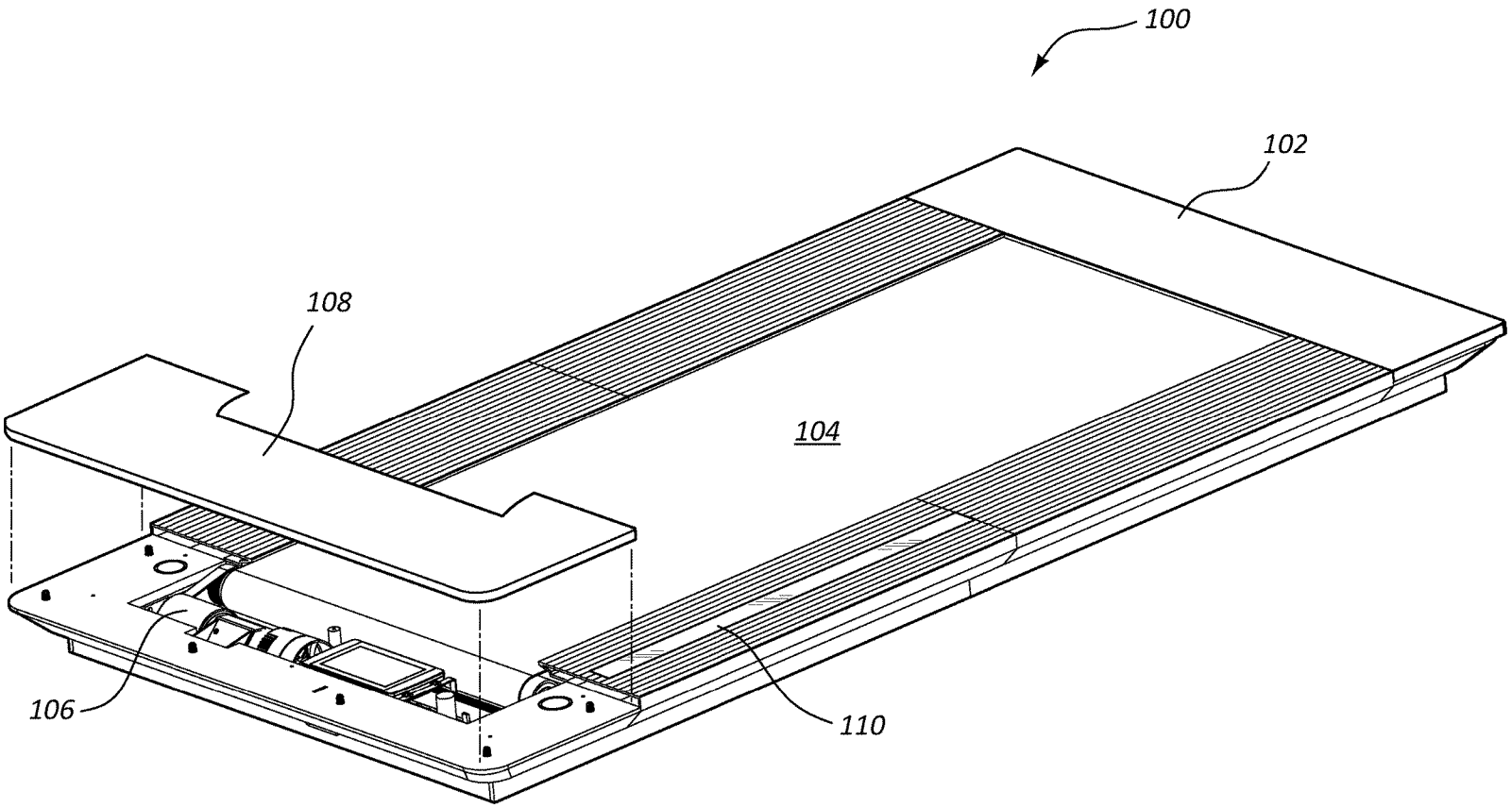
FIG. 1 illustrates a perspective view of an example of a treadmill in accordance with the present disclosure.

FIG. 1 depicts an example of a treadmill 100 having a deck 102 with a first pulley disposed in a first portion of the deck 102 and a second pulley incorporated into a second portion of the deck 102. A tread belt 104 surrounds the first pulley and the second pulley. A motor 106 is in mechanical communication with either the first pulley or the second pulley. A cover 108 is superjacent the motor 106.

The treadmill 100 also includes a pacing mechanism which includes a light 110 incorporated into the side of the deck.

Figure 2:
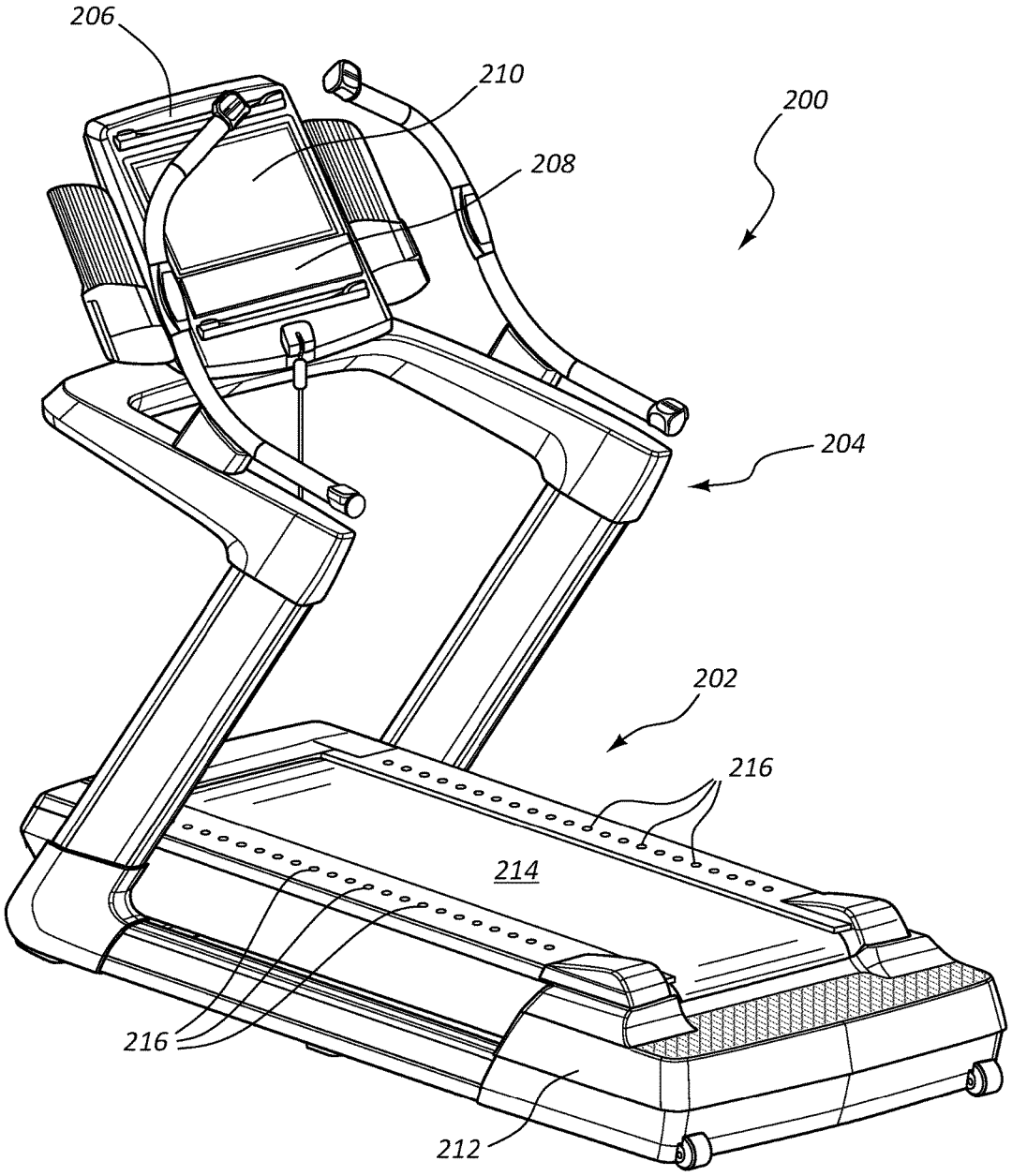
FIG. 2 illustrates a perspective view of an example of a treadmill in accordance with the present disclosure.

FIG. 2 depicts an example of a treadmill 200 that includes a deck 202 and an upright structure 204. The upright structure 204 includes a console 206 and incorporates at least one input mechanism 208 and a display 210. The input mechanism 208 can control at least one parameter of the treadmill, such as the speed of the tread belt, the incline of the deck 202, a climate control, entertainment, and so forth.

The deck includes a platform 212 with a front pulley and a rear pulley. A tread belt 214 surrounds the front and rear pulleys. The platform 212 includes portions of the deck 202 that are adjacent to the tread belt's edges. In the example of FIG. 2, these regions adjacent to the tread belt include multiple lights 216 distributed along a length of the deck 202.

Figure 3:
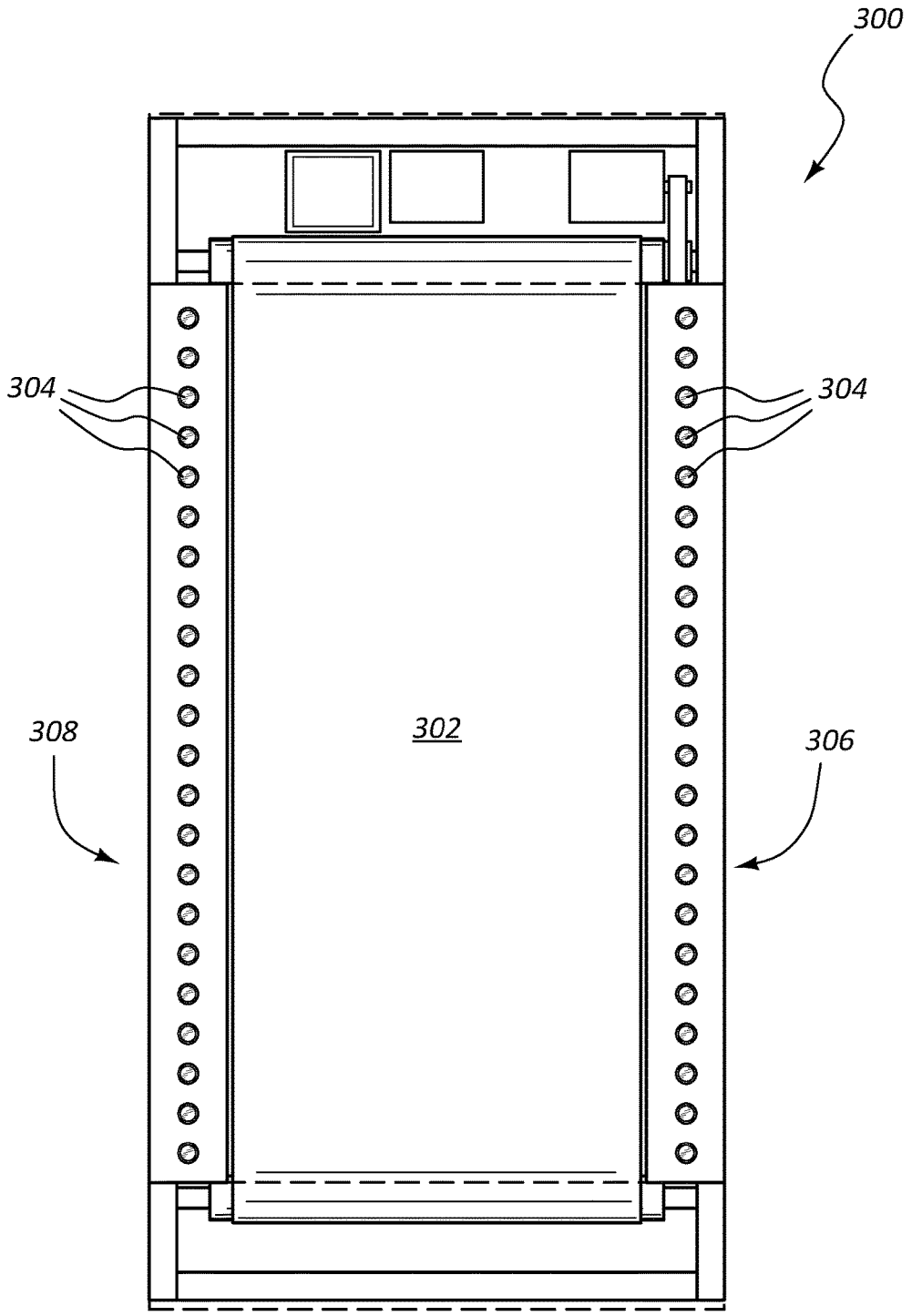
FIG. 3 illustrates a top view of an example of a treadmill in accordance with the present disclosure.

FIG. 3 depicts a top view of a deck 300. In this example, the deck 300 includes a tread belt 302 and lights 304 positioned along the sides 306, 308 the tread belt 302.

Figure 4:
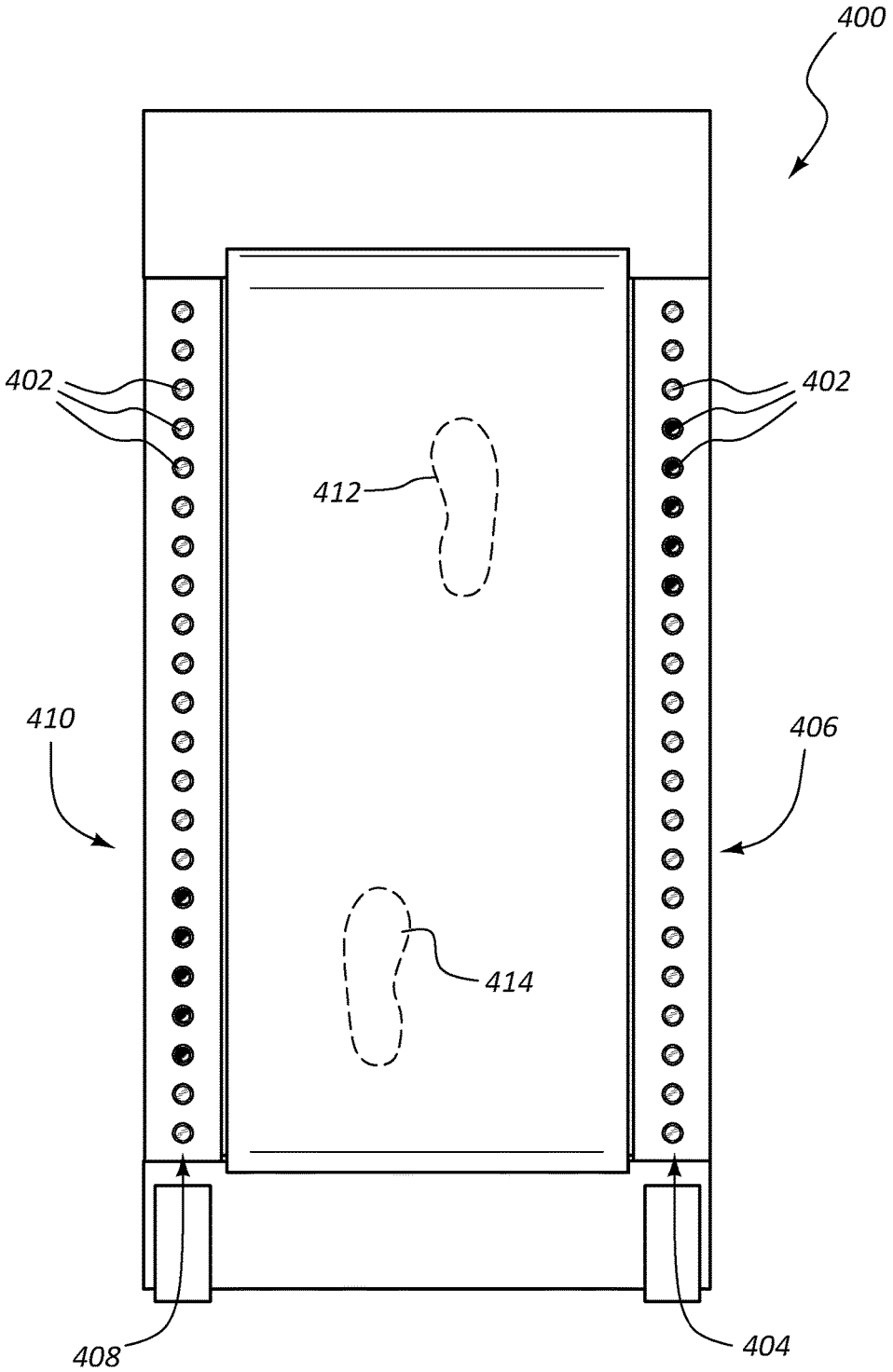
FIG. 4 illustrates a top view of an example of a treadmill in accordance with the present disclosure.

FIG. 4 depicts a top view of the deck 400 and the lights 402. In this example, a first subset 404 of the lights 402 is positioned on a first side 406 of the deck 400, and a second subset 408 of the lights 402 is positioned on a second side 410 of the deck 400. A user's first foot is represented with a first foot print 412, and a user's second foot is represented with a second foot print 414.

The lights 402 illuminate to set a pace for the user based on the speed of the tread belt 416. In some cases, the user's stride is determined or inputted into the treadmill, and the pace is also determined based, in part, on the user's stride. Based on the pace, a pacing mechanism of the treadmill determines how fast the user's feet have to move to keep up with the tread belt's movements. The first subset 404 of lights 402 illuminate in a sequential order at the pace that the user's first foot has to move to keep up with the pace. Likewise, the second subset 408 of lights 402 illuminate in a sequential order at the pace that the user's second foot has to move to keep up with the pace. The illumination timing of the first subset 404 is matched with the first foot, and the illumination timing of the second subset 408 is matched with the second foot. Thus, the illumination timing of the first subset 404 and the second subset 408 of lights 402 is offset since the placement of the first and second feet on the tread belt are offset from each other. The illumination of each light is temporary for a predetermined amount of time. The frequency of the light's illumination is based on the pace. In those circumstances where the user is running at the pace set with the pacing mechanism, the user's first foot appears to move in unison with the illumination of the first subset 404 of lights 402, and the user's second foot appears to move in unison with the illumination of the second subset 408 of lights 402.

Figure 5:
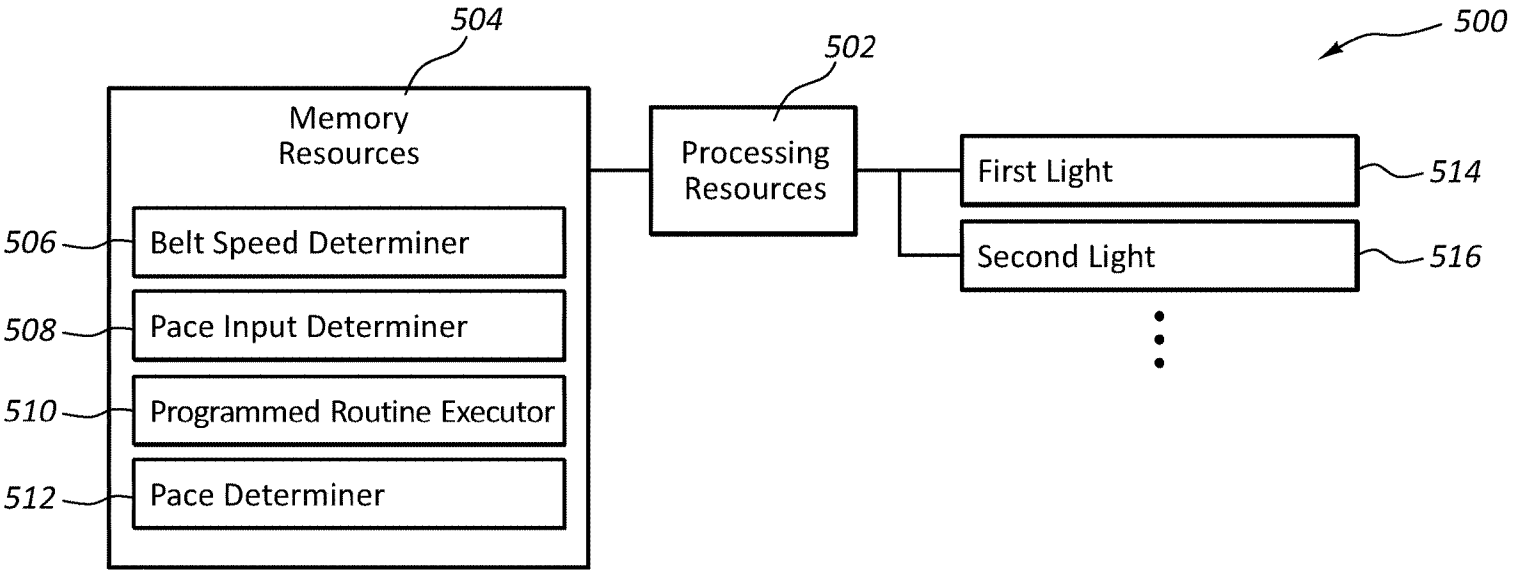
FIG. 5 illustrates a block diagram of an example of a pacing mechanism in accordance with the present disclosure.

FIG. 5 depicts an example of a pacing mechanism 500. In this example, the pacing mechanism 500 includes processing resources 502 and memory resources 504. The memory resources 504 may cause the processing resources 502 to carry out functions programmed in the memory resources 504. In this example, the memory resources 504 include a belt speed determiner 506, a pace input determiner 508, a programmed routine executor 510, and a pace determiner 512.

The processing resources 502 may be in communication with I/O resources, which may include a receiver, a transmitter, a transceiver, another type of communication device, or combinations thereof. Further, the processing resources 402 may be in direct communication or in communication through the I/O resources with a first light 514, a second light 516, other lights, or combinations thereof.

Figure 6:
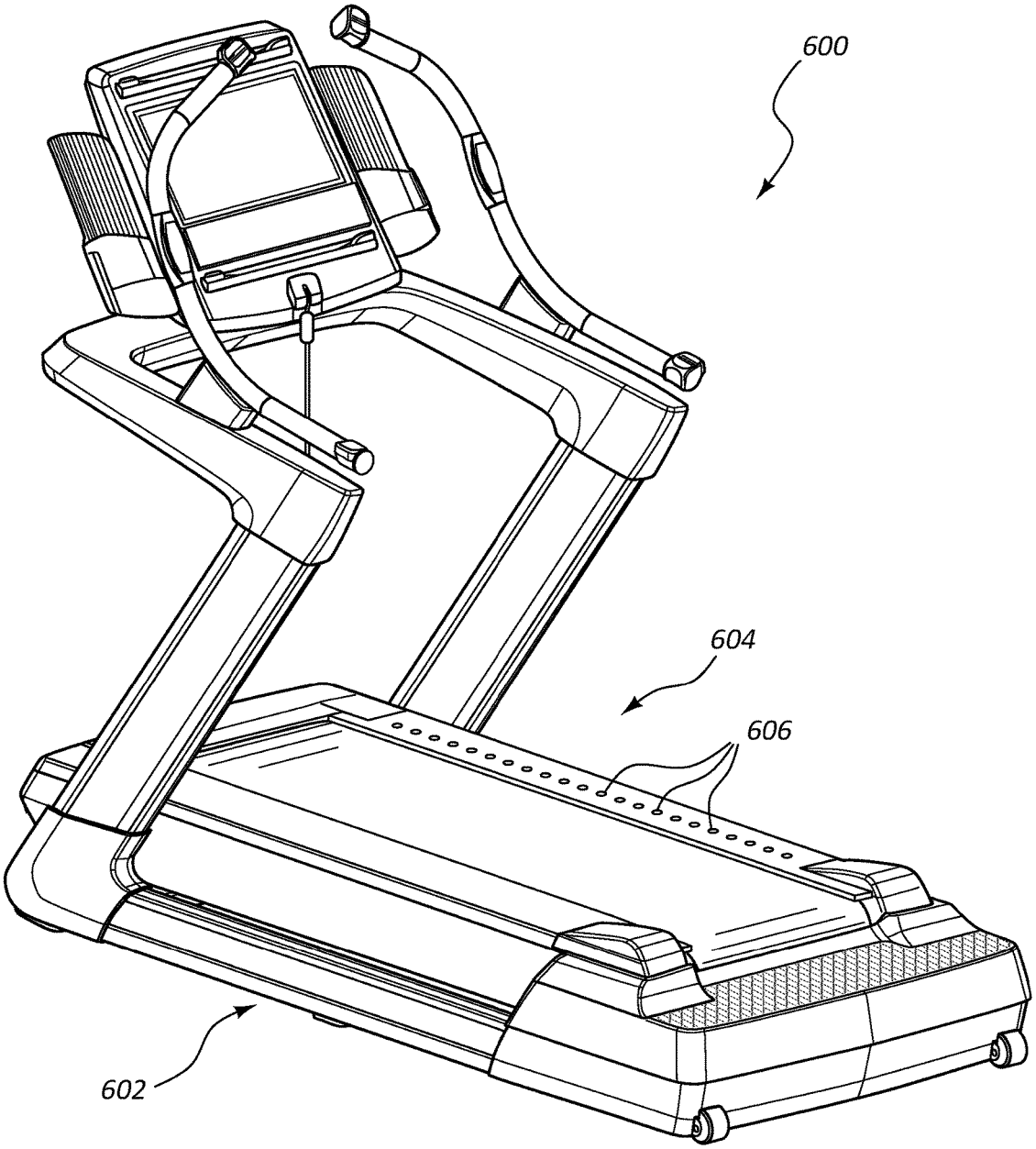
FIG. 6 illustrates a perspective view of an example of a treadmill in accordance with the present disclosure.

FIG. 6 depicts an example of the treadmill 600 with a deck 602. In this example, just a single side 604 of the deck 602 includes the lights 606 that illuminate based at least in part on the tread belt's speed.

GENERAL DESCRIPTION

In general, the invention disclosed herein may provide users with a treadmill that can pace a user of a treadmill. A pacing mechanism incorporated into the treadmill can help the user stay on pace by providing indicators that help the user visually understand how fast the user has to move his or her feet to maintain the pace.

The exercise deck may include a platform that has a first pulley located in a front portion of the deck and a second pulley located in a rear portion of the deck. A tread belt may surround the first and second pulleys and provide a surface on which the user may exercise. At least one of the first pulley and the second pulley may be connected to a motor so that when the motor is active, the pulley rotates. As the pulley rotates, the tread belt moves as well. The user may exercise by walking, running, or cycling on the tread belt's moving surface. In other examples, the tread belt is moved with the user's own power.

The exercise deck may be capable of having its front portion raised and lowered as well as its rear portion raised and lowered to control the lengthwise slope of the running deck. With these elevation controls, the orientation of the running deck can be adjusted as desired by the user or as instructed by a programmed workout. In those examples where the treadmill is involved with simulating a route that involves changes in elevation, the running deck can be oriented to mimic the elevation changes in the route.

In some cases, the treadmill includes a console. The console may locate the input mechanism within a convenient reach of the user to control the operating parameters of the exercise deck. For example, the control console may include controls to adjust the speed of the tread belt, adjust a volume of a speaker integrated into the treadmill, adjust an incline angle of the running deck, adjust a decline of the running deck, adjust a lateral tilt of the running deck, select an exercise setting, control a timer, change a view on a display of the control console, monitor the user's heart rate or other physiological parameters during the workout, perform other tasks, or combinations thereof. Buttons, levers, touch screens, voice commands, or other mechanisms may be incorporated into the control console incorporated into the treadmill and can be used to control the capabilities mentioned above. Information relating to these functions may be presented to the user through the display. For example, a calorie count, a timer, a distance, a selected program, an incline angle, a decline angle, a lateral tilt angle, another type of information, or combinations thereof may be presented to the user through the display.

The treadmill may include preprogrammed workouts that simulate an outdoor route. In other examples, the treadmill has the capability of depicting a real world route. For example, the user may input instructions through the control console, a mobile device, another type of device, or combinations thereof to select a course from a map. This map may be a map of real world roads, mountain sides, hiking trails, beaches, golf courses, scenic destinations, other types of locations with real world routes, or combinations thereof. In response to the user's selection, the display of the control console may visually depict the beginning of the selected route. The user may observe details about the location, such as the route's terrain and scenery. In some examples, the display presents a video or a still frame taken of the selected area that represents how the route looked when the video was taken. In other examples, the video or still frame is modified in the display to account for changes to the route's location, such as real time weather, recent construction, and so forth. Further, the display may also add simulated features to the display, such as simulated vehicular traffic, simulated flora, simulated fauna, simulated spectators, simulated competitors, or other types of simulated features. While the various types of routes have been described as being presented through the display of the control console, the route may be presented through another type of display, such as a home entertainment system, a nearby television, a mobile device, another type of display, or combinations thereof.

In addition to simulating the route through a visual presentation of a display, the treadmill may also modify the orientation of the running deck to match the inclines and slopes of the route. For example, if the beginning of the simulated route is on an uphill slope, the running deck may be caused to alter its orientation to raise the front portion of the running deck. Likewise, if the beginning of the simulated route is on a downward slope, the rear portion of the running deck may be caused to elevate to simulate the decline in the route. Also, if the route has a lateral tilt angle, the running deck may be tilted laterally to the appropriate side of the running deck to mimic the lateral tilt angle.

As the user begins to walk or run on the running deck, the display may change the scenery to mimic what the user would see if the user were actually at the real world location of the selected route. For example, a tree or another object located along the route that appears to be in the distance when the user is simulated to be at the beginning of the route may appear progressively closer as the user walks or runs on the running deck based on the speed at which the user is simulated to be traveling. Additionally, as the inclines and slopes of the simulated route change as the user progresses along the simulated route, the running deck can adjust to account for these terrain changes. For example, if the steepness of an uphill incline increases in the route, the running deck can likewise increase the incline of the running deck to mimic the change in steepness. Further, if the lateral angle of the route changes, the running deck can tilt laterally to one side to mimic the route's lateral angle.

While the programmed workout or the simulated environment may send control signals to orient the deck, the user may, in some instances, override these control signals with inputs from the console. For example, if the programmed workout or the simulated environment cause the deck to be steeper than the user desires, the user can adjust the deck's orientation through the console.

The treadmill may also include a pacing mechanism that creates visible cues for the user to follow to maintain or get onto the appropriate pace. The pacing mechanism may determine the pace for the user based, at least in part, on the speed of the tread belt. Other factors that may be considered by the pacing mechanism include the user's stride, the user's height, the incline of the deck, other factors, or combinations thereof.

The pacing mechanism may obtain the user's stride length from the user. In some cases, the user may input the stride length into the treadmill's console. In other examples, the pacing mechanism may have access to a personal profile of the user. In this circumstance, the personal profile may include the user's stride length among other types of information. For example, the other types of information may include the user's age, health, fitness history, health history, gender, height, weight, body weight composition, other types of information, or combinations thereof.

In alternative embodiments, the pacing mechanism may determine the user's stride length. For example, the treadmill may include sensors that can measure parameters indicative of the user's stride length. In one case, pressure sensors may be incorporated into the deck that determines where the user's feet land and come off of the tread belt. In other examples, cameras are employed on the treadmill to determine the user's stride length. In other examples, motor loads can be compared to the tread belt's speed to determine how long the user's feet are in contact with the tread belt. In yet other examples, the user's shoe may include a magnet or another type of detectable object that can be tracked with sensors on the treadmill or associated with the treadmill to determine the user's stride length.

The pacing mechanism may include a light that is incorporated into the treadmill's deck. The light may be located in the front portion of the deck, side portions of the deck, rear portions of the deck, the handle bars, the console, the upright structure, other locations on the treadmill, or combinations thereof. In one situation, the light may illuminate at a frequency that corresponds to the time that the user's foot has to land on the tread belt to maintain the pace. In another situation, the light may illuminate at a frequency that corresponds to the time that the user's foot has to come off of the tread belt to maintain the pace. The light can be located on the treadmill so that the light is easily visible to the user during the performance of the user's workout.

In another example, the pace setting device includes multiple lights that are distributed along at least one side of the treadmill's deck. These lights may form a line along the deck's length. Each light in the line may correspond to a location that the user's foot has to be to maintain the pace. Thus, the lights may temporarily illuminate when the user's foot should be within the corresponding location on the tread belt. Accordingly, as the user's foot is to move along the length of the deck, the lights on the deck's side illuminate one by one in a sequential order. In this example, if the user's foot is on pace and timed with the pacing mechanism, the user's foot moves past the lights as the lights are illuminating. As the user's foot reaches the rear portion of the treadmill, the user lifts his or her foot off of the tread belt and returns the foot to the forward portion of the tread belt. Likewise, the lights on the deck's side illuminate in a sequential order from the deck's forward lights progressively towards the deck's rearward lights. At that moment when the user's foot is to be returned to the forward position on the tread belt, one of the deck's forward lights illuminates indicating that the user's foot is to return to maintain the pace. The deck's next rearward light to the forward illuminating light then lights up as the user's foot is now moving down the deck. Then the adjacent light on the rearward side to the most recently illuminated light also lights up after a short delay as the user's foot is to move past the adjacent light towards the rearward portion of the deck. Thus, each light along the deck lights up as the foot moves past each light until the foot reaches the location where the foot is to be lifted off of the tread belt. The corresponding light to the lift-off location is the last light in the line to illuminate before one of the forward lights illuminates.

In some cases, the forward light that illuminates when the foot is returned is the forward most light in the line. But, in some cases, another light in the forward section of the treadmill lights up. In this circumstance, the user's stride length may not be long enough to where the user can comfortably reach to the location that corresponds with the forward most light. In other circumstances, the pacing mechanism may encourage the user to run at a stride that is less than what the user can comfortably run at.

Similarly, the last rearward light that illuminates when the foot is to be lifted off of the tread belt may be the rearward most light in the line of lights. But, in some cases, another light in the rearward section of the deck may be the last light to light up. In this circumstance, the user's stride length may not be long enough to where the user can comfortably reach the location the corresponds with the rearward most light. In other circumstances, the pacing mechanism may encourage the user to run at a stride that is less than what the user can comfortably run at.

The pacing mechanism may encourage the user to shorten his or her stride when the deck is inclined, declined, tilted, or otherwise oriented in a manner that may benefit from a shorter stride. In other examples, the simulated environment depicted in the user's console may include a snow patch or other type of terrain where a user may benefit from changing his or her stride if the user were in the actual environment being simulated. In this case, as part of the simulation, the pacing mechanism may encourage the user to shorten or otherwise change his or her stride. In yet another example where the user is following a programmed workout, changing the user's stride length may be part of the programmed workout. The programmed workout may incorporate stride length changes to change the intensity of the workout. The variable intensity and continuous nature of changing the user's stride may place stress on both the user's aerobic and anaerobic systems. These types of stress may build the user's strength, increase endurance, promote fat burning, and increase fitness ability for sports that involve changing intensities.

In another embodiment, a first subset of lights may be incorporated along the deck's length on a first side of the deck, and a second subset of lights may be incorporated along the deck's length on a second side of the deck. The first subset of lights may set the pace for the user's first foot proximate the first side, and the second subset of lights may set the pace for the user's second foot proximate the second side. Accordingly, the first subset of lights and the second subset of lights are offset to mimic the running patterns intended for each of the user's feet to maintain the pace.

In some embodiments, when a first light illuminates, a second light, adjacent to the first light, illuminates before the first light turns off. In some instances, the first light may have turned off before the second light is illuminated. Further, the second light may illuminate within one minute of the first light illuminating, within ten seconds of the first light illuminating, with five seconds of the first light illuminating, within one second of the first light illuminating, within 100 microseconds of the first light illuminating, within another time period, or combinations thereof.

Any appropriate number of lights may be positioned along the length of the deck. In one example, a single light is positioned along the length of the deck to pace the user. In another example, two to five lights are used along a single side of the deck to pace the user. In yet another example, six to twenty lights are used along a single side of the deck to pace the user. In an additional example, over twenty lights are used along a single side of the deck to pace the user.

In some cases, the lights used to pace the user are the same color. In yet another example, at least some of the lights are different colors. For example, the lights along the same side of the deck may have different colors. In another example, a first subset of lights on a first side of the deck may have a different color than a second subset of lights positioned on a second side of the deck.

While the examples above have been described with reference to multiple lights being arranged along the length of the deck in a line, any appropriate type of arrangement may be used in accordance with the principles described in the present disclosure. For example, the lights may be arranged in a curved arrangement, a zigzag arrangement, another type of arrangement, or combinations thereof.

The pacing mechanism may include a combination of hardware and programmed instructions for executing the functions of the pacing mechanism. The pacing mechanism may include processing resources that are in communication with memory resources. Processing resources include at least one processor and other resources used to process the programmed instructions. As described herein, the memory resources may represent generally any memory capable of storing data such as programmed instructions or data structures used by the pacing mechanism.

The processing resources may include I/O resources that are capable of being in communication with a remote device that stores the user information, workout history, external resources, databases, or combinations thereof. The remote device may be a mobile device, a cloud based device, a computing device, another type of device, or combinations thereof. In some examples, the pacing mechanism communicates with the remote device through a mobile device which relays communications between the pacing mechanism and the remote device. In other examples, the mobile device has access to information about the user.

The remote device may execute a program that can provide useful information to the pacing mechanism. An example of a program that may be compatible with the principles described herein includes the iFit program which is available through www.ifit.com. An example of a program that may be compatible with the principles described in this disclosure is described in U.S. Pat. No. 7,980,996 issued to Paul Hickman. U.S. Pat. No. 7,980,996 is herein incorporated by reference for all that it discloses. In some examples, the user information accessible through the remote device includes the user's age, gender, body composition, height, weight, health conditions, other types of information, or combinations thereof.

The processing resources, memory resources, and remote devices may communicate over any appropriate network and/or protocol through the input/output resources. In some examples, the input/output resources includes a transmitter, a receiver, a transceiver, or another communication device for wired and/or wireless communications. For example, these devices may be capable of communicating using the ZigBee protocol, Z-Wave protocol, BlueTooth protocol, Wi-Fi protocol, Global System for Mobile Communications (GSM) standard, another standard, or combinations thereof. In other examples, the user can directly input some information into the pacing mechanism through a digital input/output mechanism, a mechanical input/output mechanism, another type of mechanism, or combinations thereof.

The memory resources may include a computer readable storage medium that contains computer readable program code to cause tasks to be executed by the processing resources. The computer readable storage medium may be a tangible and/or non-transitory storage medium. The computer readable storage medium may be any appropriate storage medium that is not a transmission storage medium. A non-exhaustive list of computer readable storage medium types includes non-volatile memory, volatile memory, random access memory, write only memory, flash memory, electrically erasable program read only memory, magnetic based memory, other types of memory, or combinations thereof.

The memory resources may include a belt speed determiner that represents programmed instructions that, when executed, causes the processing resources to determine the speed of the belt. The belt speed determiner may measure the speed of the belt with a sensor to determine the belt's speed. The memory resources may also include a pace input receiver that represents programmed instructions that, when executed, causes the processing resources to receive an input about the pace. In this example, the user may input that the tread belt is to move at a certain speed. The pacing mechanism may use the user's input to determine what speed the tread belt is traveling. Also, the memory resources may include a programmed routine executor that represents programmed instructions that, when executed, causes the processing resources to execute a programmed workout and/or a simulated environment. In this case, the programmed workout and/or simulated workout may communicate the belt's speed to the pacing mechanism.

Each of the belt speed determiner, the pace input receiver, and the programmed routine executor may be used to determine the tread belt's speed. The pace determiner may represent programmed instructions that, when executed, cause the processing resources to determine the pace that the user has to move to maintain the pace. In some cases, the memory resources further include a stride length determiner that represents programmed instructions that, when executed, cause the processing resources to determine the user's stride length. In this example, the pace determiner may determine the pace based on the belt speed and on the user's stride. The pacing mechanism may also include a stride adjustor that adjusts the stride depicted with the lights by changing the range of lights that illuminate.

Further, the memory resources may be part of an installation package. In response to installing the installation package, the programmed instructions of the memory resources may be downloaded from the installation package's source, such as a portable medium, a server, a remote network location, another location, or combinations thereof. Portable memory media that are compatible with the principles described herein include DVDs, CDs, flash memory, portable disks, magnetic disks, optical disks, other forms of portable memory, or combinations thereof. In other examples, the program instructions are already installed. Here, the memory resources can include integrated memory such as a hard drive, a solid state hard drive, or the like.

In some examples, the processing resources and the memory resources are located within the treadmill, a mobile device, an external device, another type of device, or combinations thereof. The memory resources may be part of any of these device's main memory, caches, registers, non-volatile memory, or elsewhere in their memory hierarchy. Alternatively, the memory resources may be in communication with the processing resources over a network. Further, data structures, such as libraries or databases containing user and/or workout information, may be accessed from a remote location over a network connection while the programmed instructions are located locally.

What is claimed is:

1. A treadmill, comprising:

an exercise deck, the exercise deck including:

a platform;

a first pulley attached to the platform in a front portion;

a second pulley attached to the platform in a rear portion;

a tread belt surrounding the first pulley and the second pulley; and a pacing mechanism incorporated into the platform, wherein the pacing mechanism includes multiple lights that illuminate sequentially.

2. The treadmill of claim 1, wherein the multiple lights are distributed along a length of the platform.

3. The treadmill of claim 1, wherein the pacing mechanism includes a first set of multiple lights and a second set of multiple lights.

4. The treadmill of claim 3, wherein the first set of multiple lights and second set of multiple lights are set to temporarily illuminate during a predetermined duration of time at a frequency based at least in part on a speed of the tread belt.

5. The treadmill of claim 1, wherein a pace of the pacing mechanism is based on at least in part on a speed of the treadmill.

6. The treadmill of claim 1, further including:

a console; and memory and a processor, the memory including programmed instructions, when executed, that cause the processor to selectively illuminate one of multiple lights based on a pace.

7. The treadmill of claim 6, wherein the programmed instructions, when executed, further cause the processor to receive a pace input from a user.

8. The treadmill of claim 6, wherein the programmed instructions, when executed, further cause the processor to execute a programmed exercise routine where the programmed exercise routine contains the pace.

9. The treadmill of claim 1, wherein the pacing mechanism further includes:

a first portion on a first side of the platform between the front portion and the rear portion; and a second portion on a second side of the platform between the front portion and the rear portion.

10. The treadmill of claim 9, wherein the first portion includes:

a first subset of multiple lights distributed along a length of the platform that illuminate sequentially based on a pace; and a second subset of the multiple lights distributed along the length of the platform that illuminate sequentially based on the pace.

11. The treadmill of claim 10, wherein the first subset of the multiple lights illuminate sequentially based at least in part on a speed and a movement that a user's first foot has to travel to maintain the pace; and wherein the second subset of the multiple lights illuminate sequentially based at least in part on the speed and the movement that a user's second foot has to travel to maintain the pace.

12. A treadmill, comprising:

an exercise deck, the exercise deck including:

a platform;

a first pulley attached to the platform in a front portion;

a second pulley attached to the platform in a rear portion;

a tread belt surrounding the first pulley and the second pulley; and multiple lights distributed along a length of the platform.

13. The treadmill of claim 12, wherein the multiple lights illuminate sequentially based at least in part on a speed of the tread belt.

14. The treadmill of claim 12, further including:

a console; and memory and a processor, the memory including programmed instructions, when executed, that cause the processor to selectively illuminate one of multiple lights based on a pace.

15. The treadmill of claim 14, wherein the programmed instructions, when executed, further cause the processor to receive a pace input from a user.

16. The treadmill of claim 14, wherein the programmed instructions, when executed, further cause the processor to execute a programmed exercise routine where the programmed exercise routine contains the pace.

17. The treadmill of claim 12, wherein the multiple lights further includes:

a first portion on a first side of the platform between the front portion and the rear portion; and a second portion on a second side of the platform between the front portion and the rear portion.

18. The treadmill of claim 17, wherein the first portion includes:

a first subset of multiple lights distributed along the length of the platform that illuminate sequentially based on a pace; and a second subset of the multiple lights distributed along the length of the platform that illuminate sequentially based on the pace.

19. The treadmill of claim 18, wherein the first subset of the multiple lights illuminate sequentially based at least in part on a speed and a movement that a user's first foot has to travel to maintain the pace; and wherein the second subset of the multiple lights illuminate sequentially based at least in part on the speed and the movement that a user's second foot has to travel to maintain the pace.

20. A treadmill, comprising:

an exercise deck, the exercise deck including:

a platform;

a first pulley attached to the platform in a front portion;

a second pulley attached to the platform in a rear portion;

a tread belt surrounding the first pulley and the second pulley;

a pacing mechanism incorporated into the platform;

the pacing mechanism includes multiple lights distributed along a length of the platform that illuminate sequentially based at least in part on a speed of the tread belt;

a first portion on a first side of the platform between the front portion and the rear portion where a first subset of multiple lights are distributed along the length of the platform that illuminate sequentially based at least in part on the speed of the tread belt; and a second portion on a second side of the platform between the front portion and the rear portion where a second subset of the multiple lights distributed along the length of the platform that illuminate sequentially based at least in part on the speed of the tread belt.

* * * * *